US006064850A

United States Patent [19]

Matsuo et al.

[11] Patent Number: 6,064,850

[45] **Date of Patent: *May 16, 2000**

[54] IMAGE FORMATION APPARATUS

[75] Inventors: Minoru Matsuo, Sagamihara; Toshio Kobayashi, Atsugi; Yuichi Jibiki, Yokohama, all of Japan

[73] Assignee: Ricoh Company, Ltd., Tokyo, Japan

[ * ] Notice: This patent is subject to a terminal disclaimer.

[21] Appl. No.: 09/309,344

[22] Filed: May 11, 1999

Related U.S. Application Data

[63] Continuation of application No. 08/976,043, Nov. 21, 1997, Pat. No. 5,960,244, which is a continuation of application No. 08/725,713, Oct. 4, 1996, Pat. No. 5,740,513.

[30] Foreign Application Priority Data

| | | | |
|---|---|---|---|
| Oct. 4, 1995 | [JP] | Japan | 7-257846 |
| Oct. 4, 1995 | [JP] | Japan | 7-257848 |
| Oct. 4, 1995 | [JP] | Japan | 7-257853 |
| Oct. 4, 1995 | [JP] | Japan | 7-257855 |
| Oct. 4, 1995 | [JP] | Japan | 7-257857 |
| Oct. 4, 1995 | [JP] | Japan | 7-257858 |

[51] Int. Cl.[7] ..... G03G 15/20

[52] U.S. Cl. ..... 399/333; 399/69; 399/330; 399/335; 430/124

[58] Field of Search ..... 399/21, 27, 30, 399/33, 67, 69, 70, 320, 328, 330, 331, 333, 335; 219/216; 430/124

[56] References Cited

U.S. PATENT DOCUMENTS

| | | | |
|---|---|---|---|
| 4,984,027 | 1/1991 | Derimiggio et al. | 399/331 |
| 5,115,279 | 5/1992 | Nishikawa et al. | 399/331 |
| 5,274,423 | 12/1993 | Kusumoto | 399/69 |
| 5,276,493 | 1/1994 | Hediger et al. | 399/333 |
| 5,376,996 | 12/1994 | Sankaran | 399/330 |
| 5,432,593 | 7/1995 | Nishikawa et al. | 399/328 |
| 5,450,183 | 9/1995 | O'Leary | 399/321 |
| 5,740,513 | 4/1998 | Matsuo et al. . | |
| 5,804,794 | 9/1998 | Matsuo et al. . | |

*Primary Examiner*—Sandra Brase

*Attorney, Agent, or Firm*—Oblon, Spivak, McClelland, Maier & Neustadt, P.C.

[57] ABSTRACT

An image formation apparatus includes an image fixing roller for performing thermal image fixing, which image fixing roller includes an exothermic phase transition layer capable of performing reversible phase transition from an amorphous state to a crystalline state and vice versa, with liberation of crystallization heat at the phase transition from the amorphous state to the crystalline state, and the crystallization heat is used for increasing the temperature elevation rate for the image fixing roller.

22 Claims, 47 Drawing Sheets

IMAGE FORMATION APPARATUS

This application is a Continuation of application Ser. No. 08/976,043, now U.S. Pat. No. 5,960,244 filed on Nov. 21, 1997, which is a Continuation of application Ser. No. 08/725,713, filed on Oct. 4, 1996, now U.S. Pat. No. 5,740,513.

Japanese Patent Applications Nos. 7-257846, 7-257848, 7-257853, 7-257855, 7-257857 and 7-257858, filed Oct. 4, 1995, are hereby incorporated by reference.

BACKGROUND OF THE INVENTION

1. Field of the Invention

The present invention relates to an image formation apparatus such as an electrophotographic copying machine, facsimile apparatus, or a printer, for instance, comprising an image fixing apparatus for fixing toner images on an image receiving material such as an image transfer sheet or the like, more particularly to an image formation apparatus which comprises an image fixing roller comprising an exothermic phase transition layer provided on a core roller member, capable of performing reversible phase transition from an amorphous state to a crystalline state and vice versa, with liberation of crystallization heat therefrom, thereby additionally increasing the temperature elevation rate before the temperature of the outer peripheral surface of the image fixing roller reaches the predetermined image fixing temperature.

2. Discussion of Background

In a conventional electrophotographic copying machine, for instance, provided with a laser printer, a rotatable photoconductor drum is provided, and copies are made with the following steps: A photoconductive portion of the photoconductive drum is uniformly charged by a charging unit, and information is recorded in the form of latent electrostatic images by the application of a laser beam thereto by a laser scanning unit. The latent electrostatic images are then developed with toner to toner images by a development unit in the electrophotographic copying machine. The developed toner images are then transferred to a recording sheet. The toner-images-bearing recording sheet is then passed through a thermal image fixing apparatus, in which the toner images are thermally fixed to the recording sheet. Thus, copies are made by the conventional electrophotographic copying machine.

In the above-mentioned conventional thermal image fixing apparatus, for instance, an image fixing roller as illustrated in FIG. 8 is employed, which is composed of a hollow core cylinder 31 which is made of, for instance, aluminum, and a toner-releasing layer 32 which is made of, for instance, a fluoroplastic, and provided on the outer peripheral surface of the hollow core cylinder 31. The toner-releasing layer 32 is capable of preventing toner from adhering to the outer peripheral surface of the image fixing roller during the image fixing process, and releasing toner from the surface of the image fixing roller.

In the image fixing roller, a heater (not shown) such as a halogen lamp is provided in a vacant portion within the hollow core cylinder 31 along the revolution axis thereof (not shown), whereby the image fixing roller is heated from the inside thereof by the radiation heat from the heater.

In parallel with the image fixing roller, there is provided a pressure application roller (not shown) which comes into pressure contact with the peripheral surface of the image fixing roller. The image fixing roller and the pressure application roller are rotated in the same direction in the contact portion where the two rollers are mutually in pressure contact, and the toner-images-bearing recording sheet is transported so as to pass through the contact portion between the two rollers, whereby the toner images transferred to the recording sheet are softened by the heat from the image fixing roller and fixed to the recording sheet which is held between the two rollers, under the application of the pressure thereto by the pressure application roller.

In such a thermal image fixing apparatus, however, a relatively long warm-up time is required before the outer peripheral surface of the image fixing roller reaches a predetermined image fixing temperature required for toner image fixing after the thermal image fixing apparatus is powered.

Conventionally, in order to shorten the warm-up time, the main switch for the image fixing apparatus is designed in such a manner that when turned on, the preheating of the image fixing roller is started and continued. This method, however, has the shortcoming of wasting a significant amount of power.

Further, in order to avoid the above problem, there have been proposed, for example, the following various methods for shortening the worm-up time for such an image fixing roller:

A method of providing a resistive heat emitting layer at or near the peripheral surface of an image fixing roller (Japanese Laid-Open Patent Applications 55-164860, 56-138766 and 2-285383); a method of blackening the inner wall of a hollow portion of an image fixing roller to increase the radiant efficiency thereof, thereby increasing the heat absorption efficiency, and a method of increasing the surface area of the inner wall of a hollow portion of an image fixing roller by roughening the surface of the inner wall (Japanese Laid-Open Patent Applications 4-34483 and 4-134387); a method of constructing an image fixing roller composed of a heat pipe (Japanese Laid-Open Patent Application 3-139684); a method of heating an image fixing roller by electromagnetic induction (Japanese Patent Laid-Open Application 4-55055); a method of constructing an image fixing roller by use of an electroconductive elastic material and causing electric current to flow therethrough, thereby directly heating the image fixing roller (Japanese Laid-Open Patent Application 4-186270); and a method of constructing an image fixing roller which includes a cylindrical heater in which a positive thermistor material is used (Japanese Laid-Open Patent Application 4-42185).

In order to make the above-mentioned methods actually effective in practical use, it is required that the core roller for each of the image fixing rollers have good heat conductivity. However, there is a limitation to the reduction of the thickness of the core roller for increasing the heat conductivity in view of the mechanical strength required for the image fixing roller for use in practice. Therefore the above-mentioned methods are not always practical. Furthermore, a large amount of energy has to be applied to the heating elements such as heaters for the image fixing rollers in order to sufficiently shorten the warm-up time for such conventional image fixing rollers.

Furthermore, in Japanese Laid-Open Patent Application 7-104823, there is disclosed an image fixing roller comprising a phase transition layer which is capable of performing reversible phase transition from an amorphous state to a crystalline state and vice versa, liberating crystallization heat when the phase transition from the amorphous state to the crystalline state is carried out with the application of heat thereto. In this image fixing roller, the use of the liberated crystallization heat makes it possible to shorten the time required for elevating the temperature of the image fixing roller to the image fixing temperature thereof.

However, when the above-mentioned image fixing roller is actually used in the image formation apparatus, in particular, when the image fixing roller is used after an intermission of the image formation apparatus, if the phase transition layer of the image fixing roller is not in the amorphous state before the next use thereof, the above-mentioned crystallization heat cannot be used readily.

The above-mentioned intermission occurs in practical use of the image formation apparatus, for example, when the operation of the image formation apparatus is stopped after making copies, or when the image formation apparatus is provided with a preheating function and the preheating function is actually used.

SUMMARY OF THE INVENTION

It is therefore an object of the present invention to provide an image formation apparatus comprising:

an image fixing roller for thermally fixing images on an image receiving material at a predetermined image fixing temperature, the image fixing roller comprising (a) a core roller member; and (b) an exothermic phase transition layer provided on the core roller member, comprising an exothermic phase transition material which performs reversible phase transition from an amorphous state to a crystalline state and vice versa, and crystallizing at a crystallization temperature which is lower than the predetermined image fixing temperature, with liberation of crystallization heat therefrom, and the exothermic phase transition material having a melting point higher than the predetermined image fixing temperature, thereby additionally increasing the temperature elevation rate before the temperature of an exterior of the image fixing roller reaches the predetermined image fixing temperature;

a heater for setting the image fixing roller in an image fixing mode by heating the exterior of the image fixing roller to the predetermined image fixing temperature and maintaining the temperature of the exterior of the image fixing roller at the predetermined image fixing temperature, or for setting the image fixing roller in a preheating mode by heating the exterior of the image fixing roller to a predetermined preheating temperature which is below the predetermined image fixing temperature and maintaining the temperature of the exterior of the image fixing roller at the predetermined preheating temperature;

first phase transition means for performing the phase transition of the exothermic phase transition material from the amorphous state to the crystalline state by heating the exothermic phase transition layer for liberation of the crystallization heat therefrom;

second phase transition means for performing the phase transition of the exothermic phase transition material from the crystalline state to the amorphous state via a melted state by cooling the exothermic phase transition layer for successive phase transition of the exothermic phase transition material from the amorphous state to the crystalline state for utilizing the crystallization heat;

image formation operation detection means for detecting whether or not the image formation apparatus is in operation for a predetermined period of time; and phase transition activation means for activating the second phase transition means transition means for performing the phase transition when such detection is made by the operation detection means that the image formation apparatus is not in operation for the predetermined period of time.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2(*b*) is a cross-sectional view of panel opening prohibition means when the main body panel is closed.

DESCRIPTION OF THE PREFERRED EMBODIMENTS

Figure 1:
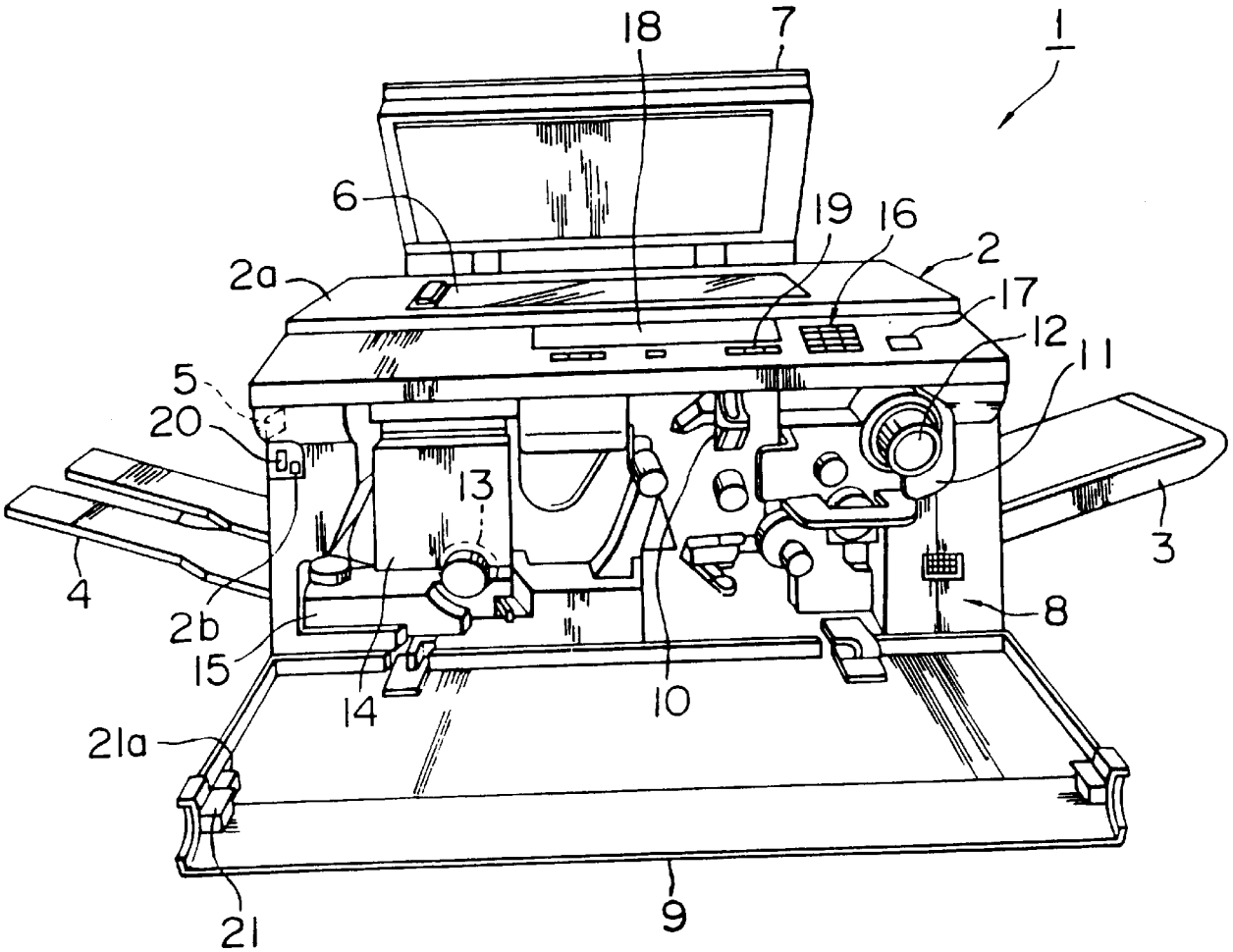
FIG. 1 is a perspective front view of an example of an image formation apparatus according to the present invention, with a main body panel being opened.

FIG. 1 is a perspective view of an example of an image formation apparatus according to the present invention, which is an electrophotographic copying machine. Reference numeral 1 indicates the copying machine which comprises a main body 2, a paper feed cassette 3 which is detachably inserted into a paper feed inlet (not shown) formed on one side of the main body 3, and a paper discharge tray 4 which is detachably provided under a paper discharge outlet (not shown) formed at the other side of the main body 2.

In the copying machine 1, a plurality of paper feed cassettes may be provided.

The main body 2 is provided with a main switch 5 on the other side thereof, a contact glass 6 provided on an upper surface 2*a* thereof, a pressure plate 7 which covers a document or book (not shown) placed on the contact glass 6, and a main body panel 9 which covers a copying mechanical portion 8 of the copying machine 1 and can be opened and shut.

The copying mechanical portion 8 comprises a drum-shaped photoconductor (not shown), a charging unit 10 for uniformly charging the surface of the photo conductor, an exposure unit (not shown), a development unit 11, a toner bottle 12, an image transfer unit 14 provided with an image transfer roller 13, and a discarded toner recovery bottle 15 for recovering a toner which is discarded when transferred or fixed.

When the main switch 5 is ON, the operation of each drive system for the above-mentioned units is initiated by pressing a start switch 17 of an operation and display section 16 provided on the upper surface 2*a* of the main body 2. At that moment, the number of copies and the state of each function are displayed on a liquid crystal display panel 18. A preheating mode selection switch 19 is provided in the operation and display section 16.

It is also possible to carry out the preheating mode automatically when the copy making operation is not performed for a predetermined period of time, without the provision of the preheating mode selection switch 19.

On an inner wall 9*a* of the main body panel 9, there is provided a metal plate 21 for keeping the main body panel 9 in a closed state by the metal plate 21 being magnetically attracted to a magnet 20 which is provided on the main body 2.

The metal plate 21 is provided with a projected piece 21*a* which is inserted into an opening 2*b* formed in the main body 2 when the main body panel 9 is closed.

Figure 2A:
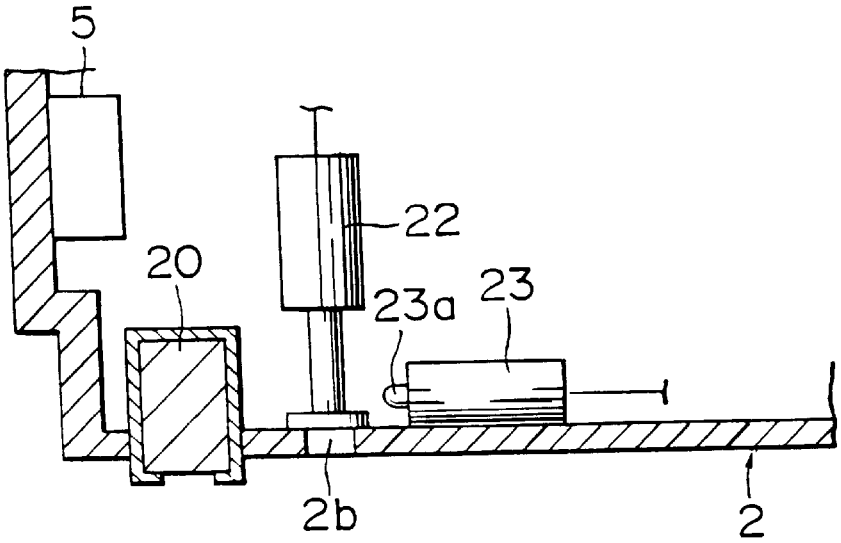
FIG. 2(*a*) is a cross-sectional view of panel opening prohibition means when the main body panel is opened.
Figure 2B:
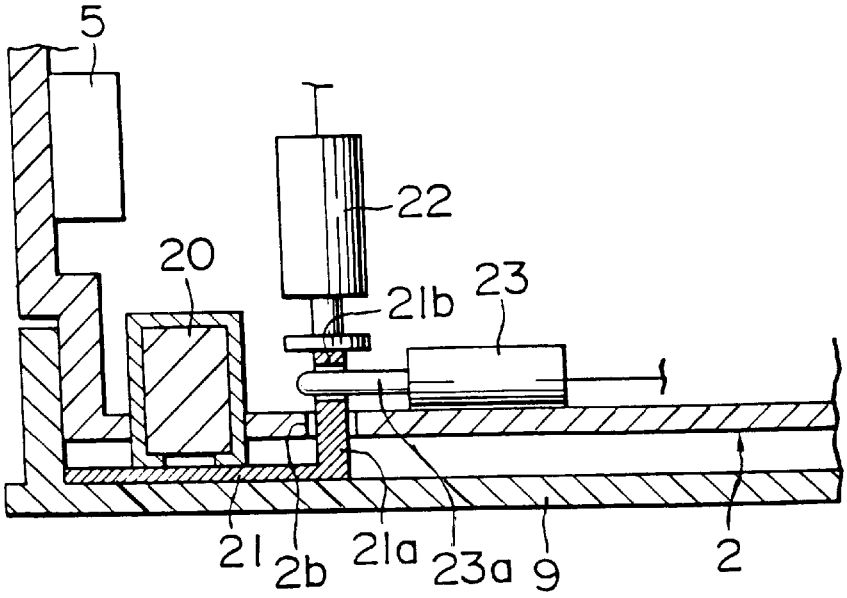

As shown in FIGS. 2(*a*) and 2(*b*), the tip of the projected piece 21*a* comes into contact with a panel opening and closing detection switch 22 which is provided on the main body 2, so that the opening or closing of the main body panel 9 can be detected.

A lock hole 21*b* is formed near the center of the projected piece 21*a*, so that when a pin 23*a* of a solenoid 23, which serves as closing prohibition means and is provided in the main body 2, is extended and engages with the lock hole 21*b*, the opening of the main body panel 9 is inhibited.

The method of inhibiting the opening of the main body panel 9 is not particularly limited to the abovementioned method. For the opening prohibition, there can be employed an electromagnet which attracts the metal plate 21, a wedge-shaped lock member which can engage the lock hole 21*b*, and a motor which can rotate the lock member in a normal direction and also in a reverse direction.

The image fixing roller of the present invention comprises (a) a core roller member; and (b) an exothermic phase transition layer comprising an exothermic phase transition material capable of performing reversible phase transition from an amorphous state to a crystalline state and vice versa, and crystallizing at a crystallization temperature which is lower than the predetermined image fixing temperature, with liberation of crystallization heat therefrom, and the exothermic phase transition material having a melting point higher than the predetermined image fixing temperature, thereby additionally increasing the temperature elevation rate before the temperature of the outer peripheral surface of the image fixing roller reaches the predetermined image fixing temperature.

Figure 3:
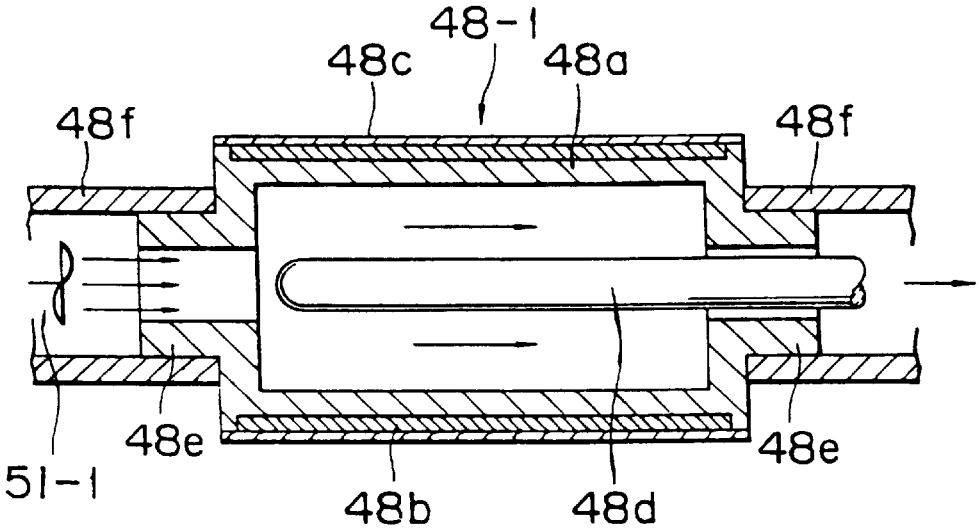
FIG. 3 is a schematic cross-sectional view of an image fixing roller for use in the image fixing apparatus for use in the present invention.

FIG. 3 schematically shows a cross-sectional view of the image fixing roller 48-1 for use in the image fixing apparatus for use in the present invention.

As the core roller member for use in the image fixing roller 48-1, for example, there can be a hollow cylindrical core metal 48*a* as illustrated in FIG. 3. As the material for the hollow cylindrical core metal 48*a*, conventionally employed materials with excellent thermal conductivity such as aluminum, aluminum alloys, and SUS, can be employed, but are not limited to such particular materials since the material for the core roller member is not restricted by the thermal conductivity thereof in the present invention.

On the outer peripheral surface of the hollow cylindrical core metal 48*a*, there is provided an exothermic phase transition layer 48*b*, which comprises an exothermic phase transition material.

In the present invention, it is required that the exothermic phase transition material be capable of performing reversible phase transition from an amorphous state to a crystalline state and vice versa, and crystallize at a crystallization temperature which is lower than the predetermined image fixing temperature, with liberation of crystallization heat therefrom, and that the exothermic phase transition material have a melting point higher than the predetermined image fixing temperature, in order to additionally increase the temperature elevation rate before the temperature of the outer peripheral surface of the image fixing roller reaches the predetermined image fixing temperature.

Currently the image fixing temperature is generally in the range of 180 to 200° C., so that in the case where the image fixing temperature is in the range of 180 to 200° C., it is preferable that the exothermic phase transition material crystallize at a temperature, for instance, in the range of 80° C. to 180° C., and that the exothermic phase transition material have a melting point higher than 200° C.

It is also preferable that the exothermic phase transition material be capable of repeatedly and easily performing reversible phase transition from an amorphous state to a crystalline state and vice versa, with liberation of crystallization heat at the crystallization temperature.

Examples of the exothermic phase transition material for use in the exothermic phase transition layer 48*b* are materials comprising a chalcogen such as O, S, Se or Te, or a chalcogenide.

Specific examples of the chalcogenide are alloys such as Si—S, Si—S—Sb, Si—Se—As, Si—Se—Sb, Si—Te, Si—Te—P, Si—Te—As, Si—As—Te, Si—Ge—As—Te, Si—Ge—As—Te, Ge—S, Ge—S—In, Ge—S—P, Ge—S—As, Ge—Se, Ge—Se—Tl, Ge—Se—P, Ge—Se—As, Ge—Se—Sb, Ge—Te—P, Ge—Te—As, Ge—As—Te, Ge—P—S, Ge—S, Ge—Sb—Se, Ge—As—Se, Ge—P—S, As—S—Se, As—S—Tl, As—S—Sb, As—S—Te, As—S—Br, As—S—I, As—S—Bi, As—S—Ge, As—S—Se—Te, As—Sb—Tl—S—Se—Te, As—Sb—P—S—Se—Te, As—Se—Cu, As—Se—Ag, As—Se—Au, As—Se—Zn, As—Se—Cd, As—Se—Hg, As—Se—Ga, As—Se—B, As—Se—Tl, As—Se—P, As—Se—Sb, As—Se—Te, As—Se—I, As—Se—In, As—Se—Sn, As—Se—Pb, As—Se—Ge, As—Se—Bi, As—Te—Tl, As—Te—I, As—Te—Ge, Sb—S, and C—S; oxides such as $SeO_2$; sulfides containing any of B, Ga, In, Ge, Sn, N, P, As, Sb, Bi, O, or Se; selenium compounds containing any of Ti, Si, Sn, Pb, P, As, Sb, Bi, O, Se, or Te; and tellurium compounds containing any of Ti, Sn, Pb, Sn, Bi, O, Se, As, or Ge.

The above-mentioned chalcogens and chalcogenides may also be used in combination.

Of the above-mentioned chalcogens and chalcogenide alloys, selenium and selenium-tellurium alloys are particularly preferable for use in the present invention. This is because selenium and selenium-tellurium alloys become amorphous from a melted state when cooled; and crystallize, with conspicuous and rapid liberation of crystallization heat, when heated up to a crystallization temperature in the range of 80 to 200° C.

The exothermic phase transition layer 48*a* may further comprise at least one additional component selected from the group consisting of the elements of Groups IIIA through VIB of the Periodic Table except the chalcogen, and a compound comprising any of the elements of Groups IIIA through VIB of the Periodic Table except the chalcogenide.

Specific examples of such an additional component are alloys such as Ge—As; oxides such as $P_2O_5$, $B_2O_3$, $As_2O_3$, $SiO_2$, $GeO_2$, $In_2O_3$, $Tl_2O_3$, $SnO_2$, $PbO_2$, $K_2B_4O_7NaPO_3$, $Na_2Si_2O_5$, $PbSiO_3$; and halogenides such as $BeF_2AlF_3$, $ZnCl_2$, AgCl, AgBr, AgI, $PbCl_2$, and $PbI_2$.

The exothermic phase transition material for use in the exothermic phase transition layer may also be a polymeric material capable of repeatedly and easily performing reversible phase transition from an amorphous state to a crystalline state and vice versa, with liberation of crystallization heat at the crystallization temperature.

The exothermic phase transition material for use in the exothermic phase transition layer may also comprise the above-mentioned exothermic polymeric material and the previously mentioned chalcogen or chalcogenide, optionally with further addition of at least one component selected from the group consisting of the elements of Groups IIIA through VIB of the Periodic Table except the chalcogen, and a compound comprising any of the elements of Groups IIIA through VIB of the Periodic Table except the chalcogenide.

Specific examples of the exothermic polymeric material for use in the exothermic phase transition layer in the present invention are polyethylene, polypropylene, polybutene, polyvinylidene fluoride, polyoxymethylene, polyoxyethylene, polyoxytetramethylene, polyoxyteramethylene, polyoxybischloromethyltrimethylene, polyethylene diadipate, polyethylene terephthalate, nylon-6, nylon-7, nylon-8, nylon-10, nylon-11, nylon-12, nylon-66, nylon-77, nylon-610, polybutylene terephthalate, polychlorotrifluoroethylene, polyvinyl alcohol, polyvinyl fluoride, polyvinylidene chloride, polychloroprene, polyethylene oxide, polytrifluorochloroethylene, polyvinyl methyl ether, polyacetal, polyphenylene sulfide, polyether ether ketone, thermoplastic fluoroplastics, aromatic polyester, polyisotactic butadiene, and polyteremethylene terephthalate.

In the image fixing apparatus for use in the present invention, the image fixing roller may further comprise a protective layer which is provided on the exothermic phase transition layer and seals the opposite ends thereof.

To be more specific, with reference to FIG. 3, a protective layer 48*c* made of, for example, fluoroplastic, is provided on the outer peripheral surface of the exothermic phase transition layer 48*b* and seals the opposite ends of the exothermic phase transition layer 48*b*, so that even when the exothermic phase transition material in the exothermic phase transition layer 48*b* is melted, the exothermic phase transition material is prevented from flowing out of the exothermic phase transition layer 48*b*.

The protective layer 48*c* may be composed of a material such as fluoroplastic, which prevents toner from adhering to the protective layer 48*c*. In this case, the protective layer 48*c* can also be used as a toner releasing layer.

Instead of the protective layer 48*c*, a toner releasing layer may be provided, which also may function as the above-mentioned protective layer.

Alternatively, as such a protective layer or a toner releasing layer, a heat-shrinkable tube made of, for example, tetrafluoroethylene—perfluoroalkylvinyl ether copolymer (PFA resin), may also be used so as to cover the exothermic phase transition layer 48*b*, with application of heat to the heat-shrinkable tube.

In the image fixing roller 48-1 shown in FIG. 3, a halogen lamp 48*d* is provided within the hollow cylindrical core metal 48*a* as heating means for heating the image fixing roller 48-1 so as to have the outer peripheral surface thereof reach and maintain the predetermined image fixing temperature.

The halogen lamp 48*d* also has the function of heating the exothermic phase transition layer 48*b* to perform phase transition of the exothermic phase transition material from the amorphous state to the crystalline state for liberation of the crystallization heat therefrom; and has the function of heating the exothermic phase transition material to change the crystalline phase of the exothermic phase transition material to a melted state.

On each of the opposite ends of the image fixing roller 48-1, there is formed an axial end portion 48*e*. Furthermore, a cylindrical support portion 48*f* is mounted on each of the axial end portion 48*e* in such a manner that the axial end portion 48*e* is rotatable on the cylindrical support portion 48*f*.

As shown in FIG. 3, inside the cylindrical support portion 48*f*, there is provided an air fan 51-1 as cooling means for rapidly cooling the exothermic phase transition layer 48*b* when performing the phase transition of the exothermic phase transition layer 48*b* from the crystalline state to the amorphous state via the melted state.

The pair of the cylindrical support portions 48*f* serves as the path for guiding cool air through the inside of the image fixing roller 48-1, whereby the exothermic phase transition layer 48*b* is efficiently cooled for the phase transition thereof from the crystalline state to the amorphous state via the melted state.

Figure 4:
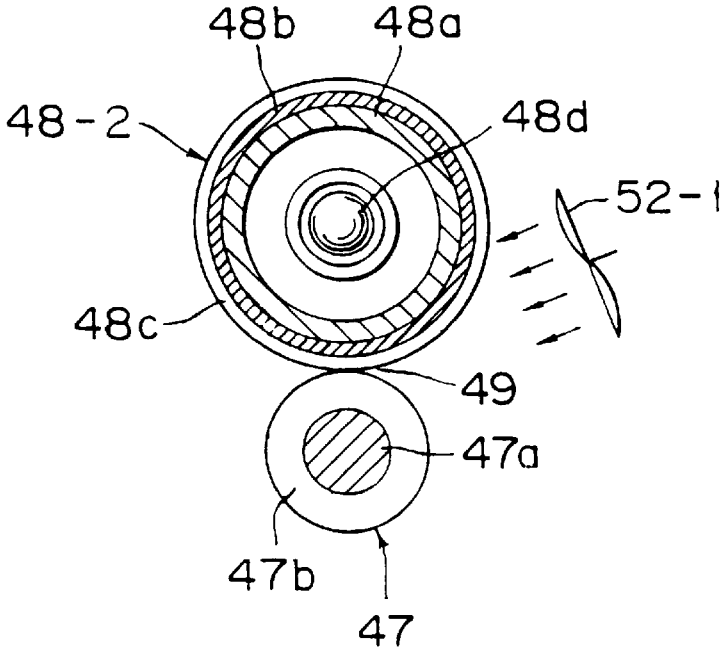
FIG. 4 is a schematically cross-sectional view of another image fixing roller for use in the image fixing apparatus of the present invention.

FIG. 4 schematically shows another image fixing roller 48-2 for use in the image fixing apparatus of the present invention. The image fixing roller 48-2 is the same as the image fixing roller 48-1 shown in FIG. 3 except that cool air is not passed through the inside of the image fixing roller 48-2, but is directly blown against the outer peripheral surface of the image fixing roller 48-2 to cool the exothermic phase transition layer 48*b* by the cool air from an air fan 51-2 which is disposed outside, whereby the phase transition thereof from the crystalline state to the amorphous state is performed via the melted state.

In the above image fixing apparatus, in order to minimize the deformation of the exothermic phase transition layer 48*b* which is in indirectly pressure contact with the pressure application roller 47 during the cooling of the exothermic phase transition layer 48*b*, it is preferable that the cool air be blown against the nip 49 between the image fixing roller 48-2 and the pressure application roller 47 while the image fixing roller 48-2 and the pressure application roller 47 are rotated.

Furthermore, it is more preferable to reduce the pressure applied between the exothermic phase transition layer 48*b* and the pressure application roller 47 during the above-mentioned cooling of the exothermic phase transition layer 48*b* for preventing the deformation of the exothermic phase transition layer 48*b*.

In an image fixing roller comprising the core roller member and the previously mentioned exothermic phase transition layer provided on the core roller member for use in the present invention, the core roller member itself may be a resistive heating element which is capable of emitting heat when energized by causing an electric current to flow through the core roller member, and serves as the heating means for heating the image fixing roller and also as the melting means for the second phase transition means, optionally with the provision of an insulating layer between the core roller member and the exothermic phase transition layer in order to avoid the electric connection between the core roller member and the exothermic phase transition layer when necessary.

Alternatively, in the image fixing apparatus of the present invention, the core roller member for the image fixing roller may comprise a resistive heating layer having the same functions as those of the above-mentioned resistive heating element, namely, which serves as the heating means for heating the image fixing roller and also as the melting means for the second phase transition means, and the image fixing roller may further comprise an insulating layer between the resistive heating layer and the exothermic phase transition layer to avoid the electric connection between the resistive heating layer and the exothermic phase transition layer, when necessary.

Instead of the above mentioned resistive heating layer, a resistive heating member can also be employed. More specifically, the image fixing roller for the image fixing apparatus for use in the present invention can be constructed so as to further comprise a resistive heating member between the core roller member and the exothermic phase transition layer, the resistive heating layer serving as the heating means for heating the image fixing roller and also as the melting means for the second phase transition means, and an insulating layer between the exothermic phase transition layer and the resistive heating member.

Figure 5:
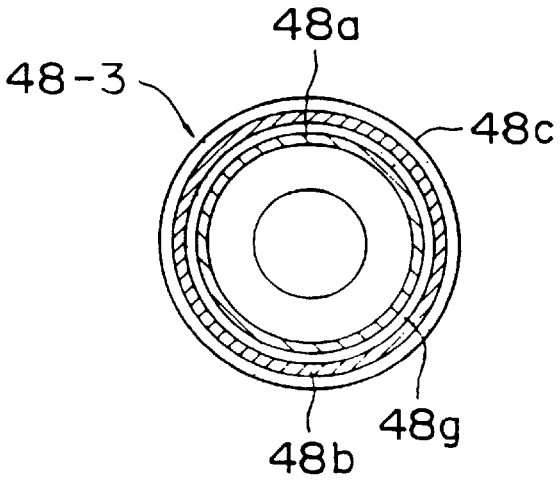
FIG. 5 is a schematically cross-sectional view of a further image fixing roller for use in the image fixing apparatus of the present invention.

FIG. 5 is a schematic cross-sectional view of a further example of the image fixing roller for use in the image fixing apparatus, which is referred to as the image fixing roller 48-3.

In the image fixing roller 48-3, the hollow cylindrical core metal 48*a* serving as the core roller member itself is a resistive heating element having the above-mentioned functions, for instance, a Peltier effect type device, and an insulating layer 48g is interposed between the hollow cylindrical core metal 48*a* and the exothermic phase transition layer 48*b*.

When the Peltier effect type device is employed as mentioned above, the exothermic phase transition layer 48*b* can also be cooled by reversing the direction of the flow of the electric current for energizing the Peltier effect type device.

Figure 6:
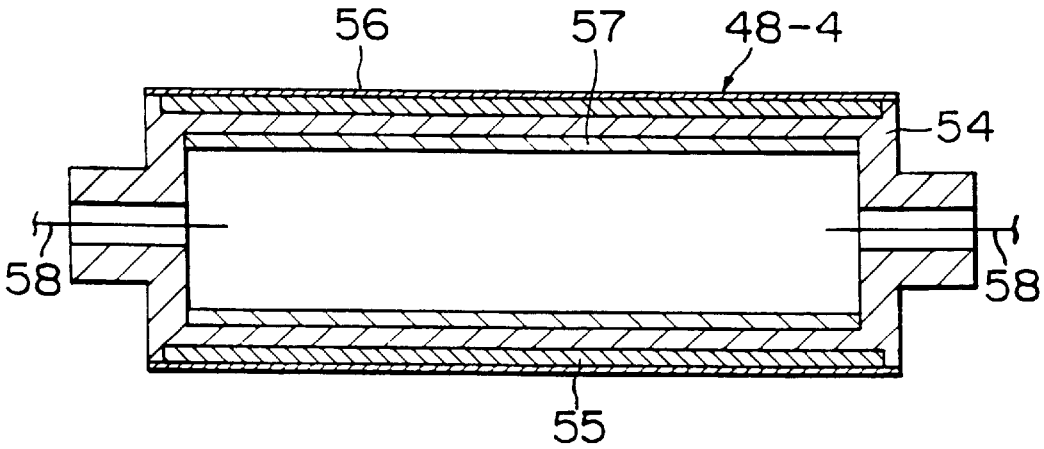
FIG. 6 is a schematically cross-sectional view of still another image fixing roller for use in the image fixing apparatus of the present invention.

FIG. 6 is a schematic cross-sectional view of an example of the above-mentioned image fixing roller comprising the Peltier effect type device, which is referred to as an image fixing roller 48-4. The image fixing roller 48-4 is driven in rotation in contact with a pressure application roller (not shown) which is made of a metal such as aluminum.

As the core roller member for use in the image fixing roller 48-4, there can be employed a hollow cylindrical core metal 54 as illustrated in FIG. 6. As the material for the hollow cylindrical core metal 54, for example, a metal with excellent thermal conductivity such as aluminum is employed.

On the outer peripheral surface of the hollow cylidrical core metal 54, there is provided an exothermic phase transition layer 55 comprising the exothermic phase transition material. The exothermic phase transition layer 55 may be the same as the exothermic phase transition layer 48*b* as shown in FIG. 3.

There is provided a protective layer 56 which covers the exothermic phase transition layer 55. The protective layer 56 may also be the same as the protective layer 48*c* as shown in FIG. 3.

Inside the hollow cylidrical core metal 54, there is provided an inner cylindrical member 57 comprising the Peltier effect type device.

The inner cylindrical member 57 has the function of increasing the external surface of the image fixing roller 48-4 to a toner image fixing temperature T.

The inner cylindrical member 57 serves not only as heating means, but also as phase transition means, in response to the direction of the current which flows through a conductive line 58.

Figure 7:
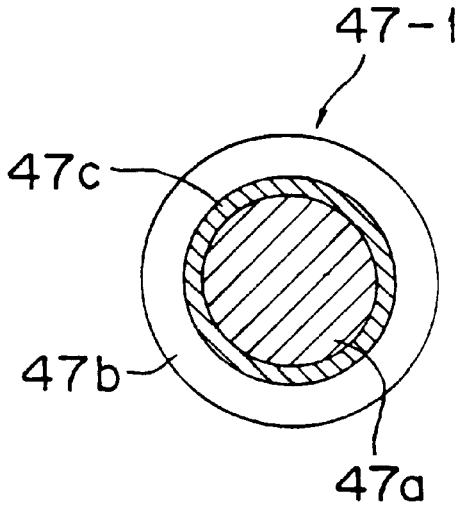
FIG. 7 is a schematic cross-sectional view of a pressure application roller.
Figure 8:
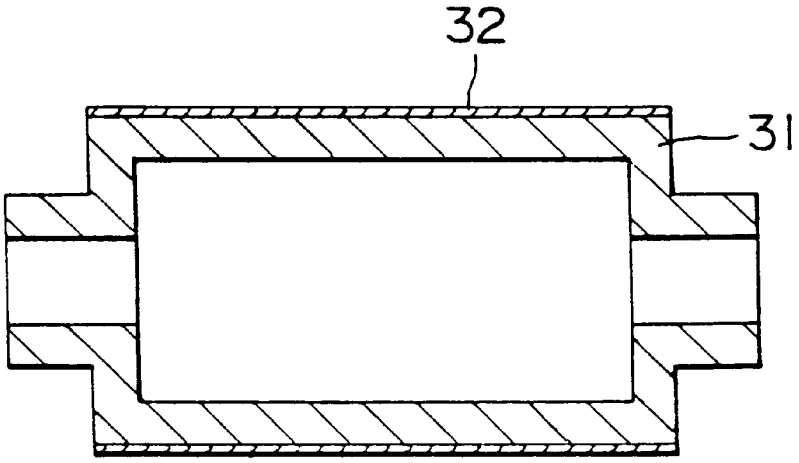
FIG. 8 PRIOR ART
FIG. 8 is a schematic cross-sectional view of a conventional image fixing roller.

FIG. 7 is a schematic cross-sectional view of a pressure application roller 47-1 which also serves as a cooling roller by use of the above-mentioned Peltier effect type device for cooling the exothermic phase transition layer 48*b* which is in a melted state to change the state to an amorphous state.

More specifically, in this pressure application roller 47-1, a Peltier effect type device 47*c* is provided between a core metal 47*a* and an elastic layer 47*b* which covers the core metal 47*a* as illustrated in FIG. 7.

When the pressure application roller 47-1 is brought into pressure contact with the surface of the image fixing roller 48-3, for instance, and the Peltier effect type device 47*c* is energized so as to cool the pressure application roller 47-1, the exothermic phase transition layer 48*b* is cooled, while the pressure applied to the exothermic phase transition layer 48*b* by the pressure application roller 47-1 is appropriately adjusted so as to maintain the thickness of the exothermic phase transition layer 48*b* appropriately even if the exothermic phase transition layer 48*b* is heated and softened.

As mentioned previously, in the image fixing apparatus for use in the present invention, there can be employed an exothermic phase transition material which comprises a chalcogen and at least one additional component selected from the group consisting of the elements of Groups IIIA through VIB of the Periodic Table except the chalcogen, and crystal nuclei with the number thereof per unit volume of the exothermic phase transition material being $10^6/cm^3$ or more.

An exothermic phase transition layer comprising the above-mentioned exothermic phase transition material can be prepared, for example, by melting selenium with high purity (99.999%) and tellurium to prepare a SeTe alloy with the concentration of tellurium being 5 wt. % or more; or by melting a mixture of $SeO_2$ and selenium with high purity (99.999%) with application of heat thereto to prepare a selenium solid solution with the amount of dissolved oxygen therein being 1 ppm or more, and depositing the thus prepared SeTe alloy or Se solid solution in vacuum on the core roller member.

In the image fixing roller for use in the present invention, as mentioned previously, when the exothermic phase transition layer is heated and the state of the exothermic phase transition material therein is changed from an amorphous state to a crystalline state, crystallization heat is liberated from the exothermic phase transition material, so that the exothermic phase transition layer is rapidly heated and therefore the surface of the image fixing roller speedily reaches the image fixing temperature. Thus, the warm-up time for the image fixing roller can be sufficiently shortened.

After the image fixing temperature is reached, the surface temperature of the image fixing roller is controlled by heating means for heating the image fixing roller.

When the exothermic phase transition material in the exothermic phase transition layer has been crystallized, the heat conductivity of the exothermic phase transition layer is increased, so that the control of the image fixing temperature is further facilitated.

When a series of copying processes have been finished, the exothermic phase transition material in the exothermic phase transition layer is temporarily heated to a temperature above the melting point thereof and is then cooled or allowed to stand to be cooled, whereby the exothermic phase transition material changes its phase back to the initial amorphous phase so as to be ready to liberate crystallization heat therefrom in the next step when heated to its crystallization temperature.

The crystallization heat is liberated by the crystallization of the amorphous exothermic phase transition material, so that the liberation of heat of solidification at the melting point of the exothermic phase transition material is prevented and the liberation of the accumulated internal energy is utilized at the elevation of the temperature thereof.

Therefore, it is preferable that the exothermic phase transition material have great heat of fusion, and perform clear-cut and complete phase transition between an amorphous state and a crystalline state. Furthermore, it is preferable that the exothermic phase transition material have high crystallization rate because if the crystallization rate is low and therefore the heat liberation rate is low, the temperature of the surface of the image fixing roller cannot be rapidly elevated with high efficiency due to the diffusion of heat.

Generally, the crystallization rate of an amorphous material by the elevation of the temperature thereof depends upon the product of the number of crystal nuclei per unit volume of the amorphous material (crystal nucleus concentration)

and the growth rate of crystal thereof at the interfaces of crystallites thereof.

The growth rate of crystal is a specific characteristic of each material and therefore cannot be controlled as desired, but the crystal nucleus concentration can be controlled by forming specific cites such as structural strain in the material or by containing foreign molecules such as impurities serving as crystal nuclei in the material.

The exothermic phase transition material, which comprises a chalcogen and at least one additional component selected from the group consisting of the elements of Groups IIIA through VIB of the Periodic Table except the chalcogen, and crystal nuclei with the number thereof per unit volume of the exothermic phase transition material being $10^6/cm^3$ or more, has sufficiently great heat of fusing, and can perform complete phase transition between an amorphous sate and a crystalline state, with high crystallization rate, and therefore can efficiently and rapidly elevate the temperature of the surface of the image fixing temperature.

Furthermore, for use in practice, it is preferable that the exothermic phase transition layer for use in the present invention have a glass transition temperature (Tg) above room temperature, and a melting point which is above the image fixing temperature, but is as close to the image fixing temperature as possible, and do not change its properties during the repeated crystallization and melting operations.

In this sense, an exothermic phase transition layer comprising as the main component selenium or a selenium-tellurium alloy is particularly preferable since such an exothermic phase transition layer has the above-mentioned properties.

A particularly suitable substance for forming crystal nucleus for selenium is oxygen. This is because oxygen can form a solid solution with selenium in any ratio, and can be bonded to chains of selenium atoms at any position thereof, and has a different electronegativity from that of selenium, which is considered to be caused by a different atomic radius from that of selenium, a spatial strain and a different bonding force between oxygen and selenium, so that the rearrangement of the oxygen and selenium atoms in the alloy during the recrystallization thereof can be facilitated.

It is further preferable that the image fixing roller for use in the present invention comprise a protective layer for protecting the exothermic phase transition layer, which is provided on the exothermic phase transition layer, and wherein the exothermic phase transition material comprises a chalcogen and at least one additional component selected from the group consisting of the elements of Groups IIIA through VIB of the Periodic Table except the chalcogen, and crystal nuclei with the number thereof per unit volume of the exothermic phase transition material being $10^6/cm^3$ or more, and increasing in the direction of the thickness of the exothermic phase transition layer toward the protective layer.

By increasing the number of the crystal nuclei per unit volume of the exothermic phase transition material in the direction of the thickness of the exothermic phase transition layer toward the protective layer, crystallization heat is liberated more speedily near the protective layer so that the crystallization heat liberated from the exothermic phase transition layer is transmitted more speedily to the surface of the image fixing roller.

For instance, when the exothermic phase transition layer comprises a SeTe alloy with the content of Te being 5 wt. % or more, the concentration of Te is increased toward the protective layer to increase the number of crystal nuclei near the protective layer.

Inside the main body 2 of the image formation apparatus according to the present invention shown in FIG. 1, there is provided a microprocessor (CPU) 29 serving as a control device.

Figure 11:
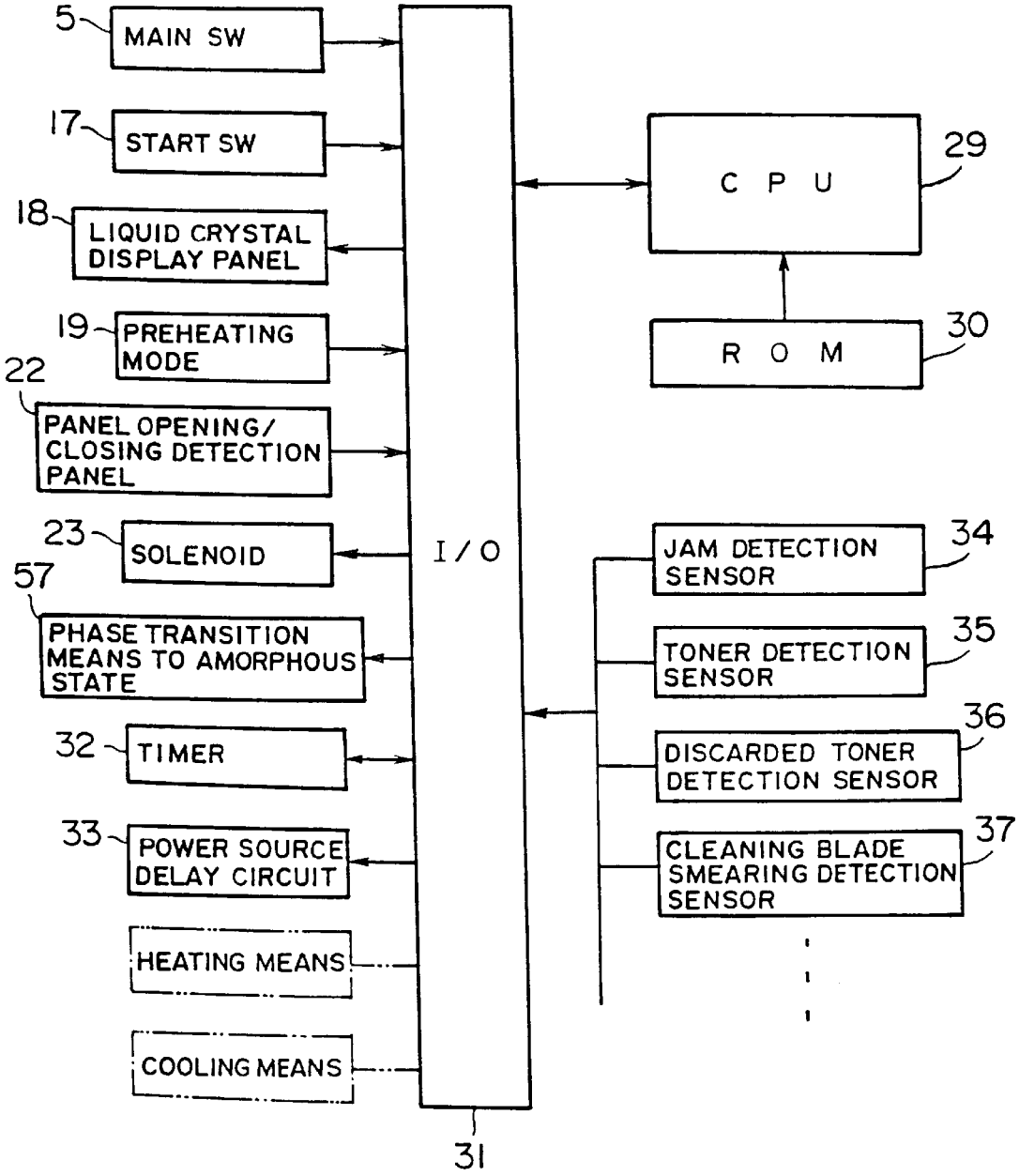
FIG. 11 is a block diagram of the operation of the image formation apparatus of the present invention.

As shown in FIG. 11, a ROM (Read Only Memory) 30 is connected to CPU 29, and the main switch 5 is also connected to CPU 29 via an I/O (input/output interface) 30. With the main switch 5 being ON, each drive system is made operable.

Furthermore, there are also connected to CPU 29, for example, a start switch 17, the liquid crystal display panel 18, various switches for the operation and display section 16, including the preheating mode switch 19, the panel opening or closing detection switch 22, the solenoid 23 serving as panel opening prohibition means, the inner cylindrical member 57 serving not only as heating means, but also as phase transition means, particularly, as means for amorphous transition, connected to the conductive line 58, a timer circuit 32, a power source dely circuit 33, a jam detection sensor 34 for detecting the jamming of a transfer paper, a toner detection sensor 35 for detecting the amount of toner remaining in the toner bottle 12, a discarded toner detection sensor 36 for detecting the amount of recovered toner in the discarded toner bottle 15, and a cleaning blade smearing detection sensor 37 for detecting the smearing of a cleaning blade (not shown) for removing the toner remaining on the photoconductor.

When the above-mentioned inner cylindrical member 57 is not used, heating means such as a halogen lamp or a heater, and cooling means such as a fan are connected to CPU 29 via I/O 31.

CPU 29 has the function of excercising general control over various controls necessary for the copying operation, and programs for performing controls such as priority and interruption for the copying operation are written in ROM 30.

The timer circuit 32 is in association with the preheating mode switch 19, so that when a copying operation is once finished, the counting is initiated, and when the next copying operation is started, the previous counting is cleared. Where no copying operation is performed for a predetermined period of time after the completion of the previous copying operation, the timer circuit 32 outputs a signal for setting the image fixing roller 13 in a preheated state.

When the main switch 5 is OFF, the power source delay circuit 33 continuously supplies power to the inner cylindrical member 57 for a predetermined period of time, in order to cool the exothermal phase transition layer 55.

Figure 12:
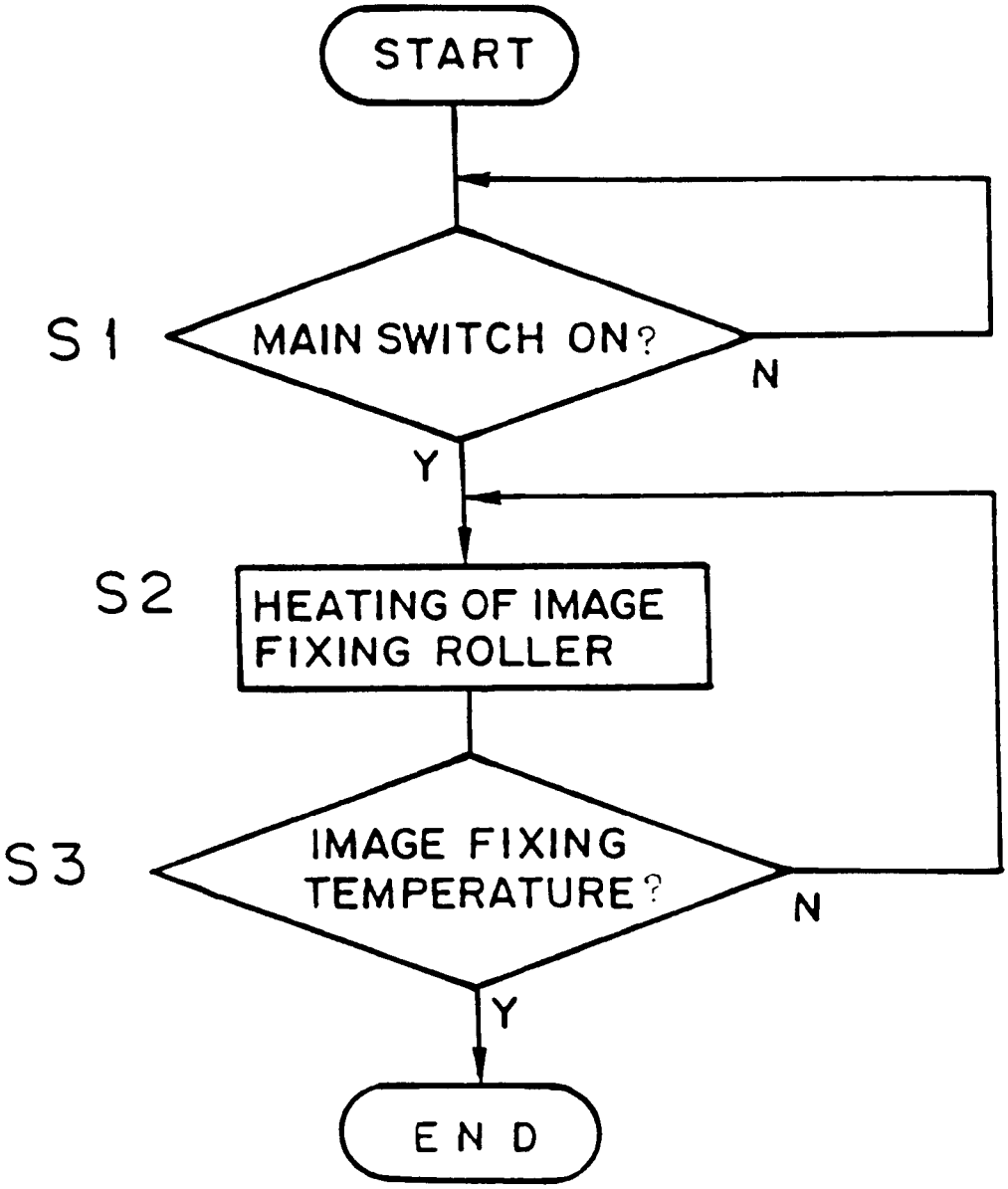
FIG. 12 is a flow chart showing the steps from the turning ON of a main switch of the image formation apparatus to the step of the phase transition of the phase transition layer to a crystalline state.

FIG. 12 shows a basic flow chart of the operation of the image formation apparatus 1 when its operation is started.

[Step 1]

In Step 1, whether the main switch 5 is turned ON or not is detected. When the main switch 5 is ON, this step proceeds to Step 2. When the main switch 5 is not ON, this step is on stand-by until the main switch is turned ON.

[Step 2]

In Step 2, an electric current is caused to flow through the inner cylindrical member 57 simultaneously with the turning ON of the main switch 5, so that the temperature of the inner cylindrical member 57 is increased and accordingly the exothermic phase transition layer 55 is heated by the inner cylindrical member 57. Thus, this step proceeds to Step 3.

[Step 3]

In Step 3, when the exothermic phase transition layer 55 is thus heated, the phase transition from an amorphous state to a crystalline state is initiated, so that crystallization heat is liberated. By this crystallization heat, the temperature elevation of the external surface of the image fixing roller 4-48 is promoted.

The exothermic phase transition layer 55 can be heated using a heater for image fixing, or using a heater for heating only the exothermic phase transition layer 55.

The above-mentioned heat application is performed in order to cause the above-mentioned phase transition in the exothermic phase transition layer 55. However, the crystallization heat released by the phase transition is not always sufficient for heating the image fixing roller 48-4 to the image fixing temperature. The crystallization heat may be used as an auxiliary heat for obtaining sufficient heat for image fixing. Therefore, the abovementioned heat application can be performed in the same manner as in the conventional heat elevation for fixing toner images.

Where the crystallization heat is sufficient for performing the image fixing, the application of heat for the phase transition will suffice for the image fixing.

A preferable toner image fixing temperature T for the image fixing roller 48-4 is 180° C., so that when selenium is employed as the exothermic phase transition material in the exothermic phase transition layer 55, the crystallization initiation temperature Tc of the exothermic phase transition layer 55 is about 120° C., the melting point Tm thereof is about 217° C., the lower limit temperature T' for image fixing is 160° C., the preheating temperature T" is about 100° C., which is lower than the crystallization initiation temperature Tc. The exothermic phase transition layer 55 at the preheating temperature T" is in an amorphous state.

[Step 3]

In Step 3, whether or not the temperature of the external surface of the image fixing roller 48-4 is increased to the toner image fixing temperature T in accordance with the elevation of the temperature of the inner cylindrical member 57 is detected. When the temperature of the external surface of the image fixing roller 48-4 reaches the toner image fixing temperature T, the image formation apparatus 1 is in a copy-making-possible state; while when the temperature does not reach the toner image fixing temperature T, this step is looped back to Step 2, so that the temperature of the inner cylindrical member 57 is continuously elevated up to the toner image fixing temperature T.

Thus, in the present invention, the phase transition from the amorphous state to the crystalline state with the application of heat to the exothermic phase transition layer 55 is performed in association with the turning ON of the main switch 5, with the liberation of the crystallization heat, so that the activation of the image fixing unit including the image fixing roller 48-4 can be quickly carried out.

Figure 13:
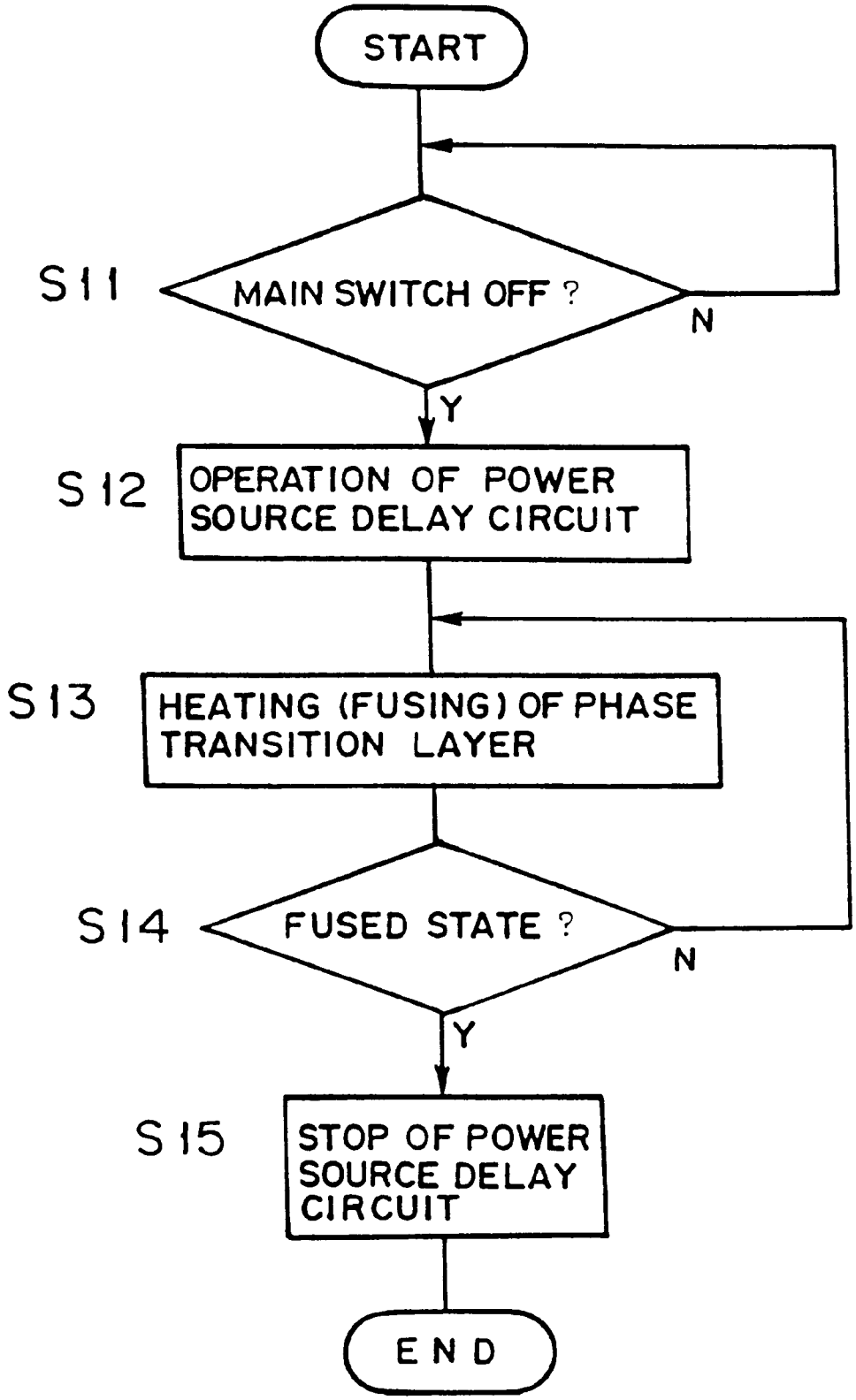
FIG. 13 is a flow chart showing the steps from the turning OFF of the main switch of the image formation apparatus to the step of the phase transition of the phase transition layer to an amorphous state.

FIG. 13 shows a basic flow chart of the steps from the turning OFF of the main switch 5 during the normal operation of the image formation apparatus 1 to the finishing of the actual operation of the image formation apparatus 1.

[Step 11]

In Step 11, whether or not the main switch 5 is turned OFF is detected. This can be detected, for instance, by the shut down of the power supply, or by a conventional soft switch. When the main switch 5 is OFF, this step proceeds to Step 12, while when the main switch 5 is not OFF, namely, ON, this step is maintained, without proceeding to Step 12.

[Step 12]

In Step 12, when the main switch 5 is OFF, no copy-making operation is performed, so that as long as the main switch 5 is OFF, the exothermic phase transition layer 55 is maintained in the crystalline state. Therefore the power source delay circuit 33 is energized to perform the phase transition of the exothermic phase transition layer 55 from the crystalline state to the amorphous state. Thus, this step proceeds to Step 13.

[Step 13]

In Step 13, an electric current is caused to flow through the inner cylindrical member 57 in the temperature elevation direction via the power source delay circuit 33, so that the exothermic phase transition layer 55, which is in the crystalline state, is heated in order to perform the phase transition thereof from the crystalline state to the amorphous state. Thus, this step proceeds to Step 14.

[Step 14]

In Step 14, whether or not the exothermic phase transition layer 55 is heated to a temperature above the melting point Tm thereof by the application of heat thereto using the inner cylindrical member 57 and fused is detected. When the exothermic phase transition layer 55 is fused, this step proceeds to Step 15, while when the exothermic phase transition layer 55 is not fused, the phase transition layer 55 is continuously heated until it is fused.

[Step 15]

In Step 15, when the fusing of the exothermic phase transition layer 55 is completed, the operation of the power source delay circuit 33 is terminated.

The exothermic phase transition layer 55 is then subjected to the phase transition from the crystalline state to the amorphous state by allowing the phase transition layer 55 to stand at room temperature, cooling the phase transition layer 55 using a fan, or causing an electric current to flow through the inner cylindrical member 57 in an endothermic direction which is opposite to the temperature-elevation direction, so that when the image formation apparatus 1 is used again, its operation can be started from the state in which the exothermic phase transition layer 55 is in the amorphous state.

When the power is supplied to the above-mentioned fan or the inner cylindrical member 57, the operation of the power source delay circuit 33 may be continued until the phase transition to the amorphous state is completed, with the power supply being terminated when the amorphous state is achieved.

The power supply via the power supply delay circuit 33 may be limited to the power supply to the image fixing roller 48-4, without the power supply being performed, for instance, to the liquid crystal display panel 18.

Figure 14:
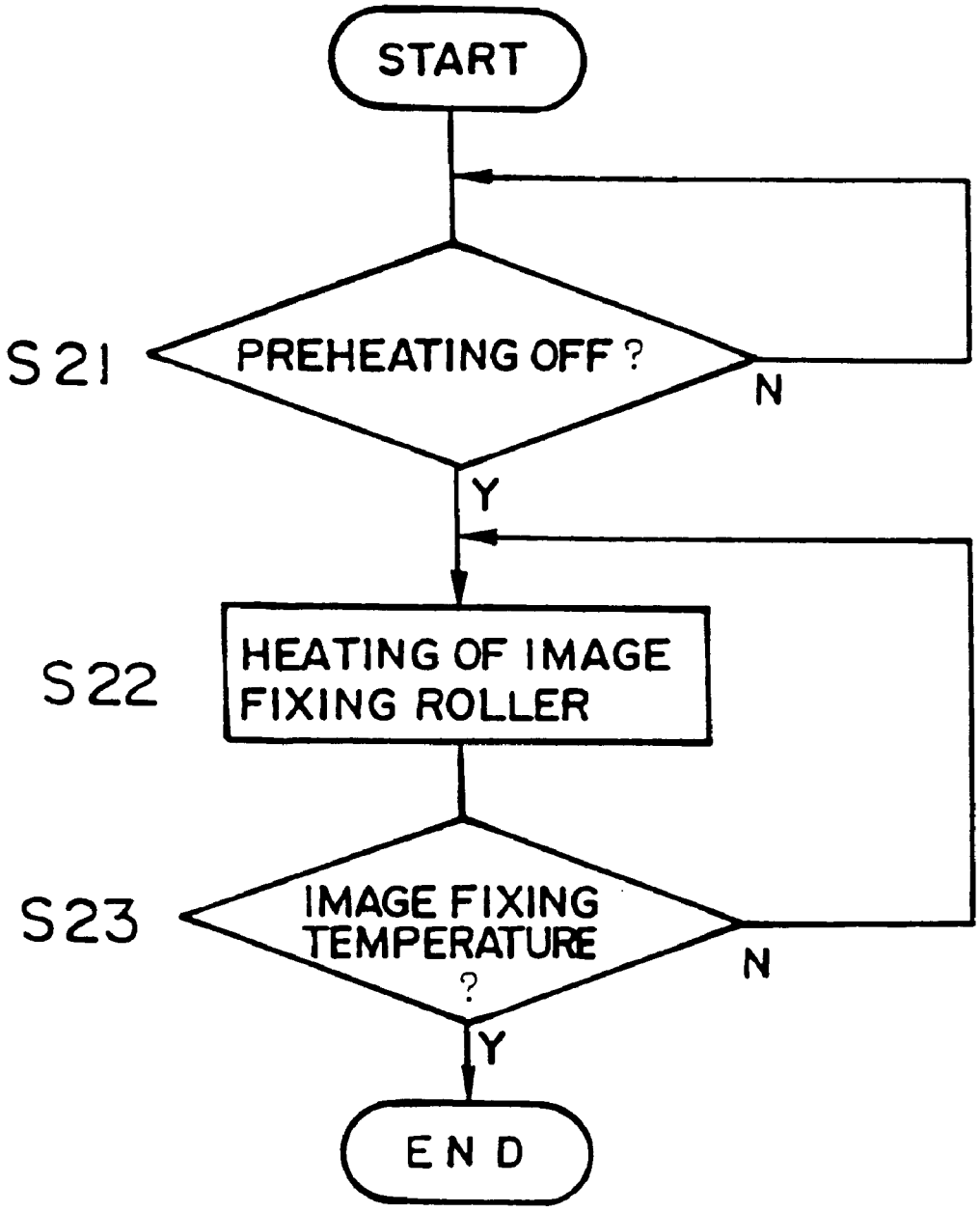
FIG. 14 is a flow chart of the operation of the image formation apparatus of the present invention when a preheating mode is OFF.

FIG. 14 shows a basic flow chart of the steps when the preheating mode is canceled during the operation of the preheating mode, on the supposition that the external peripheral surface of the image fixing roller 48-4 is at the preheating temperature T due to the operation of the preheating operation.

[Step 21]

In Step 21, whether or not the preheating mode is turned OFF is detected. Unless the preheating mode is OFF, the preheating mode is maintained. In order to perform copying operation with the cancellation of the preheating mode, the preheating mode switch 19 is turned OFF, or other operational instructions have to be made, whereby this step proceeds to Step 22.

[Step 22]

In Step 22, with the turning OFF of the preheating mode, the heating of the exothermic phase transition layer 55 in the amorphous state is initiated in order to make it possible to perform image fixing by the image fixing roller 48-4, so that this step proceeds to Step 23.

[Step 23]

In Step 23, whether or not the temperature of the external peripheral surface of the image fixing roller 48-4 reaches the image fixing temperature is detected. When the temperature of the external peripheral surface of the image fixing roller 48-4 is below the image fixing temperature, the heating of the exothermic phase transition layer 55 in Step 22 is continued, and when the temperature of the external peripheral surface of the image fixing roller 48-4 reaches the image fixing temperature, the heating operation is stopped.

Where the main switch 5 is turned OFF when the preheating mode is ON, namely when the exothermic phase transition layer 55 is in the amorphous state, the power supply is stopped without further heating or cooling the exothermic phase transition layer 55, so that the amorphous state can be maintained and therefore, the crystallization heat can be used in the next copy making operation.

EXAMPLE 1-1

Figure 15:
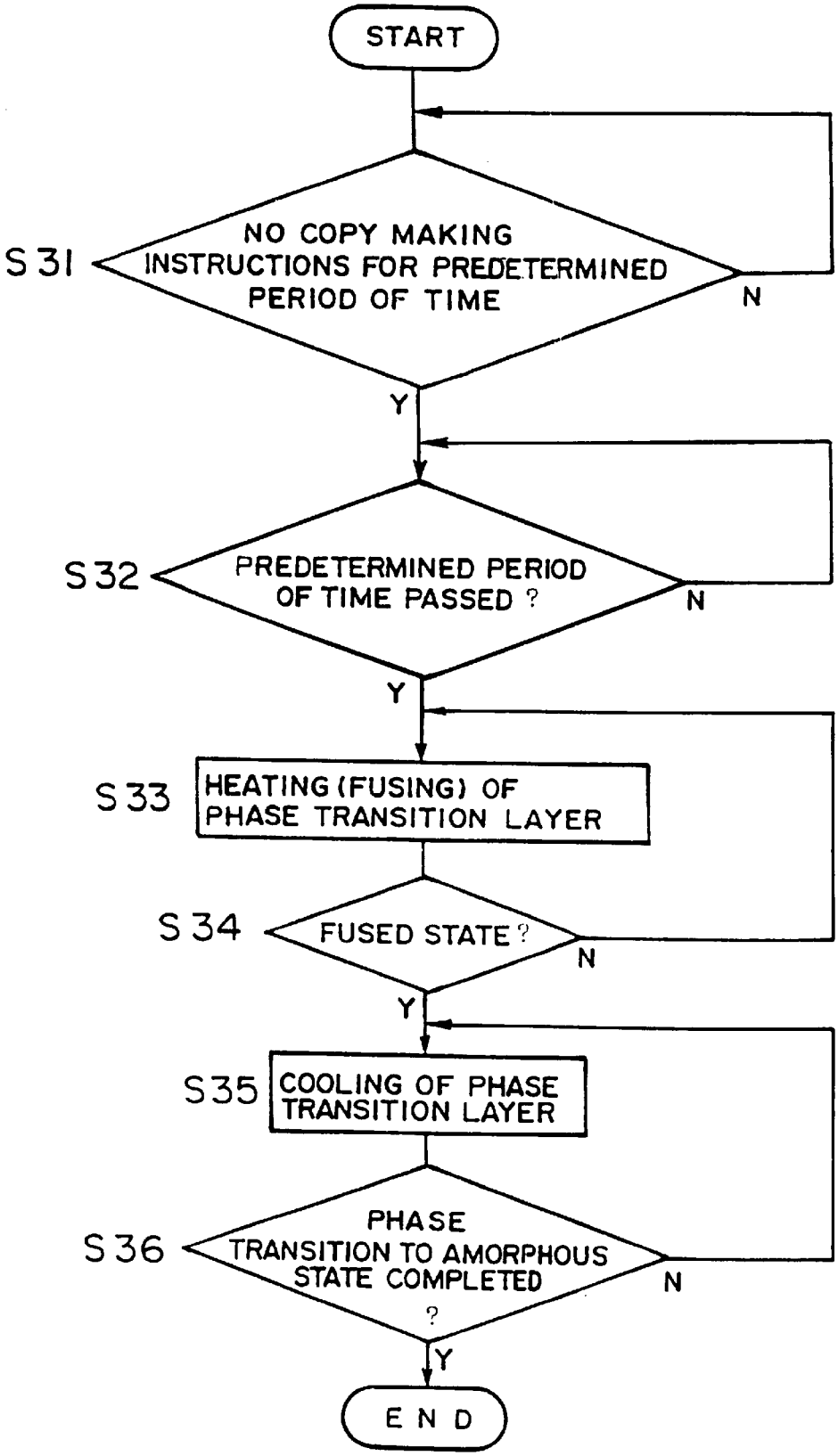
FIG. 15 is a flow chart of Example 1-1 of the present invention.

The operation of the image formation apparatus of the present invention in accordance with a flow chart of FIG. 15 is as follows on the supposition that the image formation apparatus is ready for making copies in accordance with the routine shown in FIG. 12.

[Step 31]

In Step 31, since the preheating mode is ON, whether or not copy-making instructions are not made for a predetermined period of time is detected by the count of the timer 32. In the absence of the copy-making instructions for the predetermined period of time, this step proceeds to Step 32; while in the presence of the copy-making instructions within the predetermined period of time, a copy making operation is carried out in accordance with the copy-making instructions. After the copy making operation, whether or not copy-making instructions are not made for a predetermined period of time is again detected.

[Step 32]

In Step 32, based on the absence of the copy-making instructions for the predetermined period of time, time counting is initiated by the timer 32, and this step proceeds to Step 33 after the predetermined period of time elapses.

When the predetermined period of time does not elapse, this step is looped back to Step 32 and the time counting is continued.

[Step 33]

In Step 33, with the completion of the counting of the predetermined period of time in each of Step 31 and Step 32, the heating of the inner cylindrical member 57 for performing the phase transition of the exothermic phase transition layer 55 from the crystalline state to the amorphous state is initiated. In accordance with the routine shown in FIG. 12, the phase transition layer 55 is in the crystalline state before the above-mentioned initiation of the heating by the inner cylindrical member 57.

This step then proceeds to Step 34.

[Step 34]

In Step 34, whether the exothermic phase transition layer 55, heated by the inner cylindrical member 57, is in a fused state or not is detected. More specifically, whether or not the temperature of the exothermic phase transition layer 55 reaches at least the melting point Tm thereof. When the temperature reaches at least the melting point Tm thereof, this step proceeds to Step 35, while when the temperature does not reach the melting point Tm, the heating is continued.

[Step 35]

In Step 35, the exothermic phase transition layer 55, which is in the fused state, is cooled to perform the phase transition of the phase transition layer 55 from the crystalline to the amorphous state. This step then proceeds to Step 36.

In the above, the phase transition layer 55, which is in the crystalline state, is fused, and then cooled. This is because if the phase transition is carried out gradually, the phase transition layer 55 will deteriorate.

[Step 36]

In Step 36, whether or not the phase transition layer 55 is in the amorphous state is detected. When the phase transition layer 55 is in the amorphous state, the inner cylindrical member 57 is controlled so as to maintain the above amorphous state, while when the phase transition layer 55 is not yet in the amorphous state, this step is looped back to Step 35 so that the cooling is continued. In order to maintain the above-mentioned amorphous state, the temperature of the image fixing roller 48-4 is detected by a temperature detection sensor such as a thermistor, and when the detected temperature is below a predetermined temperature, the phase transition layer 55 is heated by the inner cylindrical member 57.

The above-mentioned phase transition to the amorphous state is performed to make shorter the period of time period from the cancellation of the preheating mode to the time at which the image fixing roller 48-4 reaches an image fixable state than the period of time from the turning ON of the main switch 5 to the time at which the image fixing roller 48-4 reaches the image fixable state. Therefore it is preferable that the preheating temperature be lower than the crystallization initiation temperature Tc of the image fixing roller 484, but be close thereto.

When the preheating mode is canceled, the image fixing roller 48-4 is again heated by the inner cylindrical member 57 so as to set the image fixing roller 48-4 in an image fixable state. By setting the preheating state at a temperature lower than the crystallization initiation temperature Tc of the image fixing roller 48-4, but close thereto, the image fixing roller 48-4 can be heated, using the crystallization heat after the cancellation of the preheating mode, and the deterioration of the phase transition layer 55 can be prevented.

Figure 9:
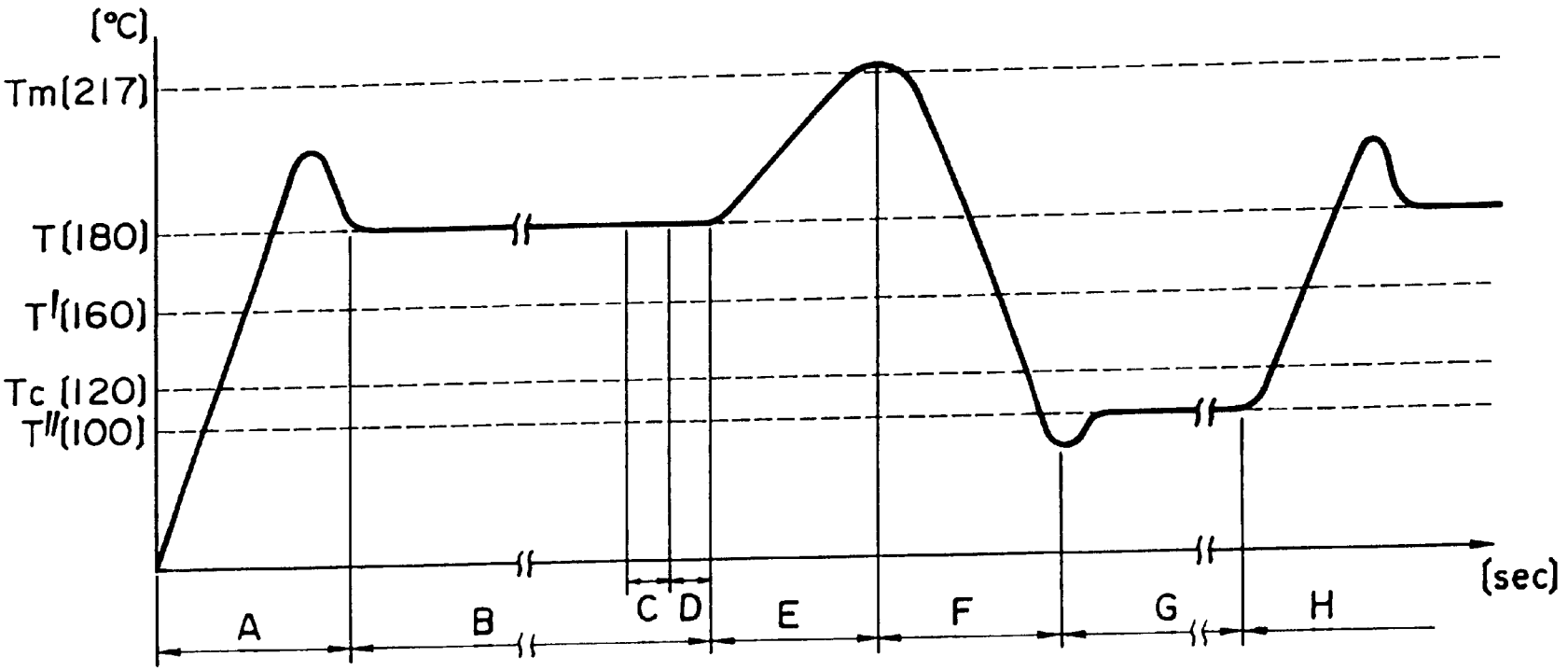
FIG. 9 is a graph showing the changes in the temperature of the external peripheral surface of an example of a phase transition layer of an image fixing roller for use in the present invention.

FIG. 9 is a graph showing the changes in the temperature of the external peripheral surface of the image fixing roller 48-4 in accordance with the abovementioned series of routines, explained with reference to the above-mentioned flow charts.

A range A indicates a range in which the image fixing roller 48-4 is warmed up from Step 1 through Step 3. The phase transition which takes place generates the crystallization heat. When the crystallization heat is released, the heating of the image fixing roller 48-4 by the inner cylindrical member 57 may be stopped in principle.

A range B indicates a range from Step 3 on, in which image fixing can be performed, and image formation is carried out.

When the image fixing roller 48-4 is allowed to stand, the temperature of the external surface thereof decreases with time. Therefore, CPU 29 controls the inner cylindrical member 27 so as to maintain the temperature of the external surface of the image fixing roller 48-4 between the image fixing temperature and the lower limit temperature T' for image fixing.

A range C is a predetermined range where the absence of copy-making instructions at Step 31 because the preheating mode is ON. A range D is a count range by the timer 32 in Step 32 after the range C.

A range E is a heat application range based on Step 33.

A range F is a cooling range based on Step 35 and Step 36, due to the temperature elevation up to at least the melting point Tm (Step 34) at the boundary between the range E and the range F.

A range G is a preheating range.

A range H is a second heating and image fixing range from Step 21 through Step 23, based on some operation conducted at the boundary between the range G and the range H.

EXAMPLE 1-2

Figure 16:
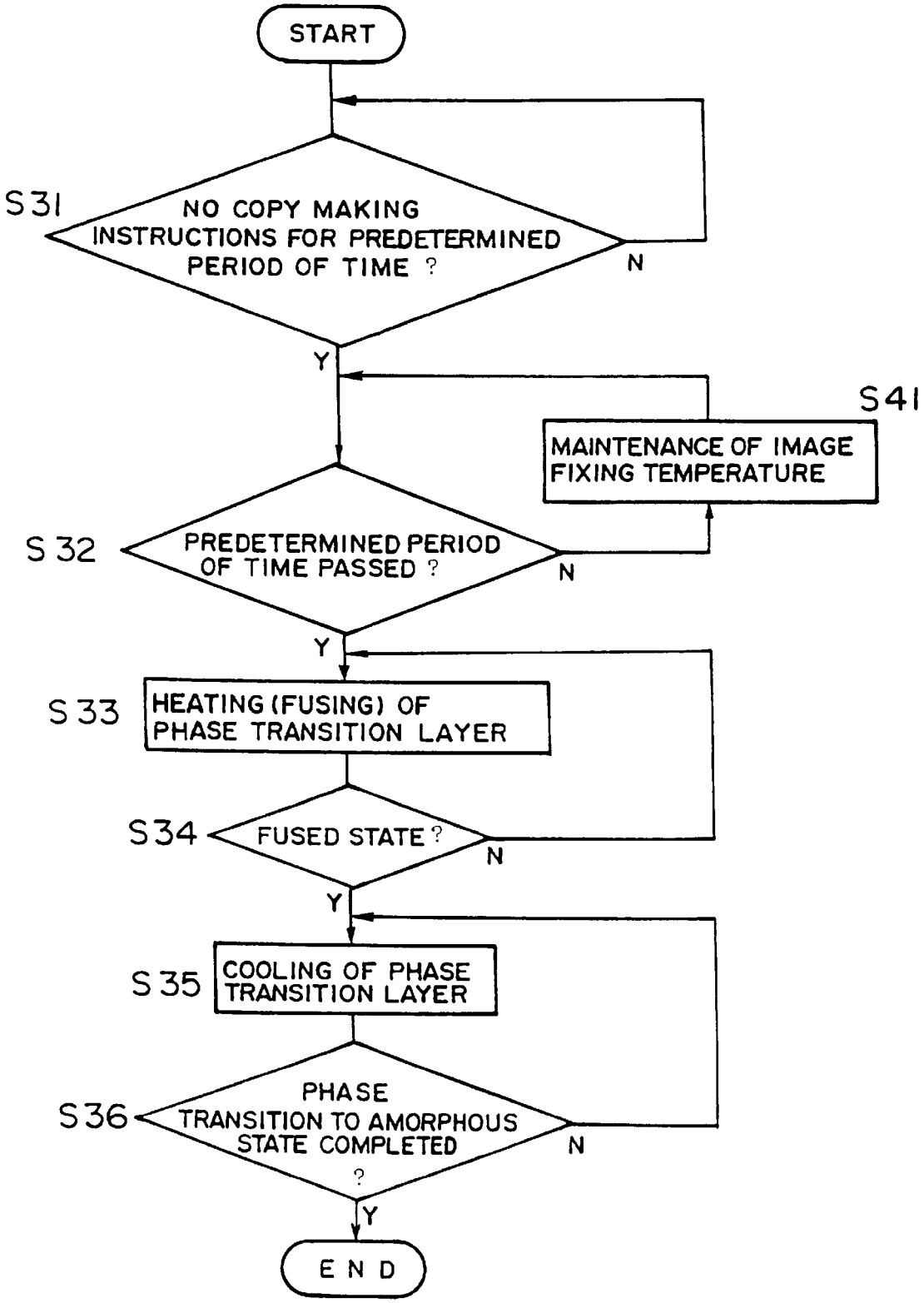
FIG. 16 is a flow chart of Example 1-2 of the present invention.

The operation of the image formation apparatus of the present invention in accordance with a flow chart of FIG. 16 is as follows on the supposition that the image formation apparatus is ready for making copies in the same manner as in Example 1-1, in which the same reference numerals designate identical routines in the above-mentioned steps, with the explanation thereof being omitted.

[Step 32]

In Step 32 in Example 1-2, where the predetermined period of time does not elapse, Step 32 is monitored through Step 41; while where the predetermined period of time elapses, the routines in Step 33 to Step 36 are processed in the same manner as in Example 1-1.

[Step 41]

In Step 41, until the predetermined period of time elapses in Step 32, CPU 29 controls the inner cylindrical member 57 in such a manner that the temperature of the external peripheral surface of the image fixing roller 48-4 is maintained at the image fixing temperature as indicated in the range D in FIG. 9. In this case, that the temperature is maintained at the image fixing temperature means that the temperature is set within a range where the image fixing can be performed, including the case where the temperature is maintained at a constant temperature as indicated in the range D in FIG. 9.

EXAMPLE 1-3

Figure 17:
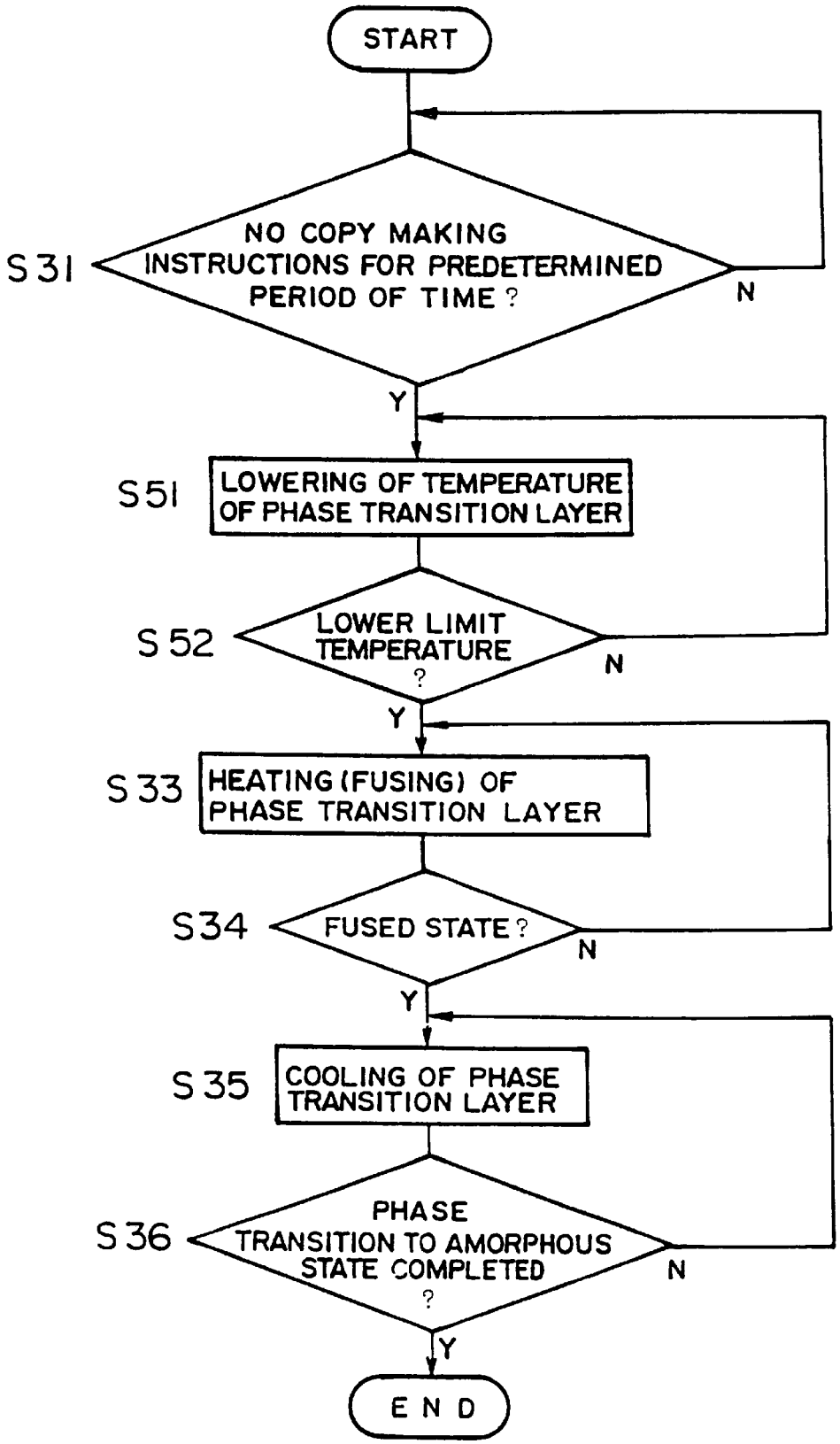
FIG. 17 is a flow chart of Example 1-3 of the present invention.

The operation of the image formation apparatus of the present invention in accordance with a flow chart of FIG. 17 is as follows on the supposition that the image formation apparatus is ready for making copies in the same manner as in Example 1-1, in which the same reference numerals designate identical routines in the above-mentioned steps, with the explanation thereof being omitted.

[Step 51]

In Step 51, the temperature of the phase transition layer 55 (accordingly, the temperature of the image fixing roller 48-4) is lowered in the absence of the copy-making instructions for the predetermined period of time, and this step proceeds to Step 52.

The lowering of the temperature in Step 51 is carried out by allowing the image fixing roller 48-4 to stand at room temperature, with the power supply thereto being stopped. Alternatively, the lowering of the temperature in Step 51 can also be carried out by forced cooling by controlling the electric current which flows through the inner cylindrical member 57, or using a cooling fan.

[Step 52]

In Step 52, the temperature of the phase transition layer 55 (accordingly, the temperature of the image fixing roller 48-4), which is being decreased, is monitored, and whether or not the temperature decreases down to the lower limit temperature T' for image fixing is detected.

When the temperature reaches the lower limit temperature T' for image fixing, this step proceeds to Step 33 and the routines in Step 34 to Step 36 are then processed, while when the temperature does not reach the lower limit temperature T' for image fixing, the temperature lowering process in Step 51 is continued. When the processes in Step 51 and Step 52 are completed, a period of time corresponding to the predetermined period of time in Step 32 shown in Example 1-1 elapses.

Figure 10:
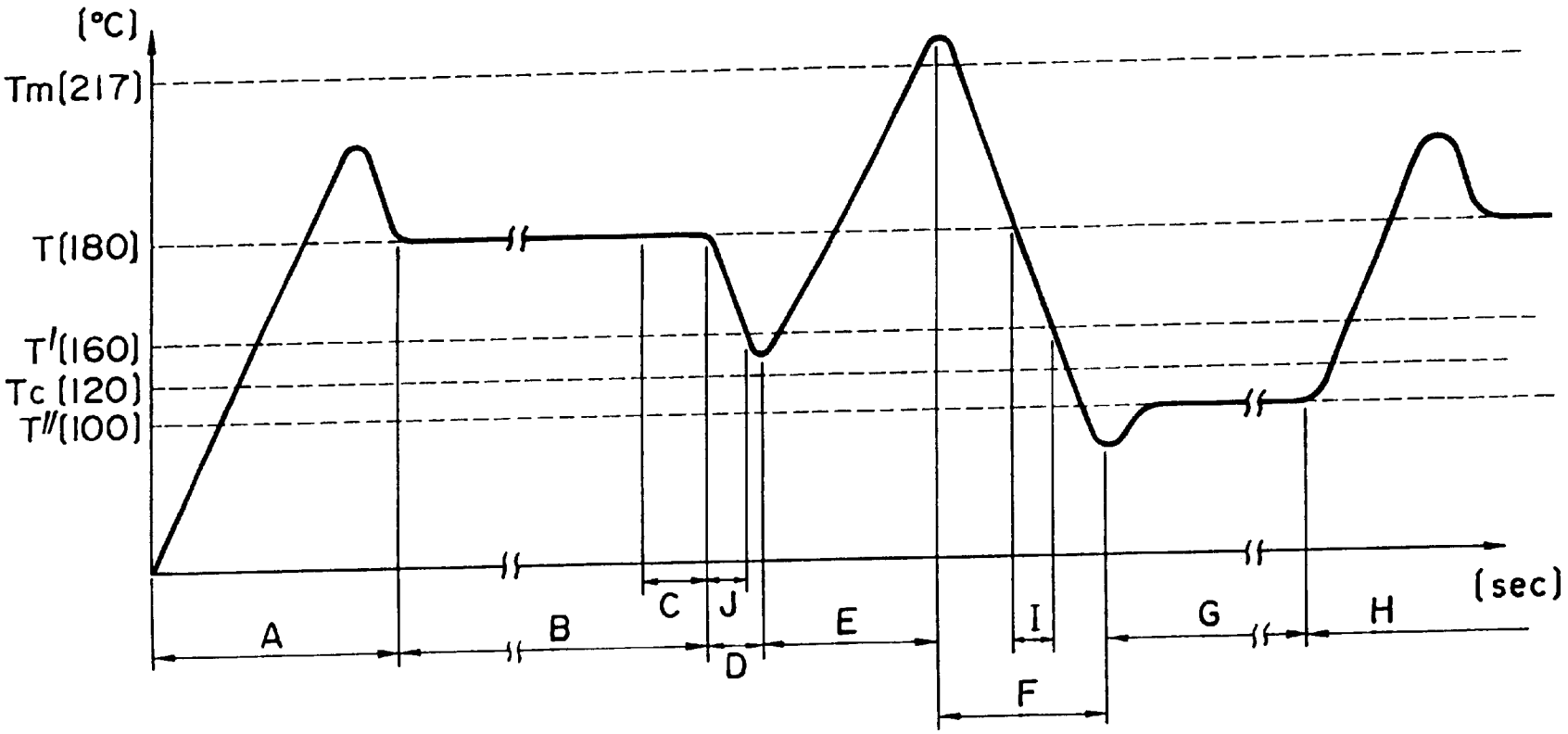
FIG. 10 is a graph showing the changes in the temperature of the external peripheral surface of an another example of a phase transition layer of an image fixing roller for use in the present invention.

FIG. 10 is a graph showing the changes in the temperature of the external peripheral surface of the image fixing roller 48-4 in accordance with the abovementioned series of routines in Example 1-3.

The ranges A, B, C, E, F, G and H are respectively the same as in FIG. 9.

A range I is a temperature decreasing range (time) based on Step 51 and Step 52.

In a range D, a downward vertex in the graph is positioned below the lower limit temperature T' for image fixing. This is because the temperature is lowered due to the time lag from the detection of the lower limit temperature T' for image fixing in Step 52 to the heating of the phase transition layer 25 in Step 33. However, the downward vertex is situated above the crystallization initiation temperature Tc, so that the phase transition layer 55 remains in a crystalline state.

EXAMPLE 1-4

Figure 18:
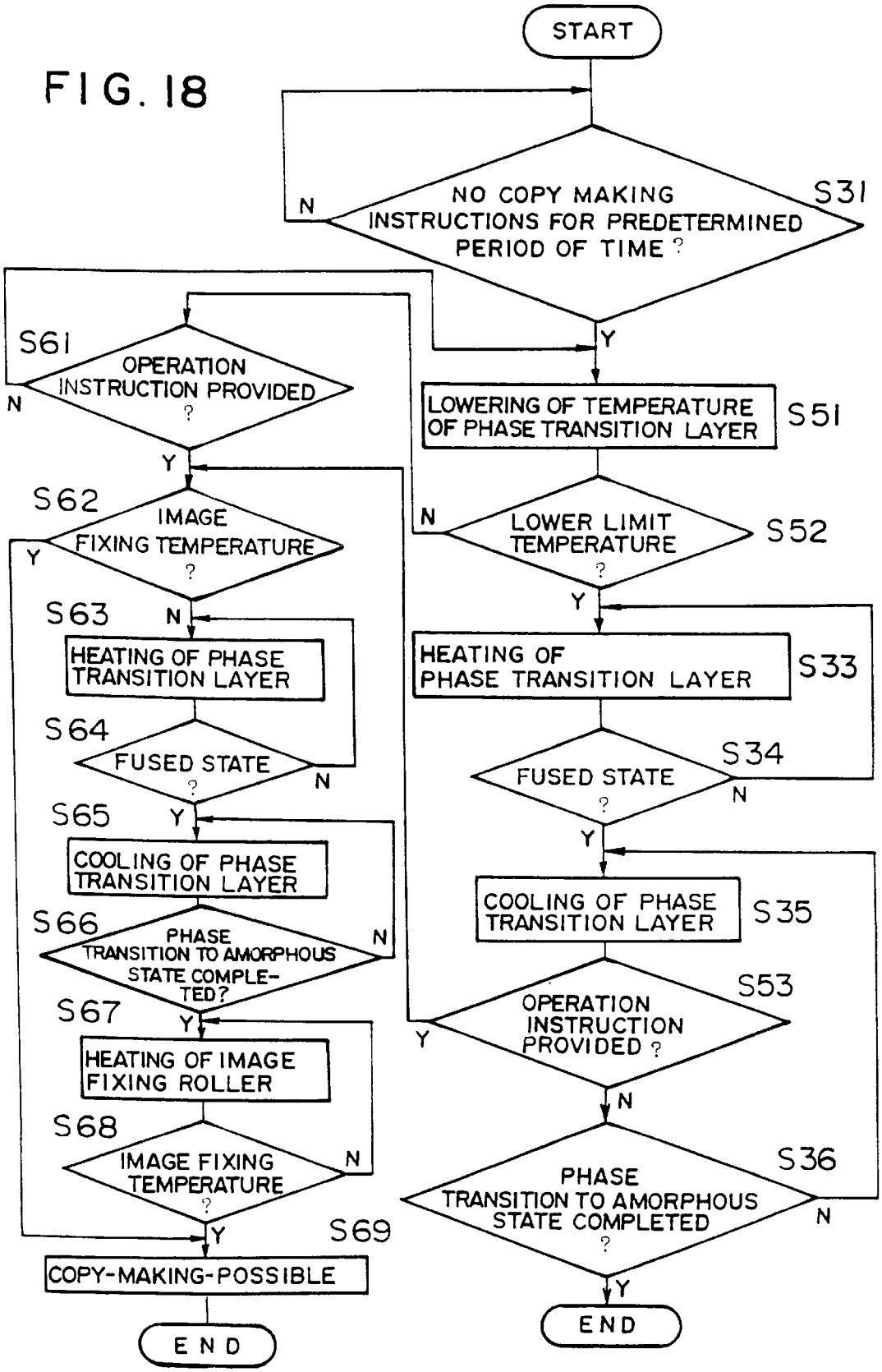
FIG. 18 is a flow chart of Example 1-4 of the present invention.

The operation of the image formation apparatus of the present invention in accordance with a flow chart of FIG. 18 is as follows on the supposition that the image formation apparatus is ready for making copies in the same manner as in Example 1-1, in which the same reference numerals designate identical routines in the above-mentioned steps, with the explanation thereof being omitted.

[Step 52]

In Step 52 in Example 1-4, the temperature of the phase transition layer 55 (accordingly, the temperature of the image fixing roller 48-4), which is being decreased, is monitored, and whether or not the temperature decreases down to the lower limit temperature T' for image fixing is detected.

When the temperature reaches the lower limit temperature T' for image fixing, the routines in Step 33 to Step 35 are processed, and the step proceeds to Step 53, while when the temperature does not reach the lower limit temperature T' for image fixing, the step proceeds to Step 61. When the processes in Step 51, Step 52 and Step 61 are completed, a period of time corresponding to the predetermined period of time in Step 32 shown in Example 1-1 elapses.

[Step 53]

In Step 53, whether or not the presence or absence of an operation instruction is detected during the period from the cooling of the phase transition layer 55 in Step 35 to the completion of the phase transition to the amorphous state. When there is an operation instruction, this step proceeds to Step 62, while when there is no operation instruction, this step proceeds to Step 36.

[Step 61]

In Step 61, whether or not the presence or absence of an operation instruction is detected during the period from the lowering of the temperature of the phase transition layer 55 in Step 51 to the time at which the temperature reaches the lower limit temperature T' for image fixing in Step 52. When there is an operation instruction, this step proceeds to Step 62, while when there is no operation instruction, this step is looped back to Step 51.

[Step 62]

In Step 62, whether or not the temperature of the external surface of the image fixing roller 48-4 is within the image fixing temperature range in accordance with the instructions from Step 53 and Step 61. When the temperature of the external surface of the image fixing roller 48-4 is within the image fixing temperature range, this step proceeds to Step 69, while when the temperature is not within the image fixing temperature range, this step proceeds to Step 63.

The image fixing temperature range in Step 62 means a range I within a range F (based on Step 53), a range J in a range D (based on Step 61).

[Step 63]

In Step 63, based on the instructions from Step 61 and Step 53, it is detected that the image fixing roller 48-4 is not at the image fixing temperature, so that the heating of the phase transition layer 55 is initiated by the inner cylindrical member 57 so as to set the phase transition layer 55 in an image fixing possible state. Then this step proceeds to Step 64.

[Step 64]

In Step 64, whether the phase transition layer 55, heated by the inner cylindrical member 57, is in a fused state or not is detected. More specifically, whether or not the temperature of the phase transition layer 55 reaches at least the melting point Tm thereof. When the temperature reaches at least the melting point Tm, this step proceeds to Step 65, while when the temperature does not reach the melting point Tm, the heating is continued.

[Step 65]

In Step 65, the phase transition layer 55, which is in the fused state, is cooled to perform the phase transition of the phase transition layer 55 from the crystalline to the amorphous state. This step then proceeds to Step 66.

In the above, the phase transition layer 55, which is in the crystalline state, is fused, and then cooled. This is because if the phase transition is carried out gradually, the phase transition layer 55 will deteriorate.

[Step 66]

In Step 66, whether or not the phase transition layer 55 undergoes the phase transition to the amorphous state is detected. When the phase transition to the amorphous state is completed, this step proceeds to Step 67; while when the phase transition is not completed, the cooling is continued.

[Step 67 and Step 68]

In Step 67, the phase transition layer 25 in the amorphous state is heated, so that this step proceeds to Step 68.

In Step 68, there is detected whether or not the temperature of the external peripheral surface of the image fixing roller 48-4 reaches the image fixing temperature by the heated phase transition layer 55. When the temperature reaches the image fixing temperature, this step proceeds to Step 69.

This system may be constructed in such a manner that when it is judged that the cooling is carried out so that the image fixing temperature is reached, with the step proceeding from the cooling after Step 65 to Step 68, the step can proceed to Step 69.

[Step 69]

In Step 69, since the image fixing roller 48-4 is in the image fixable state, based on the detection results of Step 62 or on the detection results of Step 68, such information that the copying operation is ready is displayed on the liquid crystal display panel 18 for the operator.

In the range J in FIG. 10, copy making is possible based on Step 62 under specific conditions. The specific conditions means that the phase transition layer 55 is in a solid state, and that the amorphous state is maintained to some extent (in Step 61, although the phase transition to the amorphous state is completed to some extent in Step 53).

Even if copy making instructions are provided during the heating and cooling steps for the phase transition of the phase transition layer 55 from the crystalline state to the amorphous state, it is impossible to perform the copying making operation in accordance with the copy making instructions during the heating step.

This is because when the temperature of the phase transition layer 55 reaches its melting point Tm, the temperature is outside the image fixing temperature range, so that the fusion or offset of a toner may occur.

In the case where the phase transition layer 55 is in a fused state, but the temperature thereof does not reach the melting point Tm, the peripheral surface of the image fixing roller 48-4 becomes elastic, so that the nip between the image fixing roller 48-4 and a pressure application roller (not shown) which is in pressure contact with the image fixing roller 48-4 may be changed and therefore a desired image fixing performance cannot always be attained.

However, when the phase transition layer 55 is in a solid state, and the phase transition to the amorphous state is completed to some extent, there are not the above-mentioned problems caused in the fused state, so that it is possible to perform image fixing operation.

As a material for use in the phase transition layer 55 that satisfies the above-mentioned requirements, selenium is preferable. However, when the temperature is below the image fixing temperature, it is necessary to elevate the temperature and therefore there may the risk that stable phase transition cannot be carried out. In such a case, copy making operation is possible only in the image fixing temperature range H.

Step 62 to Step 68, where instructions are provided based on Step 53 in the range outside the range I within the range F, correspond to ranges E to H.

In the present invention, when the heating step for the phase transition of the phase transition layer 55 of the image fixing roller from the amorphous state to the crystalline state is conducted in association with the turning ON of a main switch of the image formation apparatus of the present invention, the warm-up of the image formation apparatus, in particular, the warm-up of the image fixing roller, can be performed quickly.

Furthermore, during the application of heat to the phase transition layer 55 for the phase transition from the amorphous state to the crystalline state, and also during the application of heat to the phase transition layer 55 for the phase transition from the crystalline state to the amorphous state, if the main body panel 9 is closed, or the opening thereof is prohibited, stable heating can be performed without losing heat during the heat application process.

Furthermore, when the main switch is turned OFF, if the image fixing roller is heated, for instance, by power source delay means so as to set the phase transition layer in the amorphous state for the next use, namely at the turning ON of the main switch at the next use, the warm-up of the image fixing roller can be quickly performed.

At this time, by forcibly performing the phase transition of the phase transition layer 55 in a fused state to the amorphous state, even if the period of time from the turning OFF of the main switch to the turning ON of the main switch is short, that is, the non-used period is short, the heating of the phase transition layer 55 can be started from the amorphous state at the next use, so that stable warm-up of the image fixing roller, accordingly stable warm-up of the image formation apparatus can be performed. The following are such examples:

EXAMPLE 2-1

Figure 19:
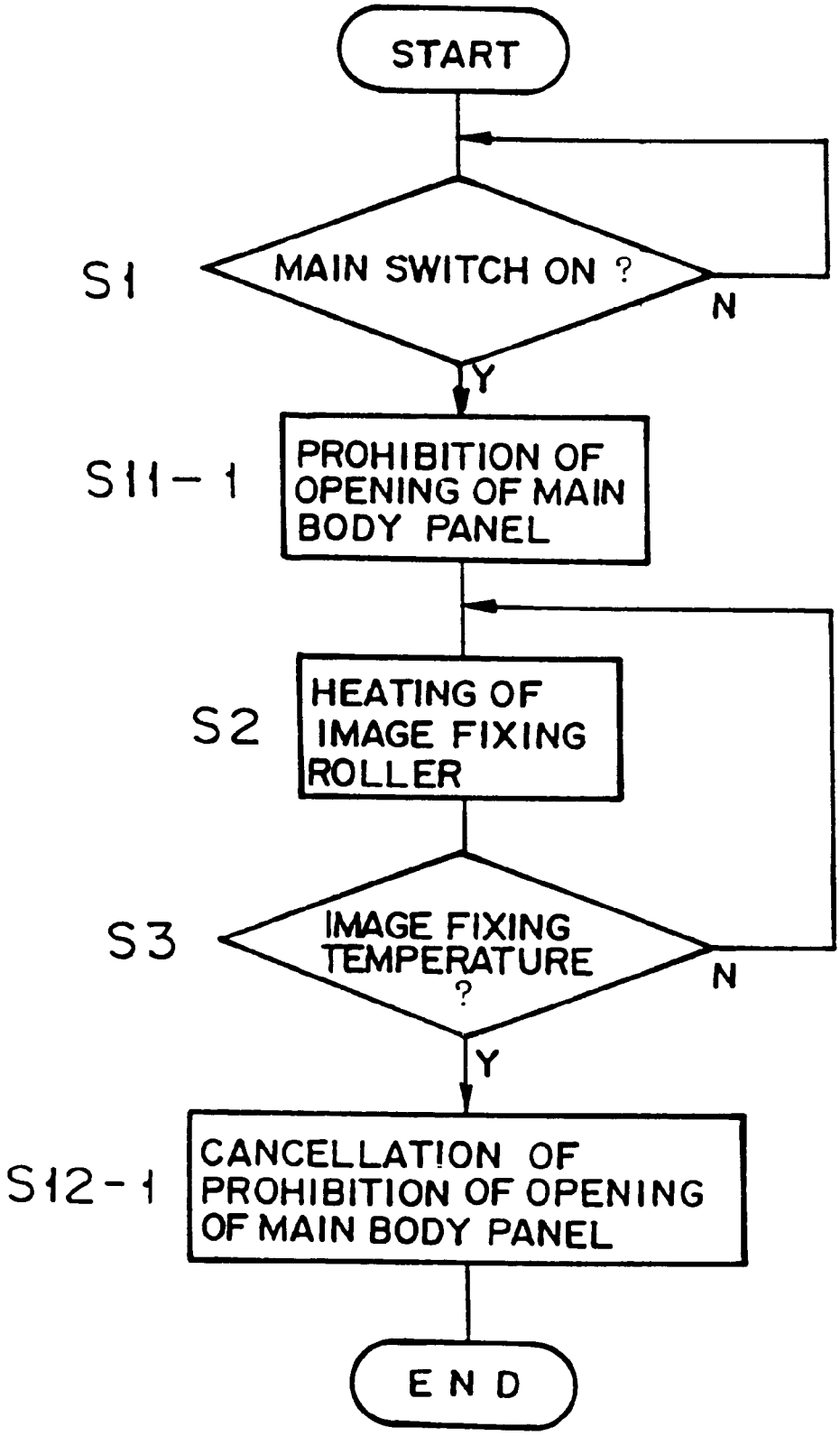
FIG. 19 is a flow chart of Example 2-1 of the present invention.

The operation of the image formation apparatus of the present invention in accordance with a flow chart in FIG. 19 is as follows on the supposition that the image formation apparatus is ready for making copies in the same manner as in Example 1-1, in which the same reference numerals designate identical routines in the above-mentioned steps, with the explanation thereof being omitted.

Figure 20:
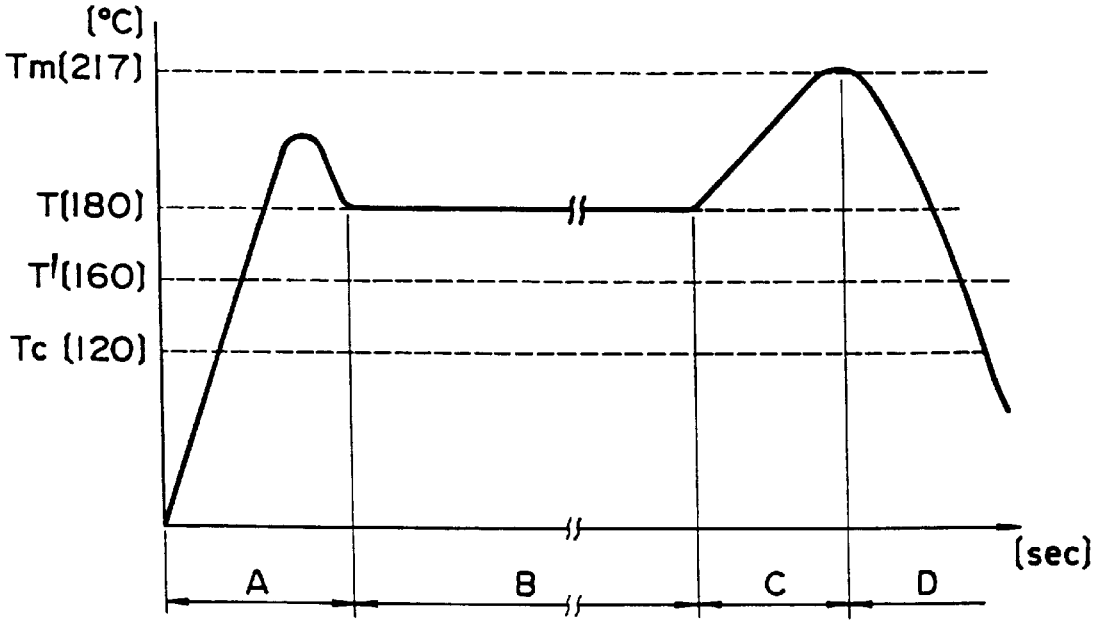
FIG. 20 is a graph showing the changes in the temperature of the external peripheral surface of an example of a phase transition layer of an image fixing roller for use in the present invention.

In the image formation apparatus, an image fixing roller comprising a phase transition material with the characteristics as shown in FIG. 20 is employed.

More specifically, the toner image fixing temperature T for the image fixing roller is 180° C., the crystallization initiation temperature Tc of the phase transition layer is about 120° C., the melting point Tm thereof is about 217° C., and the lower limit temperature T' for image fixing is 160° C. As the phase transition material, selenium is employed. The structure of the image fixing roller is the same as that of the image fixing roller 48-4 employed in Examples 1-1 to 1-4.

[Step 11-1]

When the main switch 5 is turned ON in Step 1, this step proceeds to Step 11-1. In Step 11-1, CPU 29 extends the pin 23*a* of the solenoid 23, so that the pin 23*a* engages the lock hole 21*b* of the metal plate 21, whereby the opening of the main body panel 9 is prohibited. Thus, this step proceeds to Step 2.

When the crystallization is released in the phase transition layer 55 in Step 2, if the ambient conditions around the image fixing unit are changed, for instance, by the inflow of cold air, the time required for elevating the temperature of the phase transition layer 55 to the image fixing temperature T may be prolonged. This can be prevented by prohibiting the opening of the main body panel 9. In other words, the temperature of the phase transition layer 55 can be effectively elevated to the image fixing temperature T by prohibiting the opening of the main body panel 8.

[Step 12-1]

When the temperature of the phase transition layer 55 is elevated to the image fixing temperature T, the prohibition of the opening of the main body panel 9 is canceled by retracting the pin 23*a* of the solenoid 23, thereby disengaging the pin 23*a* from the lock hole 21*a* of the metal plate 21 by operating CPU 29. This is because once the temperature of the phase transition layer 55 is elevated to the image fixing temperature T, even if the ambient conditions were changed and the phase transition layer 55 is cooled, the temperature does not decrease so quickly down to the lower limit temperature T' for image fixing. Furthermore, if paper jamming takes place in the main body of the image formation apparatus 1, or toner must be changed, and other maintenance operations are required, the main body panel 9 has to be opened.

The above-mentioned prohibition of the opening of the panel applies not only to the main body panel 9, but also to other panels or the like, if any, on each of opposite sides and back side of the image formation apparatus, particularly to any panel disposed near the image fixing unit.

EXAMPLE 2-2

Figure 21:
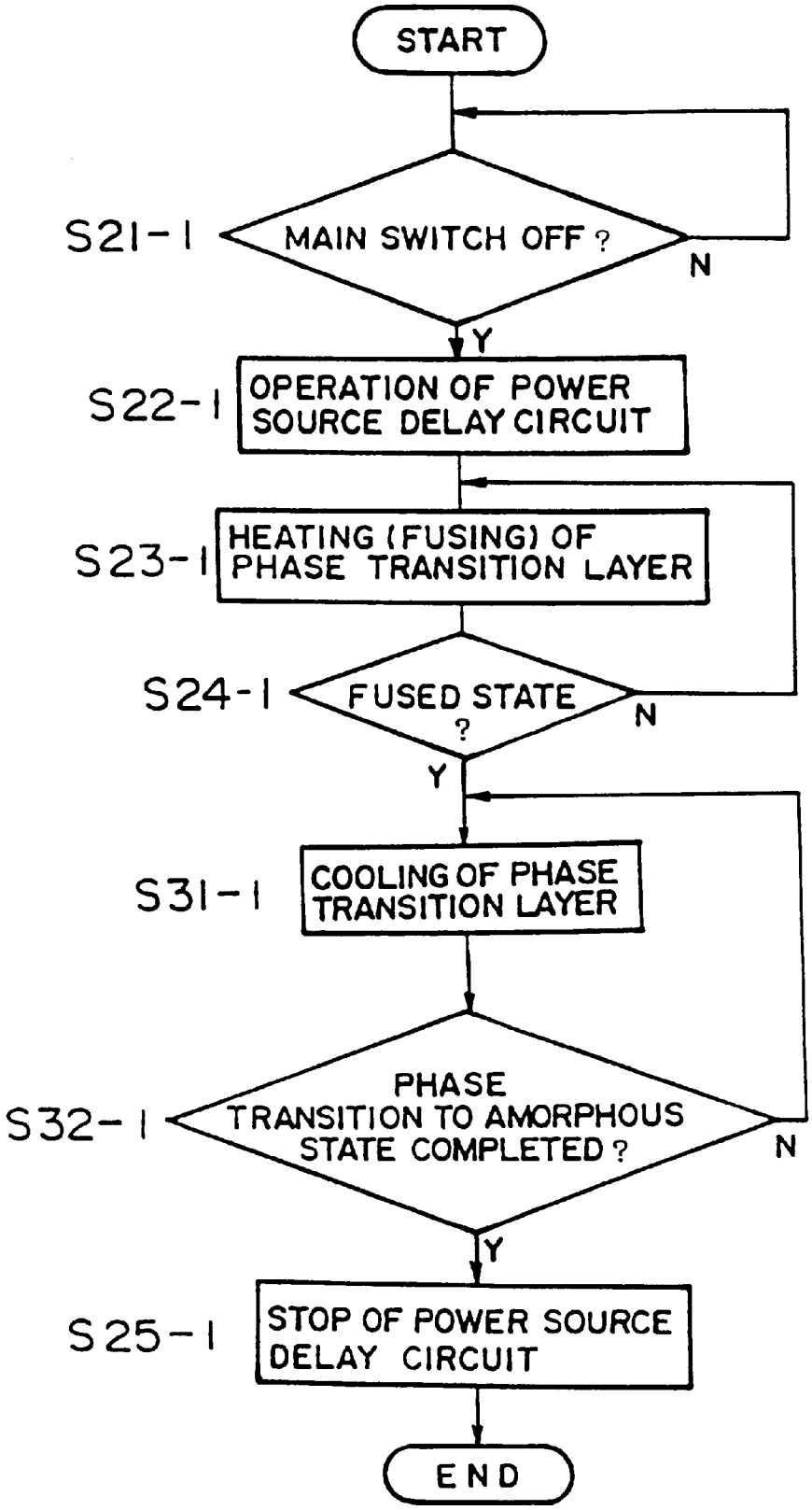
FIG. 21 is a flow chart of Example 2-2 of the present invention.

The operation of the image formation apparatus of the present invention in accordance with a flow chart of FIG. 21 is as follows on the supposition that the image formation apparatus is ready for making copies in the same manner as in Example 1-1, in which the same reference numerals designate identical routines in the above-mentioned steps, with the explanation thereof being omitted.

[Step 31-1]

In Step 31-1, the phase transition layer 55, fused through Steps 22-1 to 24-1, is rapidly cooled.

This cooling is initiated, using the endothermic function of the inner cylindrical member 57 which is released by causing an electric current to flow through the inner cylindrical member 57 in the direction opposite to the direction in the case of temperature elevation through a delayed power source.

This step proceeds to Step 32-1 after the above rapid cooling.

[Step 32-1]

In Step 32-1, there is detected whether or not the phase transition of the phase transition layer 55 to the amorphous state is performed by the cooling in Step 31-1.

When the phase transition to the amorphous state is performed, this step proceeds to Step 25-1 and the operation of the power source delay circuit 33 is terminated; while when the phase transition to the amorphous state is not performed, the cooling is continued. The power supply may be stopped when the phase transition to the amorphous state is attained.

In this case, this step may proceeds to Step 25-1 on the supposition that the phase transition to the amorphous state is attained when a predetermined period of time elapses. When a temperature-checking method is adopted, the temperature of the external peripheral surface of the image fixing roller is measured and the measured temperature is converted into the temperature of the phase transition layer 55.

The above-mentioned cooling can be carried out, using a cool-air blowing fan which is driven through a delay power source. In this case, rapid cooling is preferable. However, with reference to the cooling curve in a range D in FIG. 20, when the gradient of the cooling curve has become constant, the cooling may be terminated even when the phase transition to the amorphous state has not yet been completed.

The delay operation of the power source delay circuit 33 may be terminated when the phase transition to the amorphous state is attained, for instance, at 120° C.

Thus, when the main switch 5 is turned OFF, the phase transition layer 55 is forcibly cooled to attain the phase transition to the amorphous state, so that when the main switch is turned OFF and then turned ON, the phase transition layer 55 is ready for the generation of the crystallization heat.

With reference to FIG. 20, a range A is a warm-up range from Step 1 through Step 3; a range B is an image fixable range from Step 3 on; a range C is a fusing range of the phase transition layer 55 with the application of heat thereto in Step 23-1 to Step 24-1 (refer to FIG. 21) after the main switch 5 is turned OFF in Step 11-1; and a range D is a cooling range from Step 31-1 on.

EXAMPLE 2-3

Figure 22:
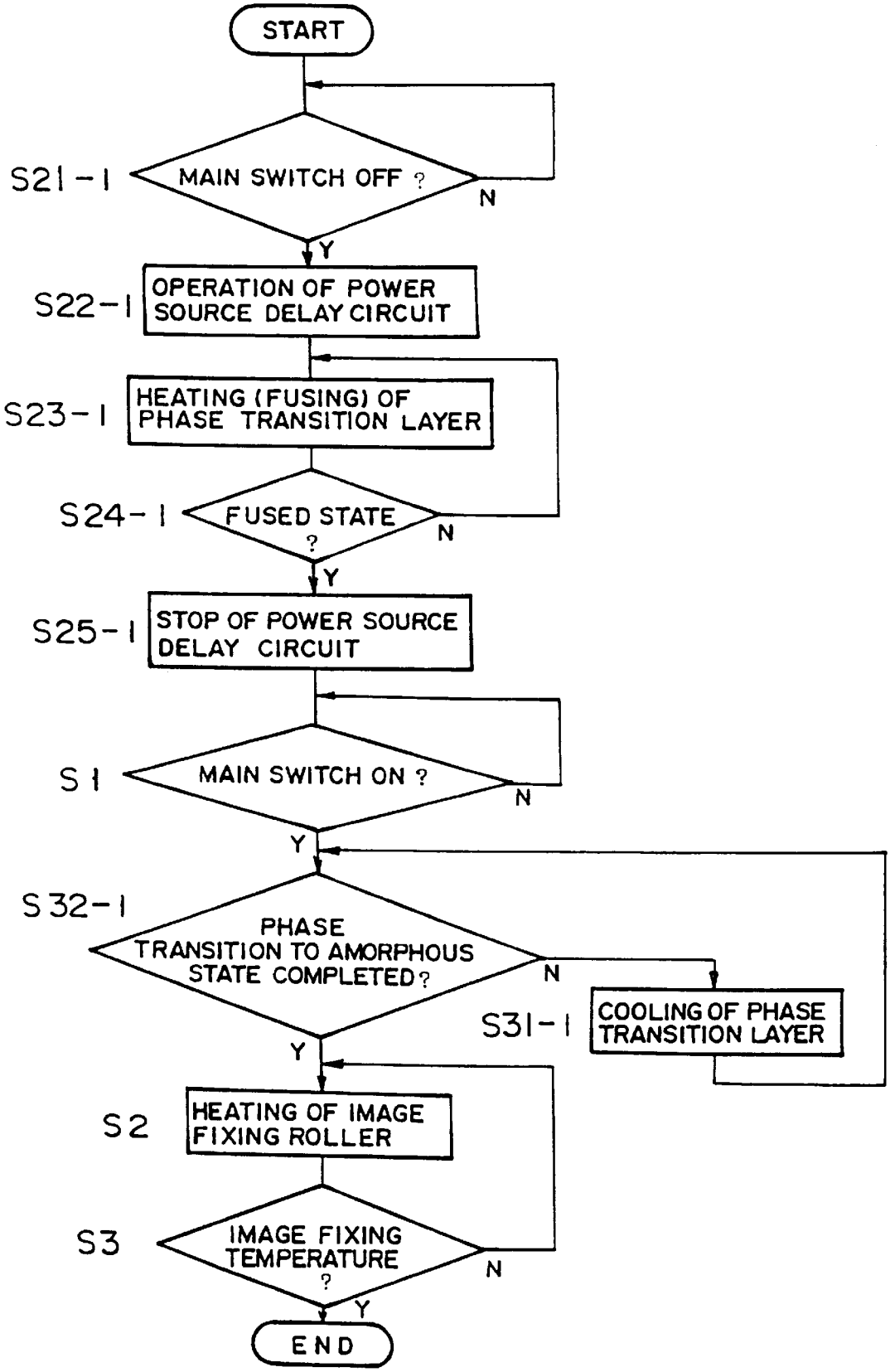
FIG. 22 is a flow chart of Example 2-3 of the present invention.

The operation of the image formation apparatus of the present invention in accordance with a flow chart of FIG. 22 is as follows on the supposition that the image formation apparatus is ready for making copies in the same manner as in Example 1-1, in which the same reference numerals designate identical routines in the above-mentioned steps, with the explanation thereof being omitted.

[Step 32-1]

In Step 32-1, there is detected whether or not the main switch 5 is turned ON or not in the same manner as in Step 1 under the conditions that the routines in Step 21-1 to Step 25-1 have been processed. When the main switch 5 is ON, this step proceeds to Step 32-1.

More specifically, in Step 32-1, by detecting the state of the phase transition layer 55 after the main switch 5 is turned ON, it is intended to perform the next step strictly depending upon the processing immediately after the main switch 5 is turned OFF, or the processing some time after the main switch 5 is turned OFF.

Where the phase transition of the phase transition layer 55 to the amorphous state is not complete immediately after the main switch 5 is turned OFF, this step is looped back to Step 31-1 to cool the phase transition layer 55 forcibly for the phase transition thereof to the amorphous state; while where the phase transition of the phase transition layer 55 to the amorphous state is complete with some time has passed after the main switch 5 is turned OFF, the routines in Step 2 and Step 3 are processed.

EXAMPLE 2-4

Figure 23:
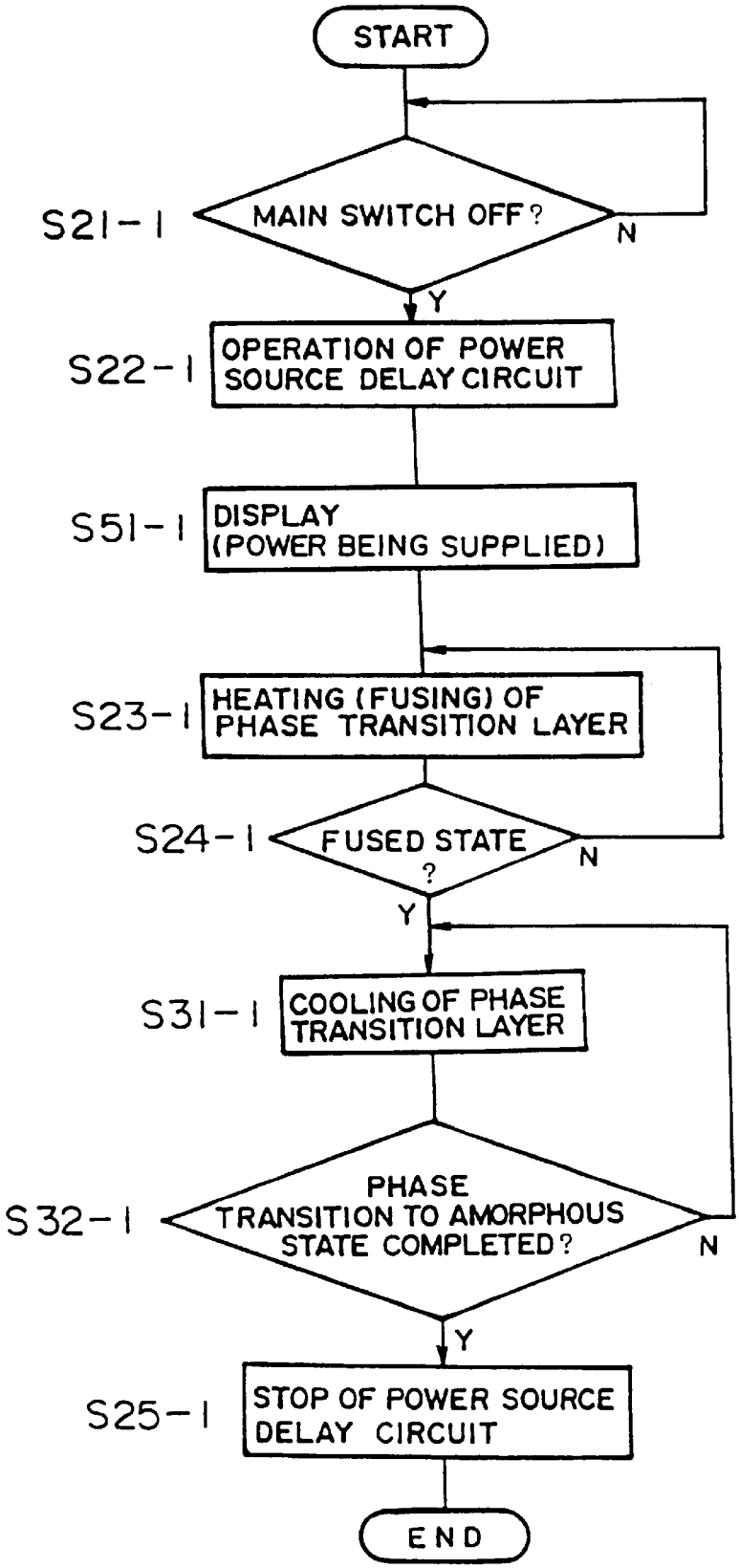
FIG. 23 is a flow chart of Example 2-4 of the present invention.

The operation of the image formation apparatus of the present invention in accordance with a flow chart of FIG. 23 is as follows on the supposition that the image formation apparatus is ready for making copies in the same manner as in Example 1-1, in which the same reference numerals designate identical routines in the above-mentioned steps, with the explanation thereof being omitted.

[Step 51-1]

In Step 51-1, when the power source delay circuit 33 is operated in Step 22-1 after the main switch 5 is turned OFF in Step 21-1, in order that the user does not misunderstand that the image formation apparatus is out of order by observing that the power supply state is not turned OFF even when the main switch 5 is turned OFF, for instance, with the liquid crystal display panel 18 being in a displaying state or with the running sounds within the image formation apparatus being continued, a message such as "temporal power supply continued", "image fixing apparatus being initialized", "in operation", or "turned off in 5 minutes", or a combination of any of such messages is displayed on the liquid crystal display panel 18. Thereafter, the routines in Steps 23-1, 24-1, 32-1, and 25-1 are processed.

Thus, by avoiding the user's misunderstanding that the image formation apparatus is out of order due to the delayed power supply, for example, it can be prevented to open the main body panel 9 inadequately.

The above-mentioned messages can be conveyed to the user, not only by the above-mentioned liquid crystal display panel 18, but also by voice message, or by some other display lamps.

EXAMPLE 2-5

Figure 24:
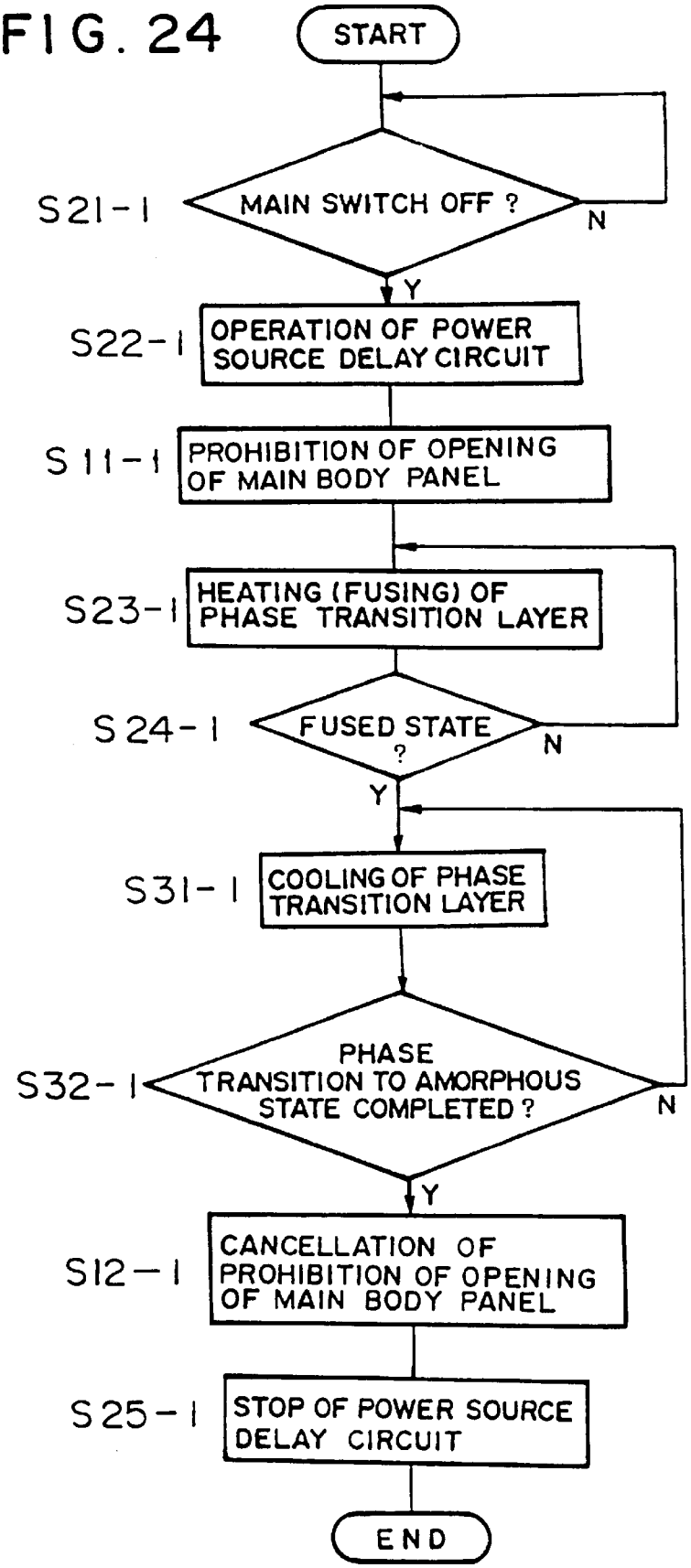
FIG. 24 is a flow chart of Example 2-5 of the present invention.

The operation of the image formation apparatus of the present invention in accordance with a flow chart of FIG. 24 is as follows on the supposition that the image formation apparatus is ready for making copies in the same manner as in Example 1-1, in which the same reference numerals designate identical routines in the above-mentioned steps, with the explanation thereof being omitted.

In Example 2-5, the function of the above-mentioned power source delay circuit 33 and the function of the solenoid 23 for prohibiting the opening of the main body panel 9 are provided.

In the above-mentioned Example 2-1, the prohibition of the opening of the main body panel 9 is made during the application of heat to the phase transition layer 55 for the phase transition thereof from the amorphous state to the crystalline state.

In contrast to this, in Example 2-5, the prohibition of the opening of the main body panel 9 is made during the application of heat to the phase transition layer 55 for the phase transition thereof from the crystalline state to the amorphous state as well, whereby the heating of the phase transition layer 55 is not affected by changes in the ambient conditions thereunder.

Therefore, in Example 2-5, of the above-mentioned steps, Steps 21-1, 22-1, 11-1, 23-1, 24-1, 31-1, 32-1, 12-1, and 25-1 are processed in this order. Generally, the user will rarely have access to the inside of the main body of the image formation apparatus after the main switch 5 is turned OFF. Therefore, the design may be such that even when the main switch 5 is turned OFF, the prohibition of the opening of the main body panel 6 is maintained, and when the main switch 5 is turned ON for the next use, and the phase transition of the phase transition layer 55 is completed, the prohibition of the opening of the main body panel 6 is canceled.

During the copy making possible time with the completion of the phase transition, the removal of jammed transfer sheets, and the exchange of a toner can be performed with the cancellation of the prohibition of the opening of the main body panel 9.

EXAMPLE 2-6

Figure 25:
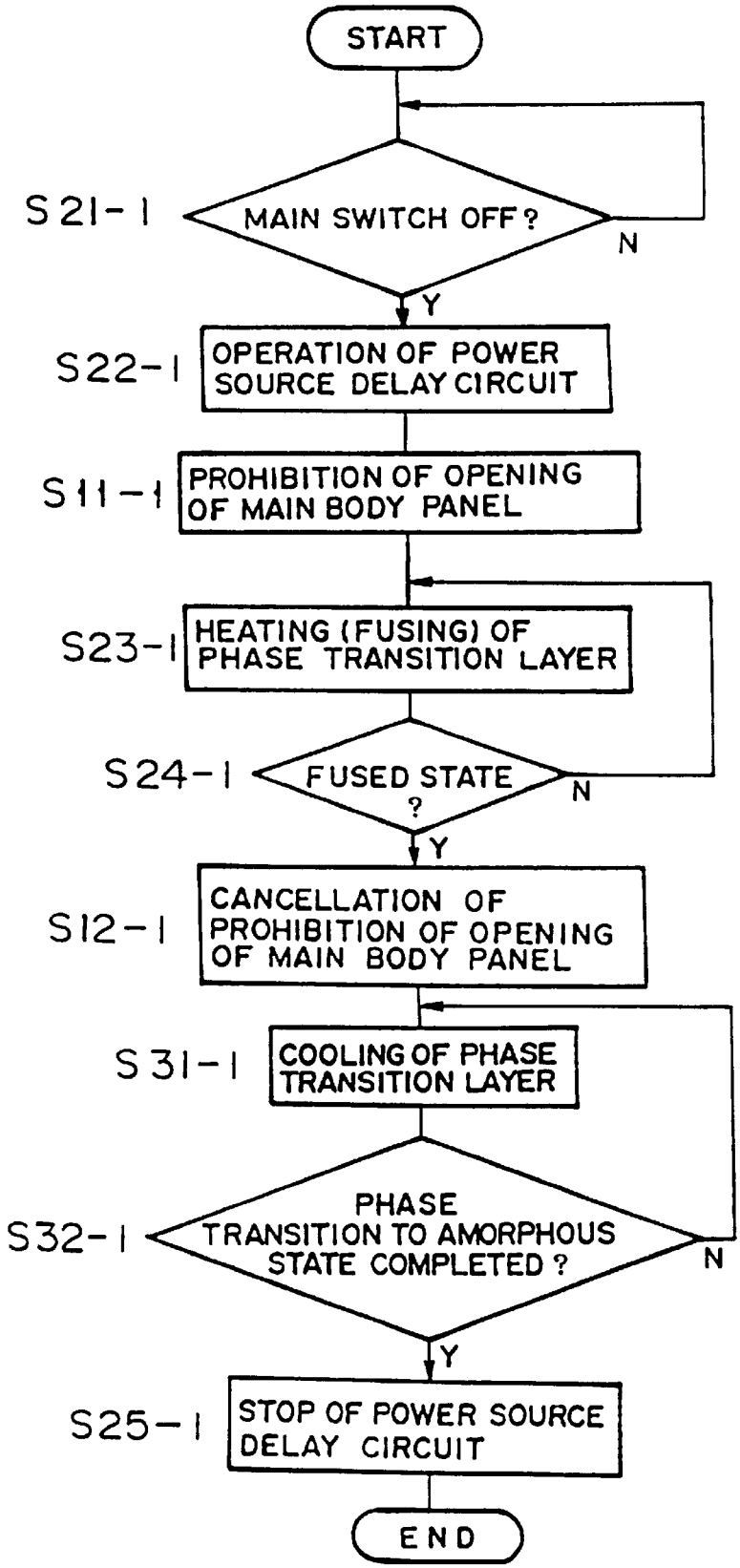
FIG. 25 is a flow chart of Example 2-6 of the present invention.

The operation of the image formation apparatus of the present invention in accordance with a flow chart of FIG. 25 is as follows on the supposition that the image formation apparatus is ready for making copies in the same manner as in Example 1-1, in which the same reference numerals designate identical routines in the above-mentioned steps, with the explanation thereof being omitted.

In Example 2-6, the function of the above-mentioned power source delay circuit 33 and the function of the solenoid 23 for prohibiting the opening of the main body panel 9 are provided in the same manner as in Example 2-5.

In Example 2-6, the prohibition of the opening of the main body panel 9 is made only during the application of heat to the phase transition layer 55 for the phase transition thereof from the crystalline state to the amorphous state. The main body panel 9 may be opened when the phase transition layer 55 is cooled after the completion of the fusing thereof, since the opening of the main body panel 9 does not have any adverse effects on the phase transition layer 55. Therefore in Example 2-6, the prohibition of the opening of the main body panel 9 is canceled before the cooling of the phase transition layer 55.

Therefore, in Example 2-6, of the above-mentioned steps, Steps 21-1, 22-1, 11-1, 23-1, 24-1, 12-1, 31-1, 32-1, and 25-1 are processed in this order.

EXAMPLE 2-7

Figure 26:
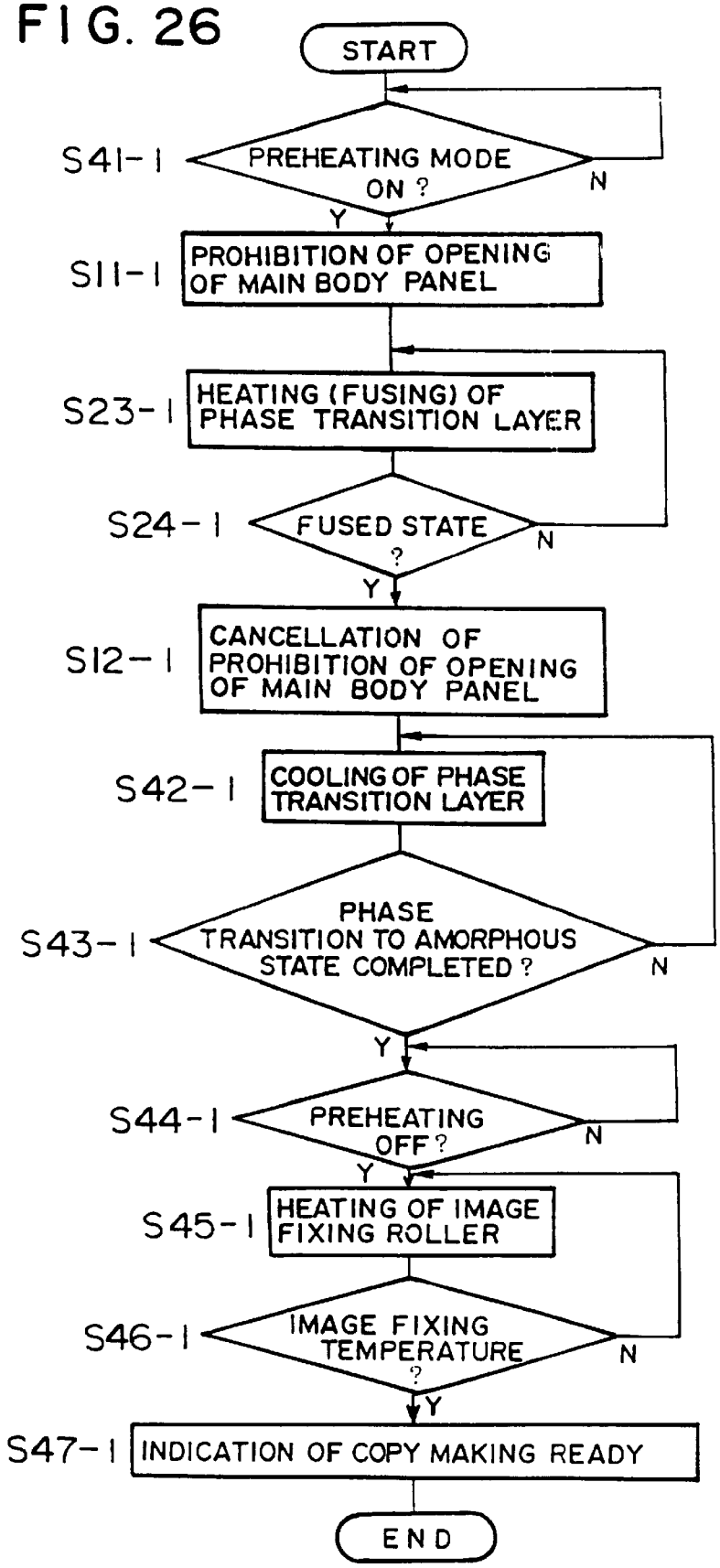
FIG. 26 is a flow chart of Example 2-7 of the present invention.

The operation of the image formation apparatus of the present invention in accordance with a flow chart of FIG. 26 is as follows on the supposition that the image formation apparatus is ready for making copies in the same manner as in Example 1-1, in which the same reference numerals designate identical routines in the above-mentioned steps, with the explanation thereof being omitted.

This example is directed to the case where the preheating mode is set, when no copy making operation is performed for more than a predetermined period of time, although the image formation apparatus is in the copy-making ready state, or when the preheating mode switch 19 is pressed.

[Step 41-1]

In step 41-1, there is monitored whether or not no operation has been made for more than a predetermined period of time, or the preheating mode is ON by pressing the preheating mode switch 19.

When the preheating mode is ON, the routines are process in the order of Steps 11-1, 23-1, 24-1, and 12-1, followed by the process of performing the phase transition of the phase transition layer 55 from the crystalline state to the amorphous state. During the heating for the phase transition, the opening of the main body panel 9 is prohibited for the same reasons as mentioned in the above-mentioned examples. This step then proceeds to Step 42.

When the preheating mode is not ON, Step 41 is continuously monitored.

[Step 42-1 and Step 43-1]

In Step 42-1, the fused phase transition layer 55 is cooled, so that this step proceeds to Step 43-1.

In Step 43-1, there is detected whether or not the phase transition of the phase transition layer 55 to the amorphous state is completed. When the phase transition of the phase transition layer 55 to the amorphous state is completed, this step proceeds to Step 44-1, while when the phase transition of the phase transition layer 55 to the amorphous state is not completed, the cooling is continued.

The monitoring of the completion of the phase transition to the amorphous state in Step 43-1 is different from that in the above-mentioned Step 32-1. The monitoring in Step 43-1 is for making shorter the period of time from the cancellation of the preheating mode to the attainment of the image fixable state by the image fixing roller than the period of time from the turning ON of the main switch 5 to the attainment of the image fixable state by the image fixing roller. The cooling in the preheating mode is performed at a temperature which is below the crystallization initiation temperature Tc of the image fixing roller, but close thereto.

[Step 44-1]

In Step 44-1, there is detected whether or not the preheating mode is canceled by pressing the preheating mode 19 or by some other operation instructions. When the preheating mode is canceled, this step proceeds to Step 45-1, while when the preheating mode is not canceled, the preheating mode is continued.

[Step 45-1 and Step 46-1]

In Step 45-1, in accordance with the cancellation of the preheating mode, the phase transition layer 55 is heated to make it ready for next copy making, and this step proceeds to Step 46-1.

In Step 46-1, whether or not the temperature of the external peripherals surface of the image fixing roller reaches the image fixing temperature is detected. When the image fixing temperature is reached, the heating is stopped, and this step proceeds to Step 47-1, while when the image fixing temperature is not reached, the heating is continued.

[Step 47-1]

In Step 47-1, the information that copy making is ready is displayed on the liquid display panel 18 with the cancellation of the preheating mode.

Figure 27:
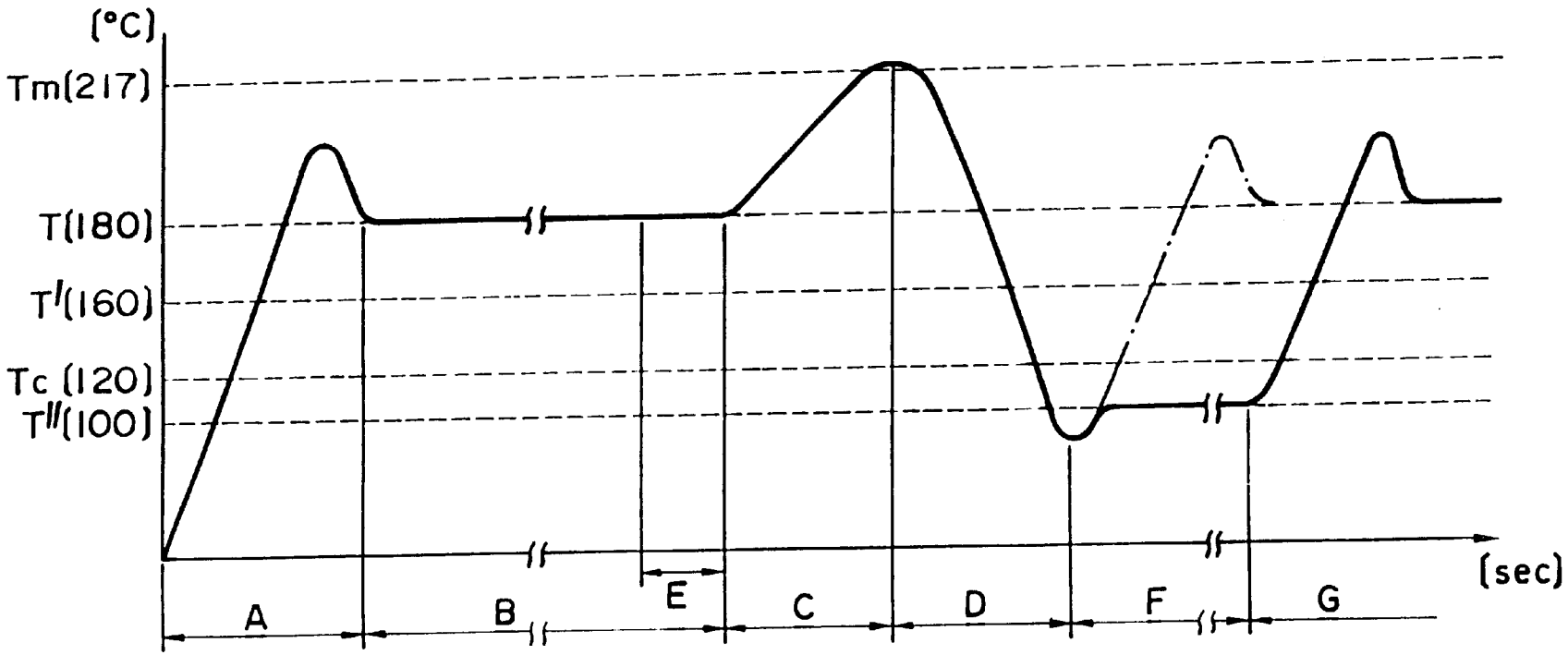
FIG. 27 is a graph showing the changes in the temperature of the external peripheral surface of the phase transition layer of the image fixing roller in Example 2-7 of the present invention.

FIG. 27 is a graph showing the changes in the temperature of the external peripheral surface of the image fixing roller, including the preheating mode. Ranges A, B, C and D in the graph are substantially the same as the corresponding ranges in the above-mentioned examples.

A range E is a count range for the predetermined period of time; a range F is a preheating range after the heat application and cooling for the preheating from Step 41-1 to Step 43-1 corresponding to the range C and range D; a range G is a return range with cancellation of the preheating from Step 44-1 to Step 46-1.

An alternate long and short dash curve within the range F indicates the heating state in Example 2-3 when the main switch 5 is turned ON immediately after the turning OFF of the main switch 5.

When selenium is employed in the phase transition layer 55, the crystallization initiation temperature Tc thereof is about 120° C. With this taken into consideration, the preheating temperature T" is set near 100° C. at which the phase transition layer 55 is in the amorphous state.

In the image formation apparatus of the present invention, there is provided a main switch for switching the power supply to the image formation apparatus with ON and OFF. Furthermore, there are provided heating and cooling means for performing the phase transition of the phase transition layer to either the amorphous state or the crystalline state by heating or cooling the phase transition layer, image formation instruction application switching means for outputting instructions relating to image formation, and a preliminary control section for validating or invalidating the instructions relating to image formation. More specifically when the preliminary control section is ON, the above-mentioned heating and cooling means is operated, so that an appropriate phase transition is performed in the phase transition layer.

When the preliminary control section is turned ON, the phase transition layer is once cooled, and is then fused by the heating and cooling means. This cooling time can be used as a stand-by time.

In the preliminary cooling with the preliminary control section being turned ON, when the phase transition layer is cooled to the lower limit temperature for image fixing, a maximum stand-by time can be secured.

In the course of the preliminary cooling with the preliminary control section being turned ON, by making image fixing possible even if the preliminary control section is turned OFF, the image formation apparatus can cope with immediate image formation.

When the temperature of the image fixing roller is within the image fixable temperature range in the course of the phase transition of the phase transition layer with the preliminary control section being ON, even if the preliminary control section is turned OFF, by making image fixing possible, the image formation apparatus can cope with image formation in the course of the phase transition.

When the preliminary section is turned OFF after the completion of the phase transition of the phase transition layer to the amorphous state, with the preliminary control section being ON, the warm-up of the image fixing roller can be quickly performed by heating the phase transition layer by the heating and cooling means.

When the main switch is turned OFF after the completion of the phase transition of the phase transition-layer to the amorphous state with the preliminary control section being ON, the amorphous state is maintained, whereby the power consumption for cooling can be saved and the next warm-up can be quickly performed. The following are such examples.

EXAMPLE 3-1

Figure 28:
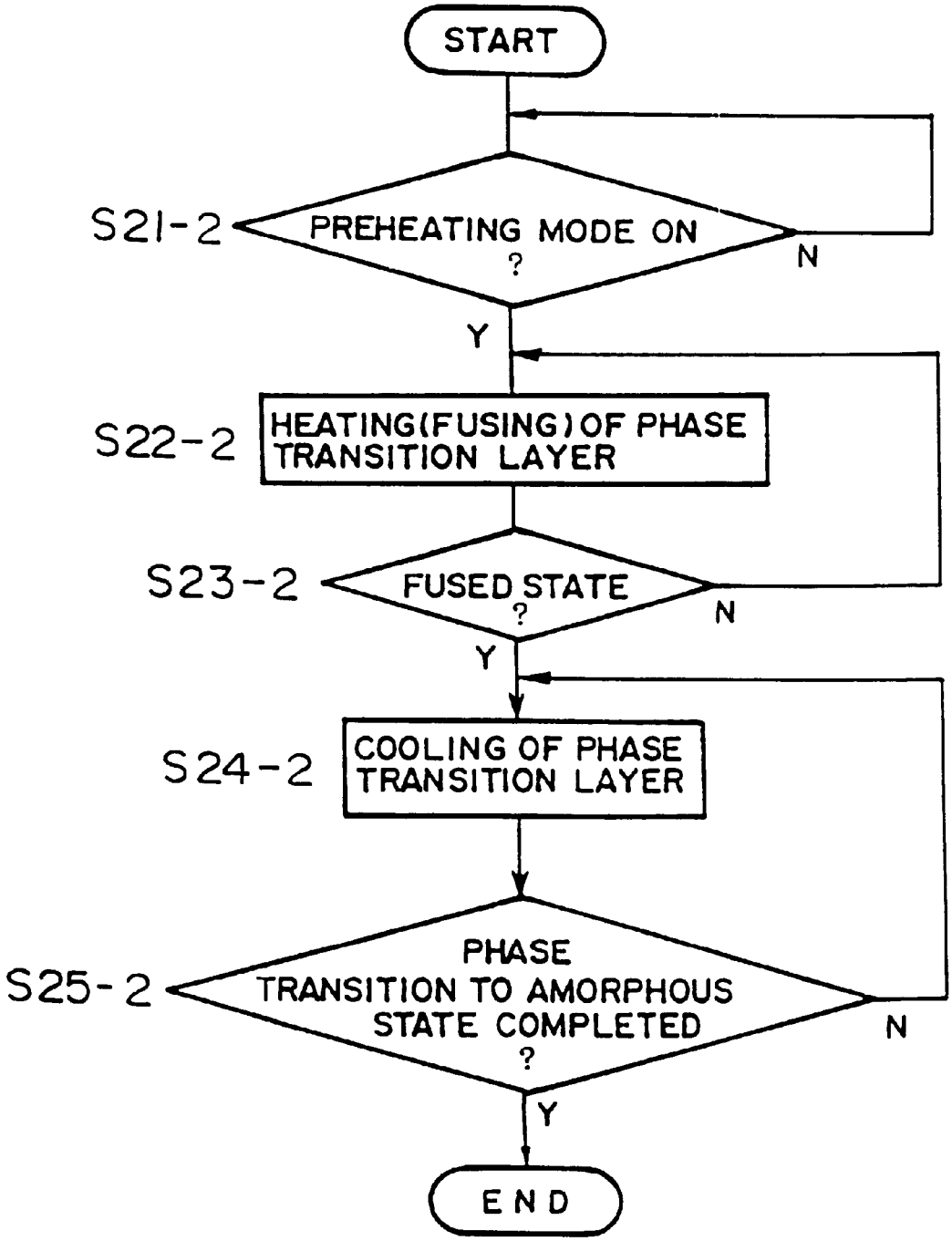
FIG. 28 is a flow chart of Example 3-1 of the present invention.

The operation of the image formation apparatus of the present invention in accordance with a flow chart of FIG. 28 is as follows on the supposition that the image formation apparatus is ready for making copies in accordance with the routine shown in FIG. 12.

[Step 21-2]

In Step 21-2, whether or not the preheating mode is ON is detected. When the preheating mode is ON, a signal is output to CPU 29 via I/O 31, and an instruction signal for displaying the warm-up state of the image formation apparatus 1 in the liquid crystal display panel 18 is output from CPU 29, so that this step proceeds to Step 22-2.

When the preheating mode is not ON, Step 21-2 is continuously monitored.

In the above preheating mode, power is supplied only to the image fixing roller, and the power supplied to the image fixing roller is reduced for power saving.

A section for setting the above-mentioned preheating mode serves as a preliminary control section for validating (when OFF) or invalidating (when ON) an image formation instruction output from an image formation instruction switch, relating to the image formation instruction from the operation and display section 16 such as a start switch 17.

With reference to FIG. 11, for instance, the preheating mode is made ON or OFF in response to the ON or OFF of the preheating mode switch 19. However, when the preheating mode switch 19 is turned ON, the timer 32 begins to operate. When no operation is carried out for a predetermined period of time, the step enters the preheating mode. Whenever some operation is performed within the predetermined period of time, the timer 32 is cleared. It is also possible to monitor the presence or absence of any operation by keeping the timer 32 in operation without using the preheating mode switch 19.

In Example 3-1, the preheating mode is made ON or OFF in response to the ON or OFF of the preheating mode switch 19.

[Step 22-2]

In Step 22-2, in accordance with the preheating mode set in Step 21-2, the phase transition layer 55, which is in the crystalline state due to the routines in FIG. 12, is heated by the inner cylindrical member 57, so that this step proceeds to Step 23-2.

[Step 23-2]

In step 23-2, whether the phase transition layer 55 heated by the inner cylindrical member 57 is in a fused state or not is detected. More specifically, whether the temperature of the phase transition layer 55 reaches at least its melting point Tm or not is detected. When the temperature reaches at least the melting point Tm, this step proceeds to Step 24-2, while when the temperature does not reach at least the melting point Tm, the heating is continued.

[Step 24-2]

In Step 24-2, the phase transition layer 55, which is in a fused state, is cooled for the phase transition thereof to the amorphous state by the inner cylindrical member 57. Thus, this step proceeds to Step 25-2.

In the above, the phase transition layer 55, which is in the crystalline state, is fused, and then cooled. This is because if the phase transition is carried out gradually, the phase transition layer 55 will deteriorate.

[Step 25-2]

In Step 25-2, whether the phase transition layer 55 is in the amorphous state or not is detected. When the phase transition layer 55 is in the amorphous state, the inner cylindrical member 57 is controlled so as to maintain the above amorphous state, while when the phase transition layer 55 is not yet in the amorphous state, the cooling is continued. In order to maintain the above-mentioned amorphous state, the temperature of the image fixing roller is detected by a temperature detection sensor such as a thermistor, and when the detected temperature is below a predetermined lower limit temperature, the phase transition layer 55 is heated by the inner cylindrical member 57.

The above-mentioned phase transition to the amorphous state is performed to make shorter the period of time from the cancellation of the preheating mode to the time at which the image fixing roller 48-4 reaches an image fixable state than the period of time from the turning ON of the main switch 5 to the time at which the image fixing roller 48-4 reaches the image fixable state. Therefore it is preferable that the preheating temperature be lower than the crystallization initiation temperature Tc of the image fixing roller 48-4, but be close thereto.

When the preheating mode is canceled, the image fixing roller 48-4 is again heated by the inner cylindrical member 57 so as to set the image fixing roller 48-4 in the image fixable state. By setting the preheating state at a temperature lower than the crystallization initiation temperature Tc of the image fixing roller 48-4, but close thereto, the image fixing roller 48-4 can be heated, using the crystallization heat after the cancellation of the preheating mode, and the deterioration of the phase transition layer 55 can be —prevented.

EXAMPLE 3-2

Figure 29:
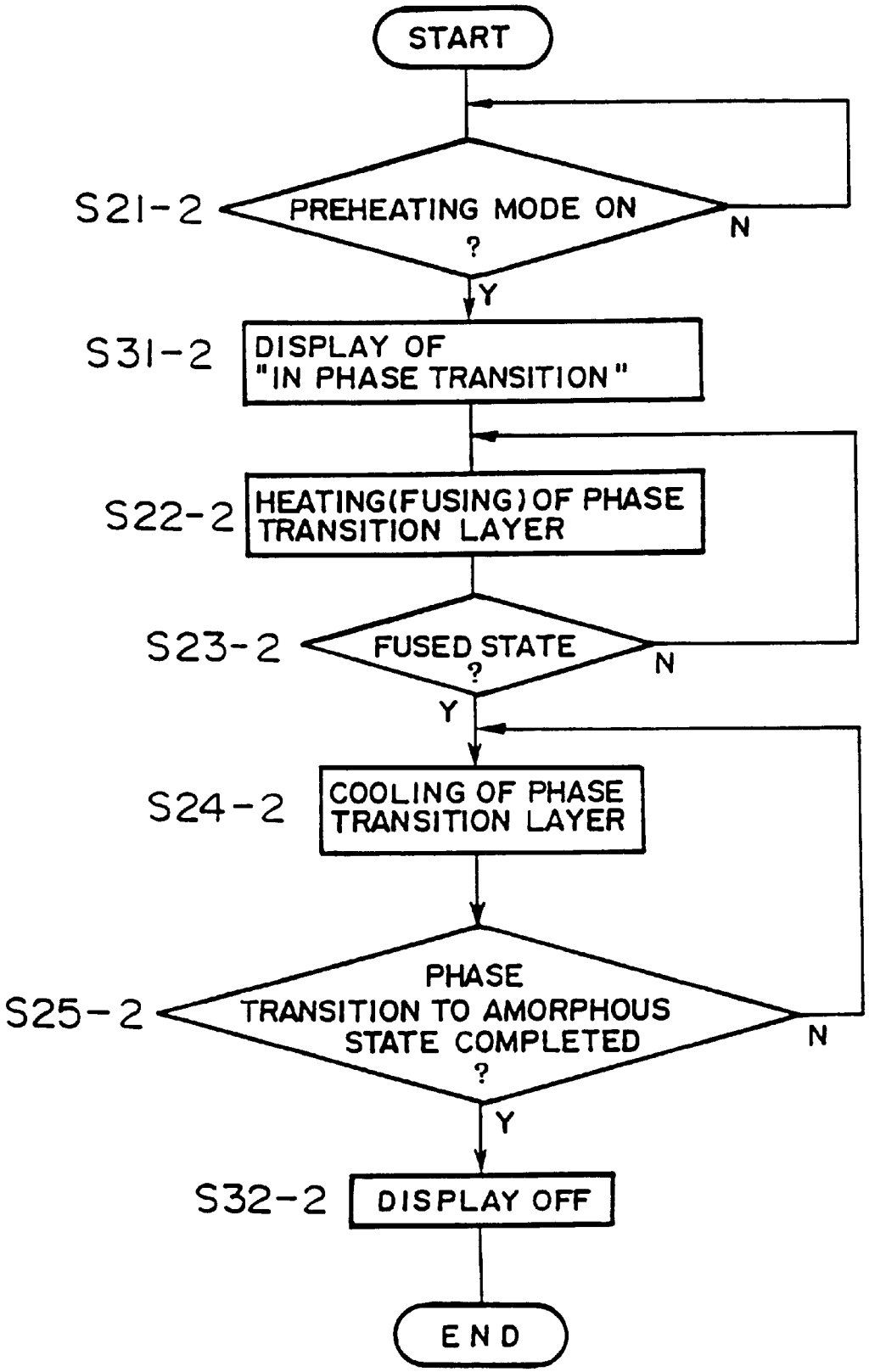
FIG. 29 is a flow chart of Example 3-2 of the present invention.

The operation of the image formation apparatus of the present invention in accordance with a flow chart of FIG. 29 is as follows on the supposition that the image formation apparatus is ready for making copies in accordance with the routine shown in FIG. 12.

[Step 31-2]

In Step 31-2 in Example 3-2, in order that the user can recognize that the routines from Step 22-2 on will be processed in accordance with the preheating mode ON, a message such as "Image fixing unit is now being initialized. Please wait for a while" is displayed on the liquid crystal display panel 18. Thereafter, the routines from Step 22-2 on are processed, and with the completion of the phase transition to the amorphous state in Step 25-2, this step proceeds to Step 32-2.

Thus the adverse effects on the fusion of the phase transition layer 55, which otherwise may be caused by the main body panel 9 being opened, can be prevented.

The above-mentioned message can be conveyed to the user, not only by the liquid crystal display panel 18, but also by voice message, a message-bearing lamp, or a flickering lamp.

[Step 32-2]

In Step 32-2, the display of the liquid crystal display panel 18 is turned OFF in accordance with the completion of the phase transition of the phase transition layer 55 to the amorphous state for the preheating mode.

The display OFF may be performed between Step 23-2 and Step 24-2, namely after the completion of the heating.

EXAMPLE 3-3

Figure 30:
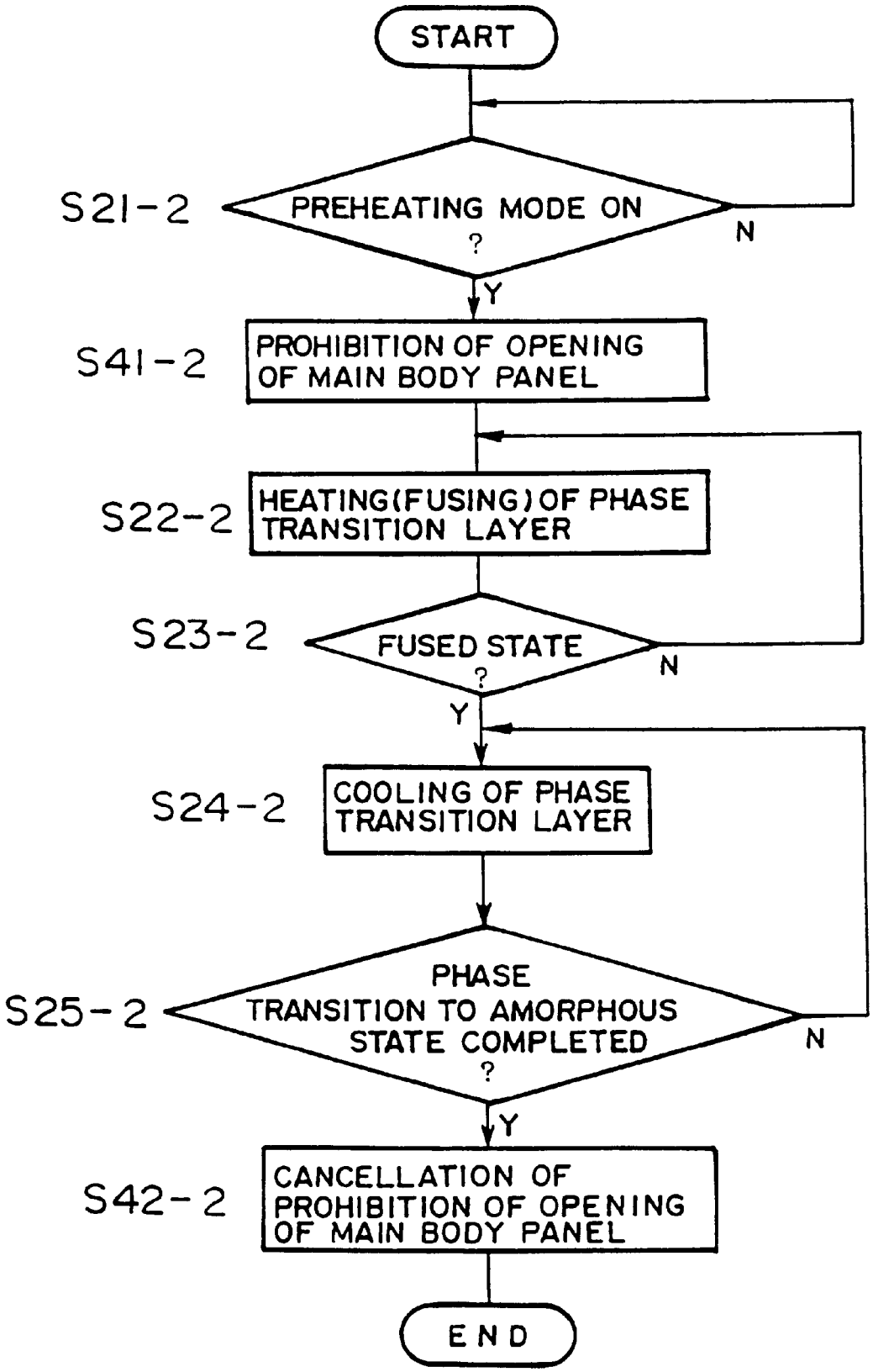
FIG. 30 is a flow chart of Example 3-3 of the present invention.

The operation of the image formation apparatus of the present invention in accordance with a flow chart of FIG. 30 is as follows on the supposition that the image formation apparatus is ready for making copies in accordance with the routine shown in FIG. 12.

[Step 41-2]

In Step 41-2, when the preheating mode is ON in Step 21-2, the main body panel 9 is locked by extending the pin 23*a* of the solenoid 23, in order to forcibly prevent the adverse effects of the changes in the ambient conditions, caused by the opening of the main body panel 9.

Thereafter, the routines from Step 22-2 on are processed, and with the completion of the phase transition to the amorphous state in Step 25-2, this step proceeds to Step 42-2.

[Step 42-2]

In Step 42-2, in accordance with the phase transition of the phase transition layer 55 to the amorphous state in Step 25-2, the opening of the main body panel 9 will not cause any problems, so that the pin 23*a* of the solenoid 23 is withdrawn, the prohibition of the opening of the main body panel 9 is canceled. Hereinafter, the preheating mode is continued.

EXAMPLE 3-4

Figure 31:
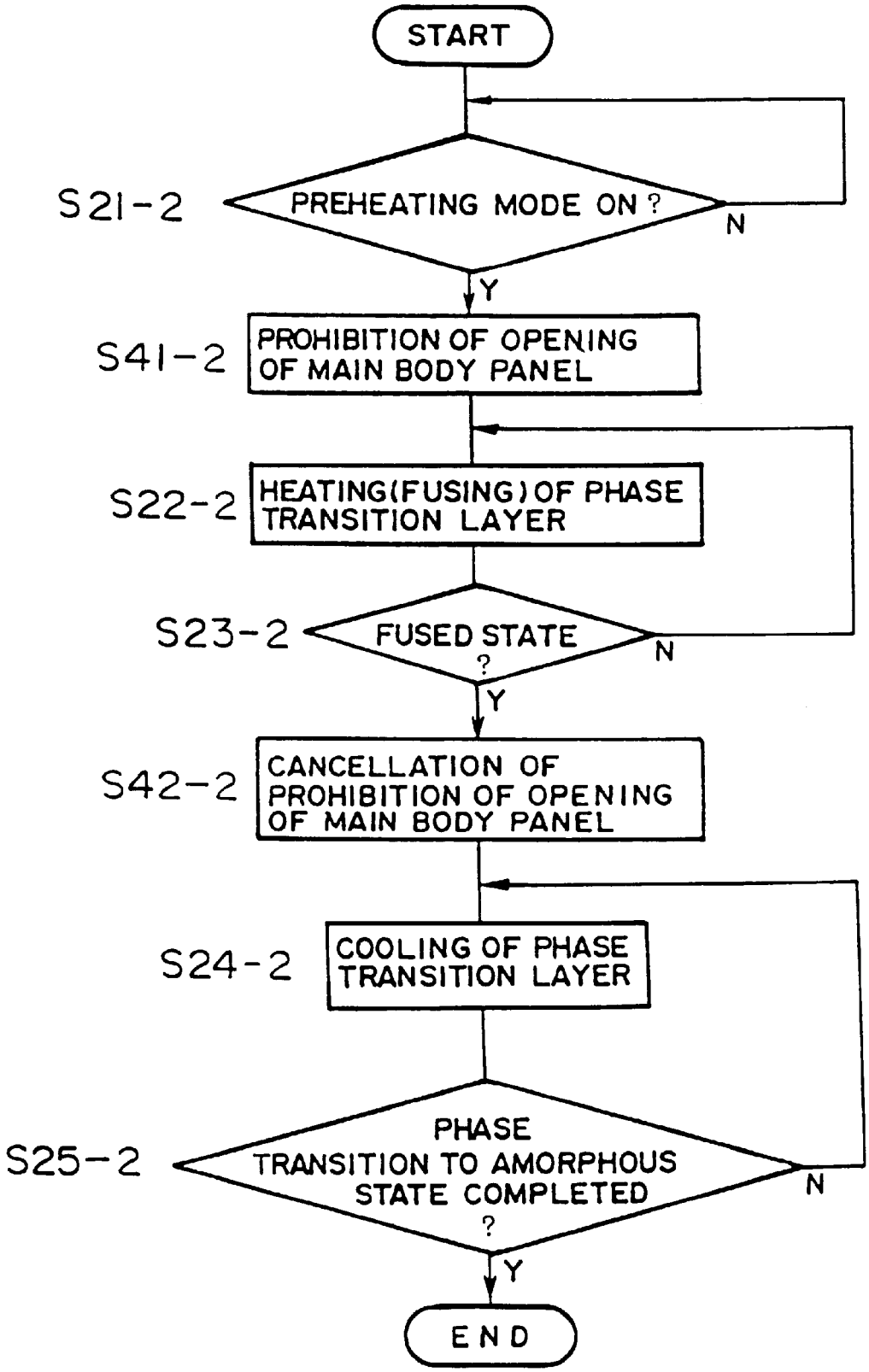
FIG. 31 is a flow chart of Example 3-4 of the present invention.

The operation of the image formation apparatus of the present invention in accordance with a flow chart of FIG. 31 is as follows on the supposition that the image formation apparatus is ready for making copies in accordance with the routine shown in FIG. 12.

In Example 3-4, the prohibition of the opening of the main body panel 9 in Example 3-3 is canceled at the completion of the heating, namely between Step 23-2 and Step 24-2, thereby prohibiting the opening of the main body panel 9 only during the heating step, since it is the heating step that is affected by the opening of the main body panel 9.

EXAMPLE 3-5

Figure 32:
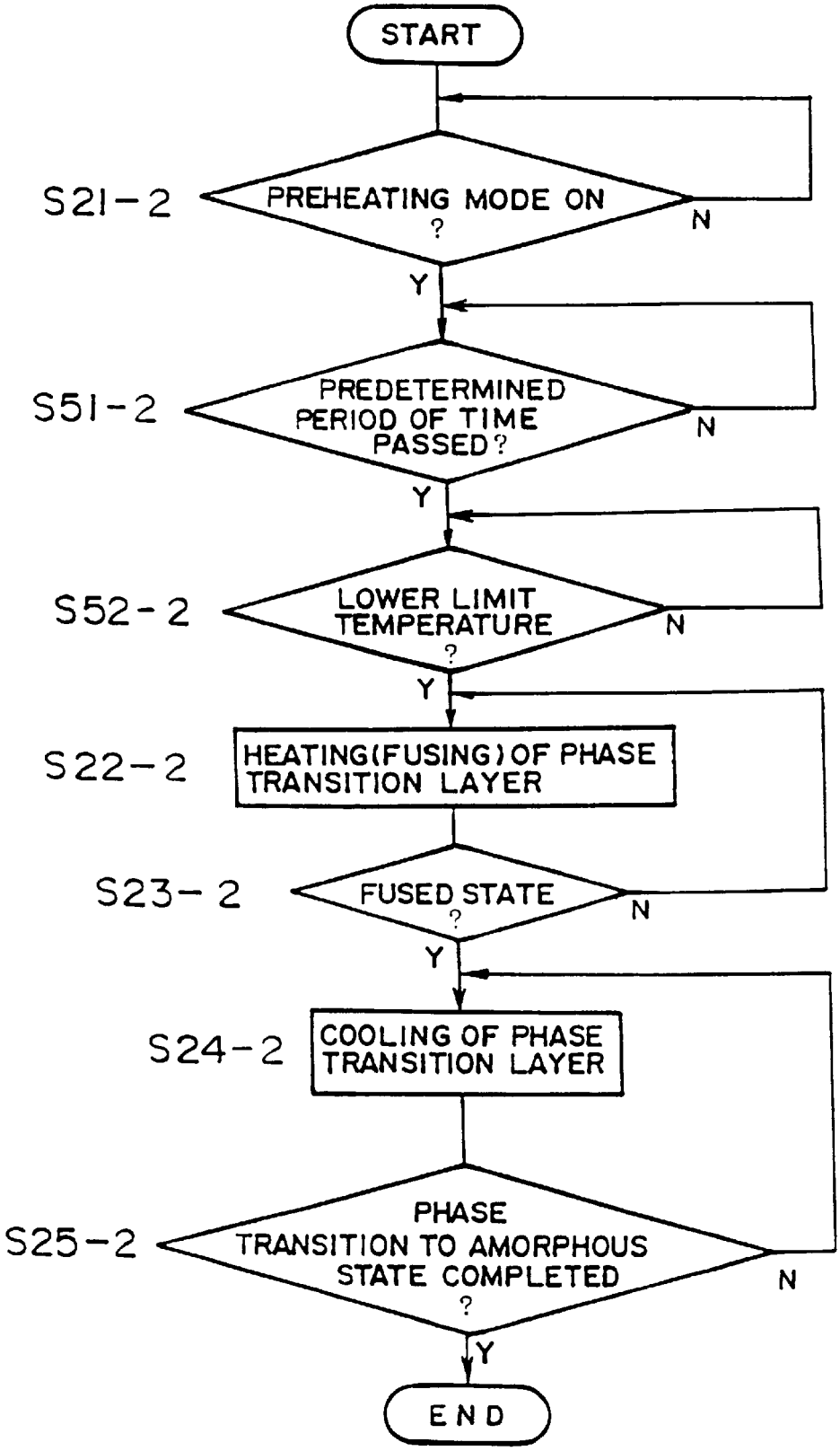
FIG. 32 is a flow chart of Example 3-5 of the present invention.

The operation of the image formation apparatus of the present invention in accordance with a flow chart of FIG. 32 is as follows on the supposition that the image formation apparatus is ready for making copies in accordance with the routine shown in FIG. 12.

[Step 21-2]

In the preheating mode ON in Step 21-2 in Example 3-5, unlike the preheating mode ON in the above-mentioned Examples, the temperature control of the image fixing roller 48-4 is not carried out in the preheating mode ON, but the using state of the image formation apparatus is judged from the count results, using the timer 32, and that the temperature controlling mode for the image fixing roller 48-4 is ON is automatically indicated. When this mode is selected, this step proceeds to Step 51-2.

[Step 51-2]

In Step 51-2, there is detected whether or not an operation instruction is not made for a predetermined period of time, such as the ON operation of the preheating mode switch 19 or the pressing of the start switch 17 thereafter. Whenever any of such operations is performed, the count is cleared, and when the predetermined period of time elapses, this step proceeds to Step 52-2.

[Step 52-2]

In Step 52-2, when the count by the timer 32 is finished, the power supply to the image fixing roller 48-4 is stopped, and the temperature of the image fixing roller 48-4 is monitored as to whether or not the temperature of the external peripheral surface of the image fixing roller 48-4 reaches the lower limit temperature T' for image fixing when the image fixing roller 48-4 is subjected to natural cooling by being allowed to stand at room temperature.

In other words, the phase transition is not initiated immediately after the completion of the count by the timer 32, but initiated when the temperature of the external peripheral surface of the image fixing roller 48-4 has reached the lower limit temperature T' for image fixing by the natural cooling, so that a predetermined delay time is provided before the initiation of the phase transition.

In the case where some operation is performed at almost the same time as the completion of the count by the timer 32, the above-mentioned delay time makes it possible for the operator to avoid the wasting of power consumption and operation time, which may be otherwise caused by the requirement that the operator must wait for the completion of the phase transition because the phase transition operation is already started by then.

Thus, since the power supply to the image fixing roller 48-4 is stopped, the count time by the timer 32 can be extended while maintaining the advantages of the preheating mode. Therefore, the range D corresponding to Step 52-2 has to be limited to the image fixable range, and when the lower limit temperature T' for image fixing is reached, this step proceeds to Step 22-2, the preheating routines in Step 23-2 to Step 25-2 are carried out.

The above-mentioned delay time can be secured by the above-mentioned natural cooling, or by the forcible cooling using the inner cylindrical member 57.

EXAMPLE 3-6

Figure 33:
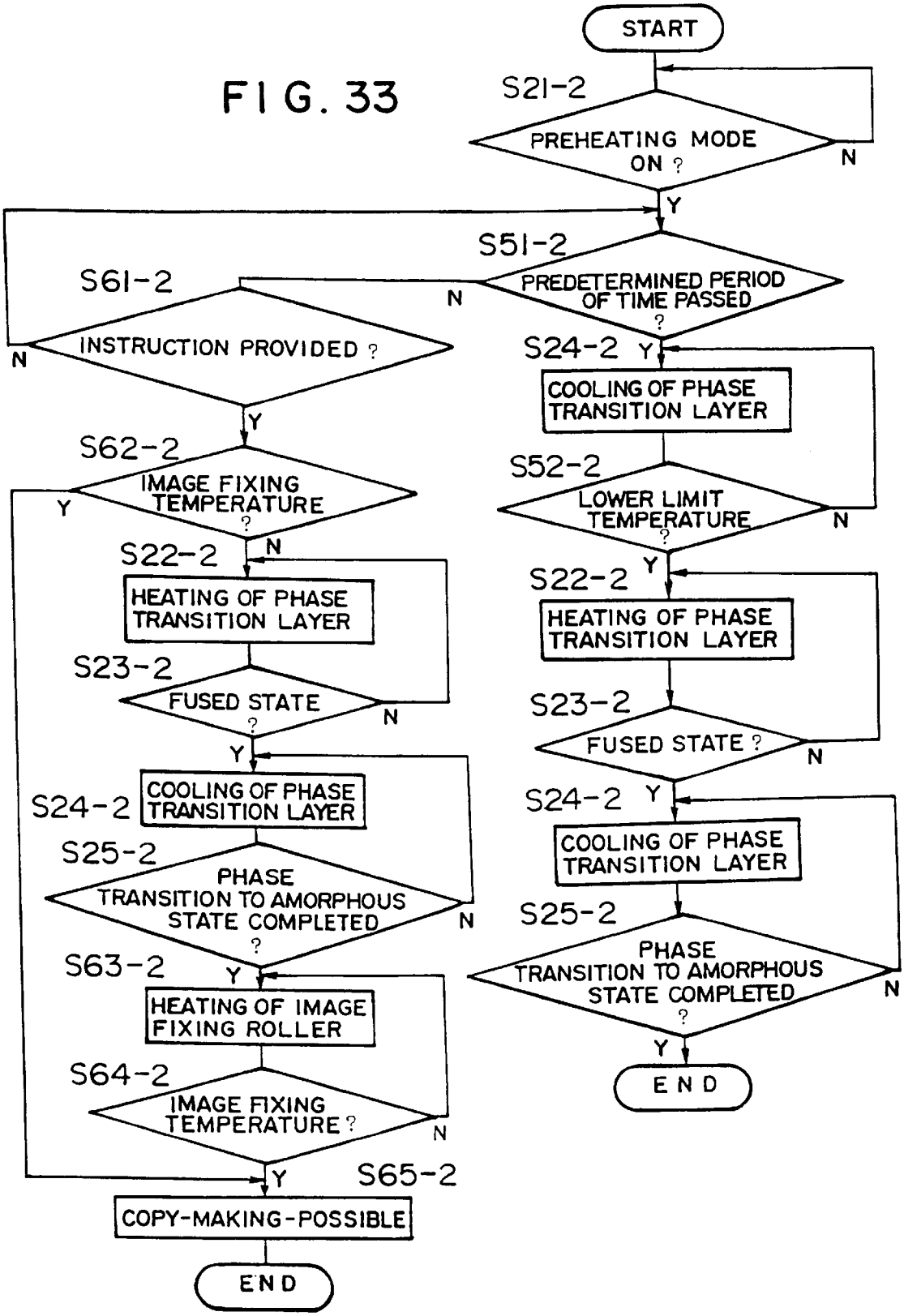
FIG. 33 is a flow chart of Example 3-6 of the present invention.

The operation of the image formation apparatus of the present invention in accordance with a flow chart of FIG. 33 is as follows on the supposition that the image formation apparatus is ready for making copies in accordance with the routine shown in FIG. 12.

[Step 51-2]

In Step 51-2, when the same detection as in Example 3-5 has been made, and the predetermined period of time has elapsed with the same result of the detection, this step proceeds to Step 24-2, while when the predetermined period of time has not elapsed, this step proceeds to Step 61-2.

[Step 24-2]In Step 24-2, the image fixing roller 48-4 is forcibly cooled to the lower limit temperature T' for image fixing in Step 52-2. As the cooling means, not only the inner cylindrical member 57, but also a cooling fan can be employed.

When the temperature of the image fixing roller 48-4 has reached the lower limit temperature T' for image fixing, the routines in Step 22-2 to Step 25-2 are processed in the same manner as in Example 3-5.

Furthermore, in the same manner as in Example 3-5, natural cooling may be employed instead of Step 24-2. The phase transition to the amorphous state in Step 25-2 can be carried out at a temperature lower than the crystallization initiation temperature Tc, and it is not always necessary that the temperature be close to the crystallization initiation temperature Tc.

[Step 61-2]

In Step 61-2, there is detected whether or not there is any instruction during the counting by the timer 32. When there is an instruction during the counting by the timer 32, this step proceeds to Step 62-2, while when there is no instruction, this step is looped back to Step

[Step 62-2]

In Step 62-2, there is detected whether or not the temperature of the external peripheral surface of the image fixing roller 548-4 reaches the image fixing temperature range. When the temperature is within the range of the image fixing temperature range, this step proceeds to Step 65-2, when the temperature is not within the range of the image fixing temperature range, the phase transition layer 55 is subjected to the phase transition to the amorphous state by the routines in Step 22-2 to Step 25-2, and this step proceeds to Step 63-2.

[Step 63-2 and Step 64-2]

In Step 63-2, the phase transition layer 55 in the amorphous state is heated, and this step proceeds to Step 64-2. In Step 64-2, there is detected whether or not the temperature of the external peripheral surface of the image fixing roller 48-4 reaches the image fixing temperature by the heated phase transition layer 55. When the temperature does not reach the image fixing temperature, the heating is continued, and when the temperature reaches the image fixing temperature, this step proceeds to Step 65-2.

[Step 65-2]

In Step 65-2, when the image fixing roller 48-4 is in an image-fixing ready state in accordance with the detection result of Step 62-2, or the detection result of Step 64-2, the message that copy making operation is ready is displayed on the liquid crystal display panel 18 to convey this message to the operator or user.

EXAMPLE 3-7

Figure 34:
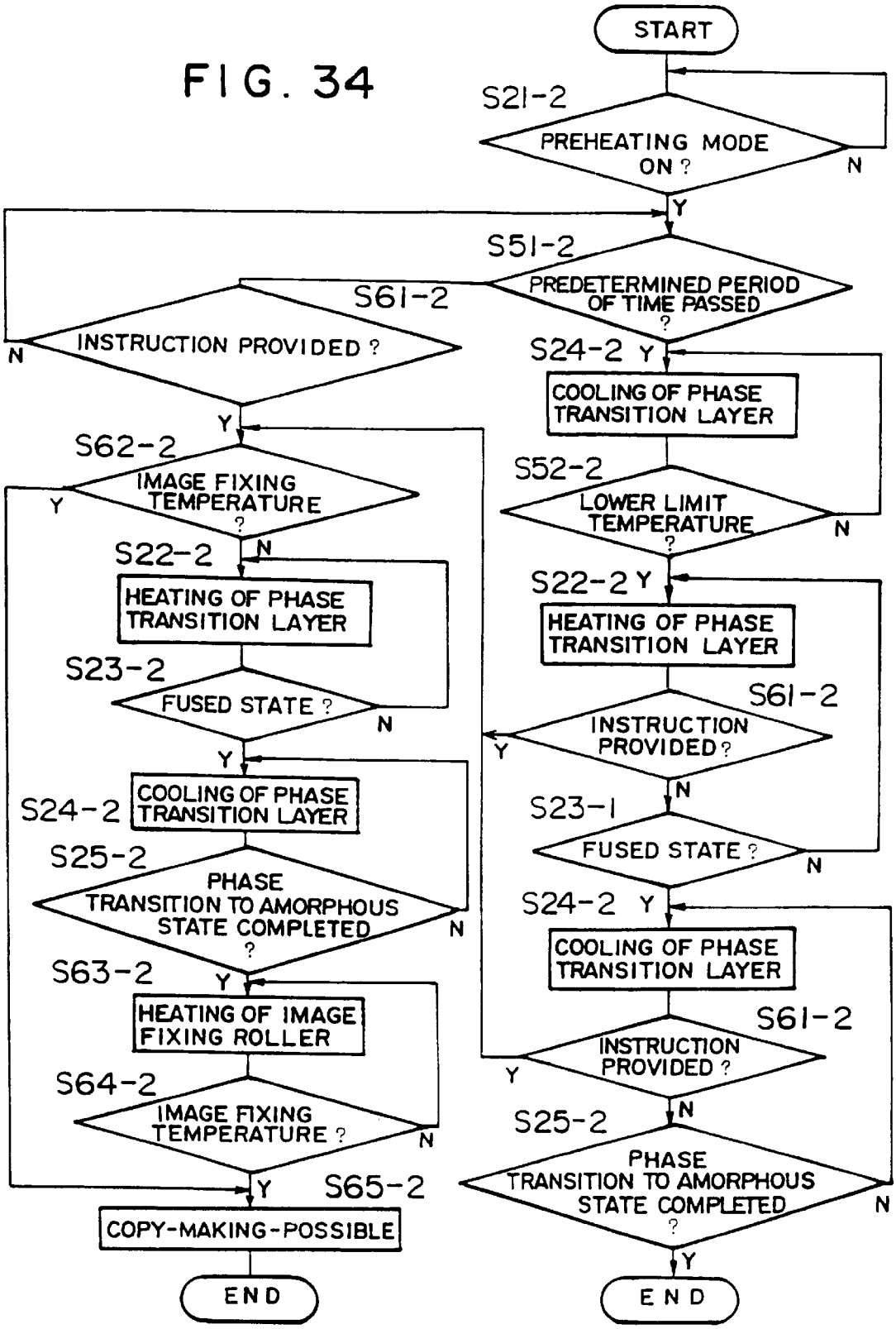
FIG. 34 is a flow chart of Example 3-7 of the present invention.

The operation of the image formation apparatus of the present invention in accordance with a flow chart of FIG. 34 is as follows on the supposition that the image formation apparatus is ready for making copies in accordance with the routine shown in FIG. 12.

In Example 3-7, Step 61-1 is interposed between Step 22-2 and Step 23-2, and also between Step 24-2 and Step 25-2 in Example 3-6, so that when some instruction is made during the heating or cooling of the phase transition layer 55, if the temperature of the external peripheral surface of the image fixing roller 48-4 reaches the image fixing temperature, copy making is made possible, while if the temperature does not reach the image fixing temperature, this step proceeds to Step 62-2 so that the temperature of the image fixing roller 48-4 is controlled so as to reach the image fixing temperature.

Figure 35:
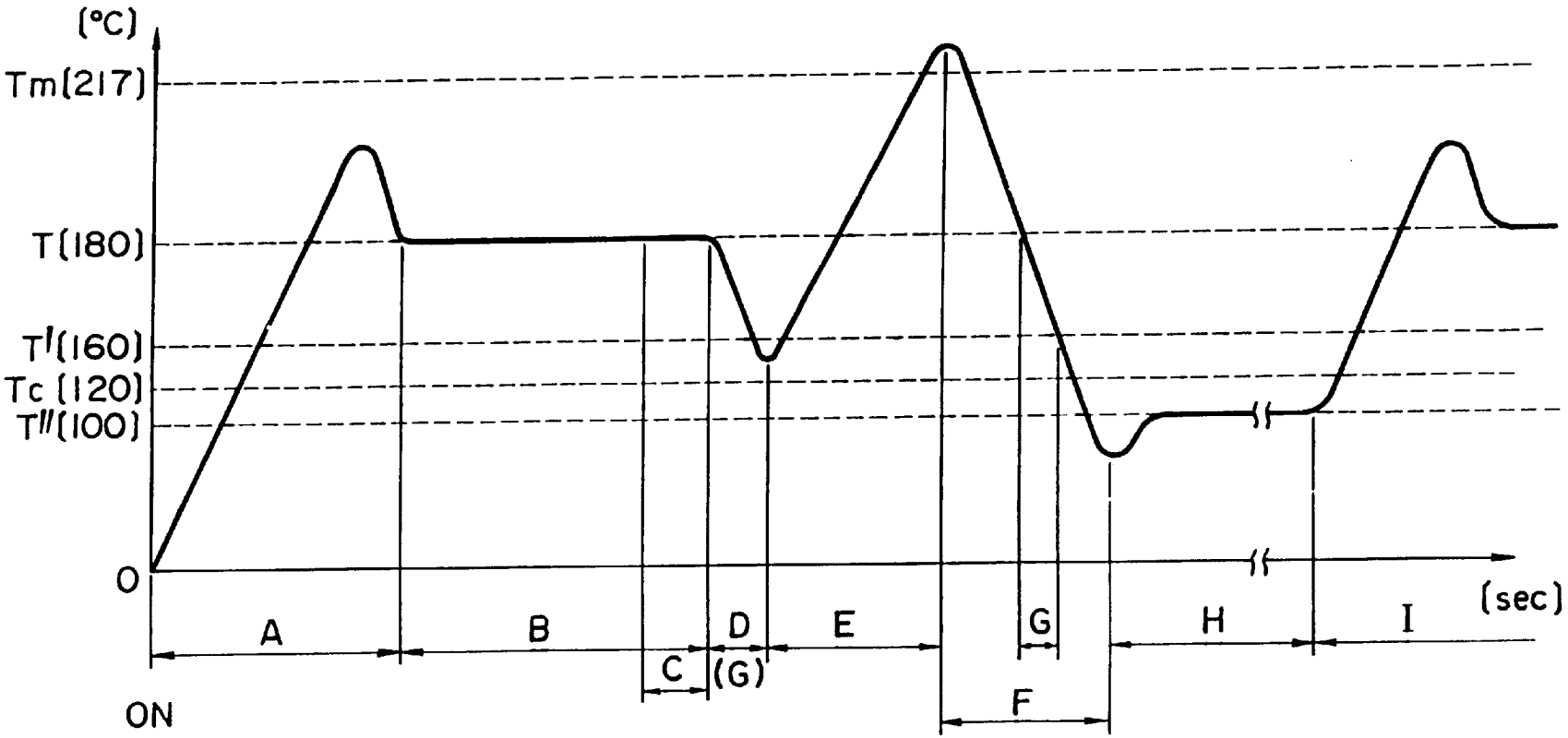
FIG. 35 is a graph showing the changes in the temperature of the external peripheral surface of the phase transition layer of the image fixing roller in Example 3-7 of the present invention.
Figure 36:
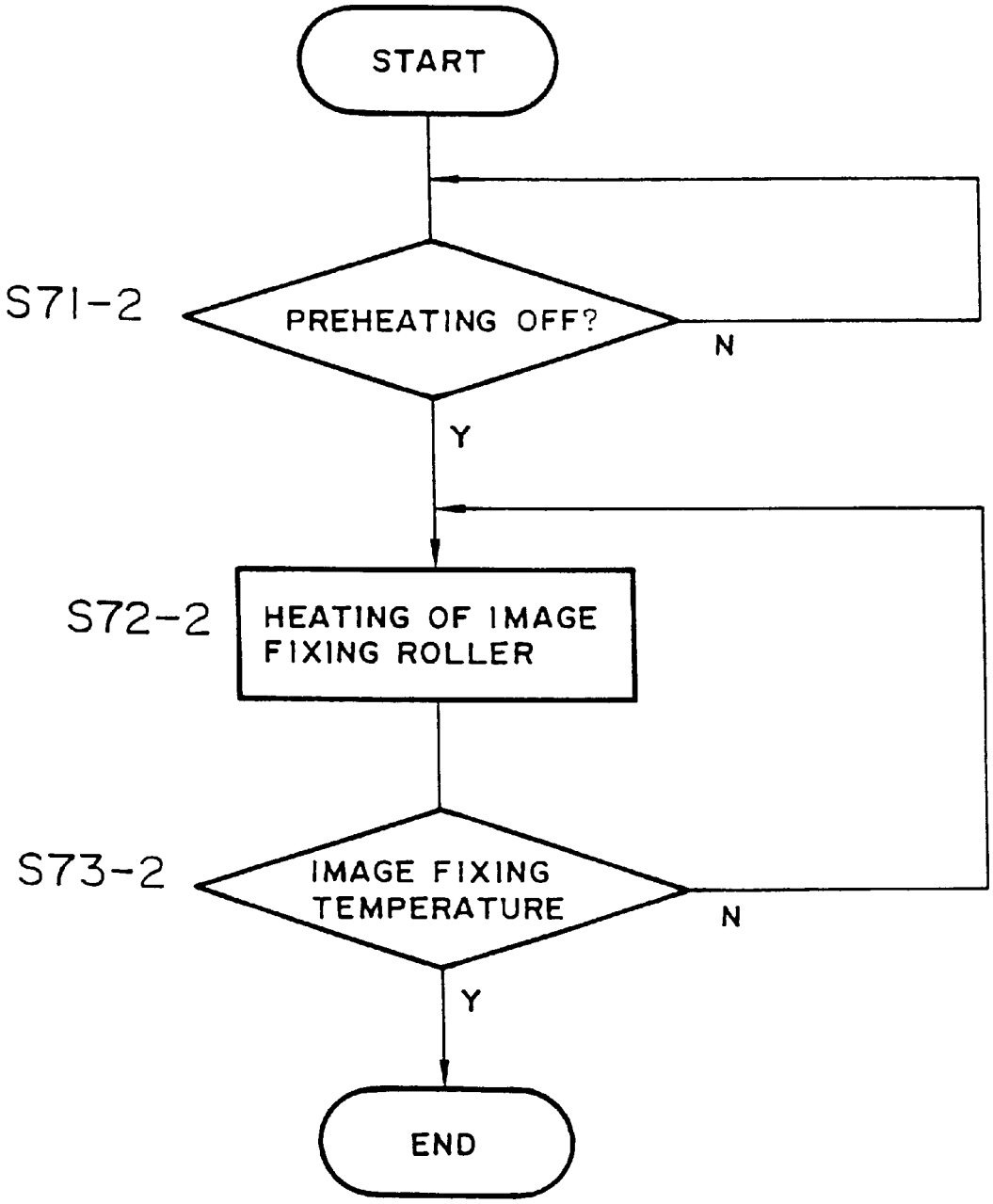
FIG. 36 is a flow chart of Example 3-8 of the present invention.

FIG. 35 shows the changes in the temperature of the external peripheral surface of the image fixing roller 48-4 in accordance with the series of routines in Example 3-7. A range A is a warm-up range for the image fixing roller 48-4 from Step 1 to Step 3 (refer to FIG. 12). Due to the phase transition in the range A, the crystallization heat is released. When the crystallization heat is released, generally the heating by the inner cylindrical member 57 may be stopped.

A range B is an image fixable range from Step 3 on. In the range B, image formation is performed. If the image fixing roller 48-4 is allowed to stand, the temperature of the external peripheral surface of the image fixing roller 48-4 decreases. Therefore, CPU 29 controls the inner cylindrical member 57 in such a manner that the temperature of the external peripheral surface of the image fixing roller 48-4 is maintained between the image fixing temperature and the lower limit temperature T' for image fixing.

A range C is the count range by the timer 32 in Step 51-2, which is within the range B. In Examples 3-1 to 3-4, in which the timer 32 is not provided, it is supposed that the preheating mode switch 19 is pressed at the end of the range C.

A range D is a margin or stand-by time range before starting the preheating operation after the completion of the count or the pressing of the preheating mode switch 19.

Both the range C and the range D may be made a stand-by time range. Alternatively, the range D may be made the stand-by time range instead of the range C, with the omission of the range C. Alternatively, the range C may be made the stand-by time range instead of the range D, with the omission of the range D. The provision of the range D serves to reduce the power consumption since the power supply to the inner cylindrical member 57 is stopped in the range D.

A range E is a heat application range based on Step 22-2. A range F is a cooling range based on Step 24-2 and Step 25-2, due to the temperature elevation up to at least the melting point Tm at the boundary between the range E and the range F.

A range G is an image fixable range under certain conditions in the range F.

A range H is a preheating range.

A range I is a second heating and image fixing range based on some operation conducted at the boundary between the range H and the range I.

The "certain conditions" in the range G means that the phase transition layer 55 is in a solid state, and that the phase transition thereof to the amorphous state is completed to some extent. As a material for use in the phase transition layer 55 that satisfies the abovementioned conditions, selenium is preferable.

EXAMPLE 3-8

The operation of the image formation apparatus of the present invention in accordance with a flow chart of FIG. 35 is as follows on the supposition that the preheating mode is carried out and the temperature of the external peripheral surface of the image fixing roller 48-4 reaches the preheating temperature T".

[Step 71-2]

In Step 71-2, there is detected whether or not the preheating mode is OFF. When the preheating mode is not OFF, the preheating mode is continued. In order to perform copy making operation with the cancellation of the preheating mode, the preheating mode is made OFF or some other operation instruction is made, so that this step proceeds to Step; 72-2.

[Step 72-2]

In Step 72-2, in accordance with the cancellation of the preheating mode, the heating of the phase transition layer 55 is initiated in order to set the image fixing roller 48-4 in an image fixable state, and this step proceeds to Step 73-2.

[Step 73-2]

In Step 73-2, there is detected whether or not the temperature of the external surface of the image fixing roller 48-4 reaches the image fixing temperature. When the temperature is below the image fixing temperature, the heating is continued until the temperature reaches the image fixing temperature.

When the preheating mode is ON, namely when the main switch 5 is OFF when the phase transition layer 55 is in the amorphous state, the amorphous state is maintained without the phase transition layer 55 being forcibly cooled or heated, with the power supply being stopped. Thus, the crystallization heat can be used in the next copy making operation.

Figure 41:
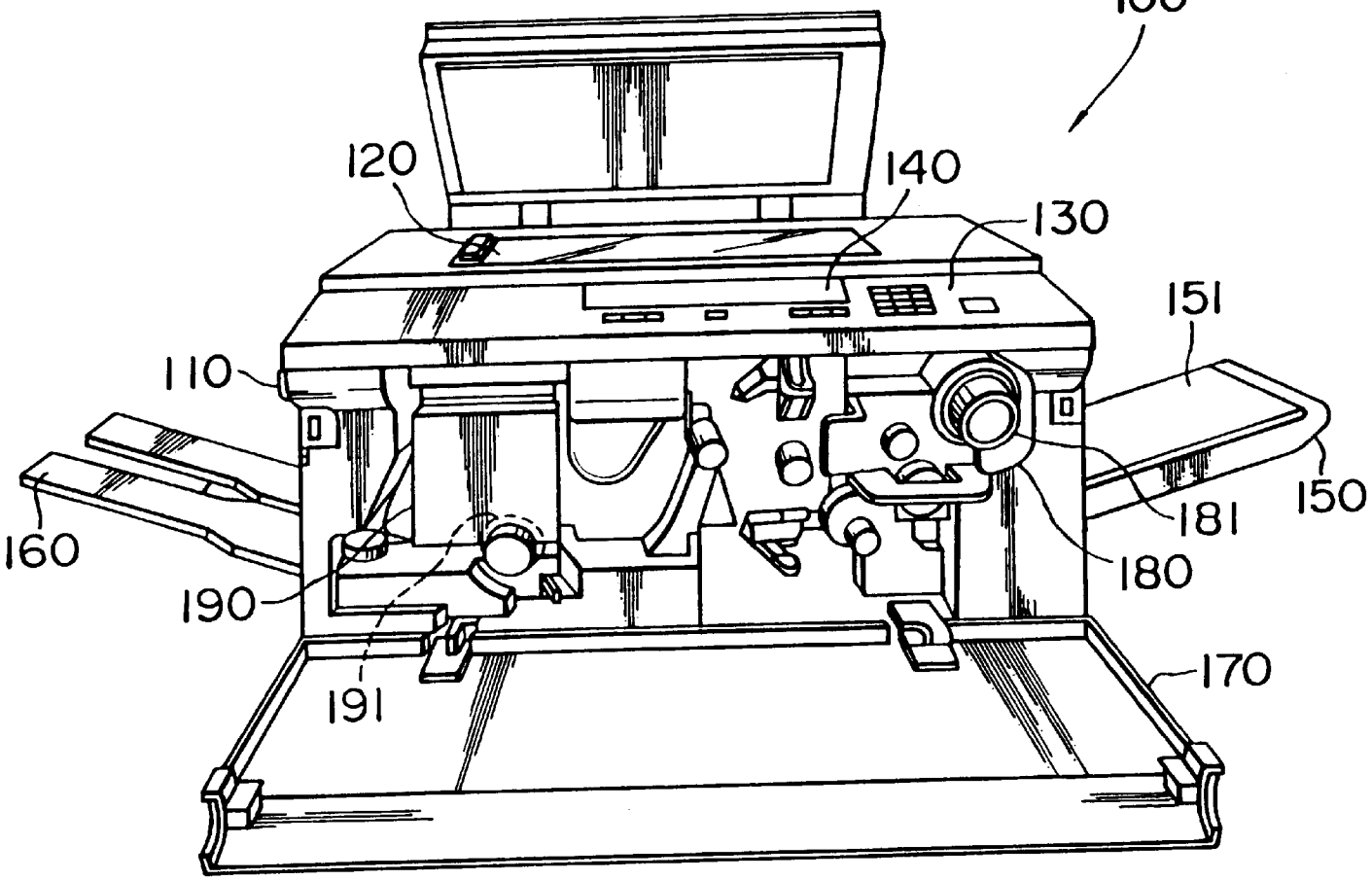
FIG. 41 is a perspective view of the image formation apparatus shown in FIG. 37.

In another image formation apparatus of the present invention as shown in FIG. 41, it is made possible to use the crystallization heat effectively even when paper jam or toner insufficiency takes place during the operation thereof, and the user takes necessary steps for attending to such problems.

Figure 37:
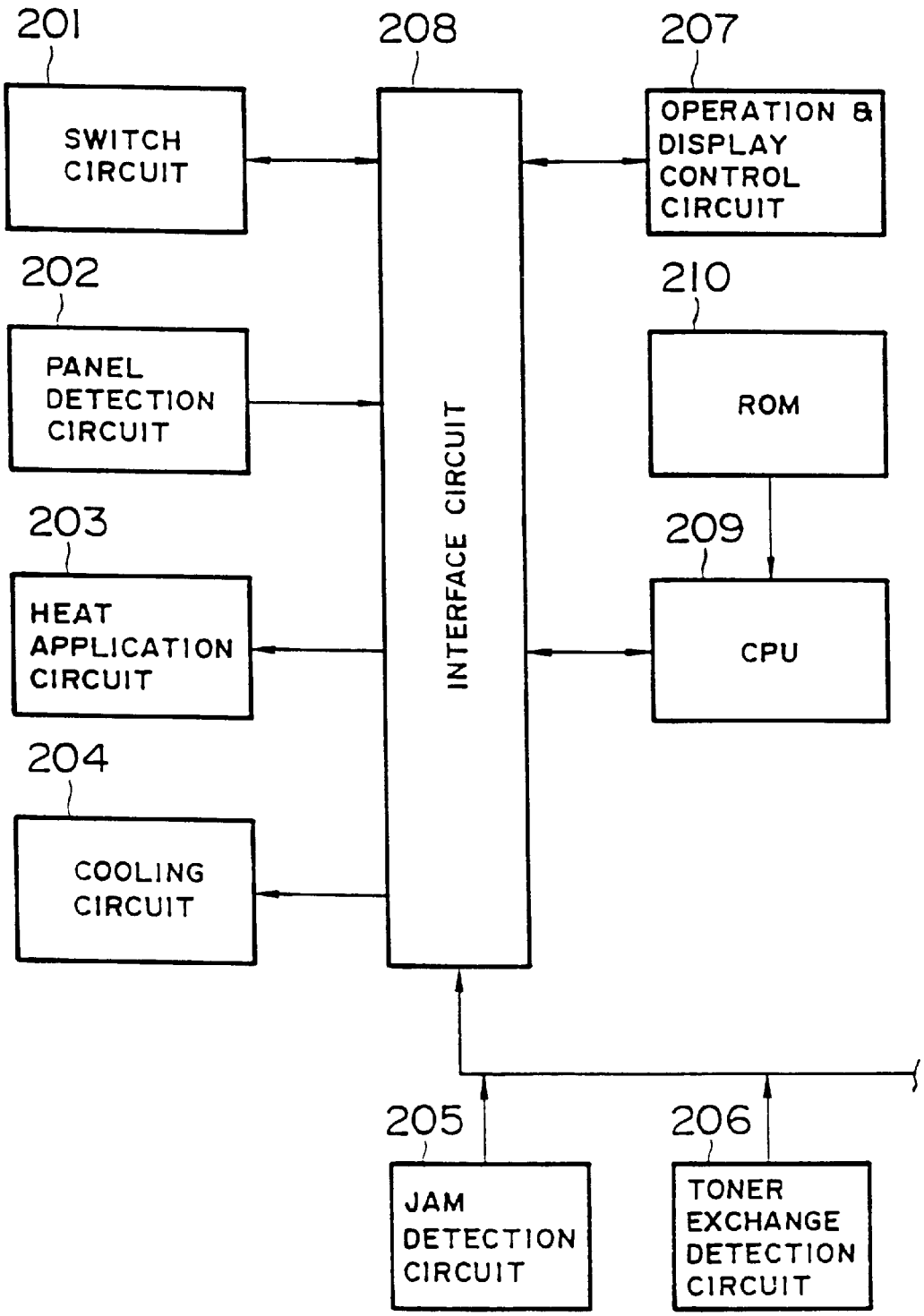
FIG. 37 is a block diagram of another example of the image formation apparatus of the present invention.

FIG. 37 is a block diagram of the above-mentioned image formation apparatus of the present invention. This system can also be applied to the image formation apparatus shown in FIG. 1.

The image formation apparatus 100 comprises a switch circuit 201, a panel detection circuit 202, a heat application circuit 203, a cooling circuit 204, a jam detection circuit 205, a toner exchange detection circuit 206, an operation & display circuit 207, an interface circuit 208, CPU (Central Processing Unit) 209, and ROM (Read Only Memory) 210.

The switch circuit 201 detects ON or OFF of a main switch 110 disposed on one side of the image formation apparatus 100. The switch circuit 201 sends a detection signal indicating ON or OFF of the main switch 110 to CPU 209 via the interface circuit 208.

When the main switch 110 is ON, the switch circuit 201 stops the power supply to the image formation apparatus 100, upon receiving a power-source OFF instruction signal from CPU 209 via the interface circuit 208.

With the main switch 110 being ON, when the switch circuit 201 receives the power-source OFF instruction signal from CPU 209 via the interface circuit 208, and then receives a power-source ON instruction, the switch circuit 201 resumes the power supply to the image formation apparatus 100.

The panel detection circuit 202 detects the opening or closing of a main body panel 170 of the image formation apparatus 100, and sends a detection signal indicating the opening or closing of the main body panel 170 to CPU 209 via the interface circuit 208.

Figure 43:
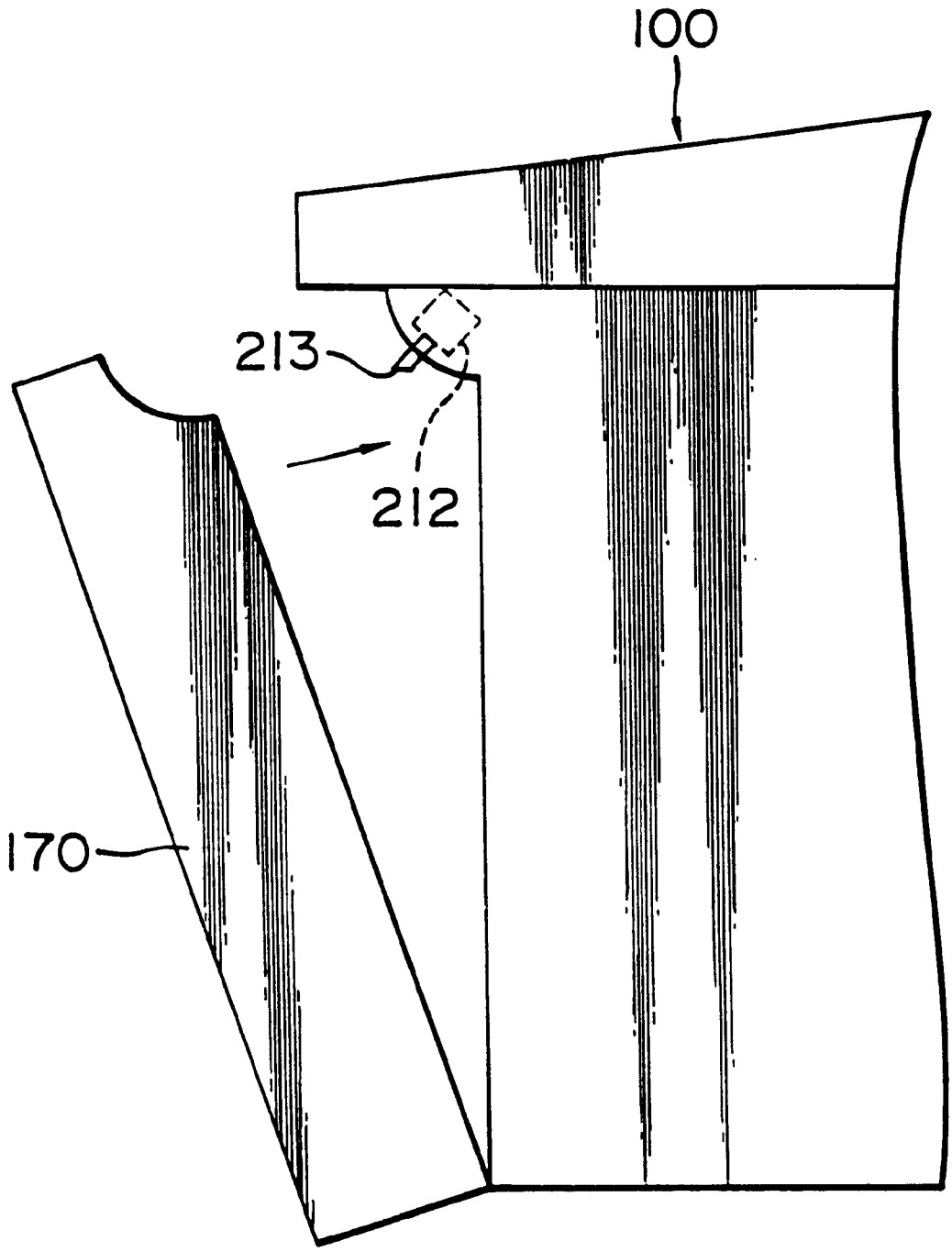
FIG. 43 is a schematic cross-sectional view of an example of a panel detection circuit.

As the panel detection circuit 202, for instance, a switch 212 can be used, which is disposed on the image formation apparatus 100 as shown in FIG. 43. When the main body panel 170 is closed, a press button 213 of the switch 212 is pressed by the panel 170. The panel detection circuit 202 outputs a detection signal which is generated when the switch 212 is ON by the press button 213 being pressed.

As the panel detection circuit 202, a panel detection circuit comprising a piezo-electric element instead of the switch 212 may be employed. In this case, when the main body panel 170 is closed, pressure is applied to the piezo-electric element by the main body panel 170, so that the piezo-electric elements generates a voltage. When the main body panel 170 is opened, the piezo-electric element generates no voltage since no pressure is applied thereto. Thus, in the panel detection circuit 202, the generation or no generation of the voltage is used as the detection signal.

Figure 42:
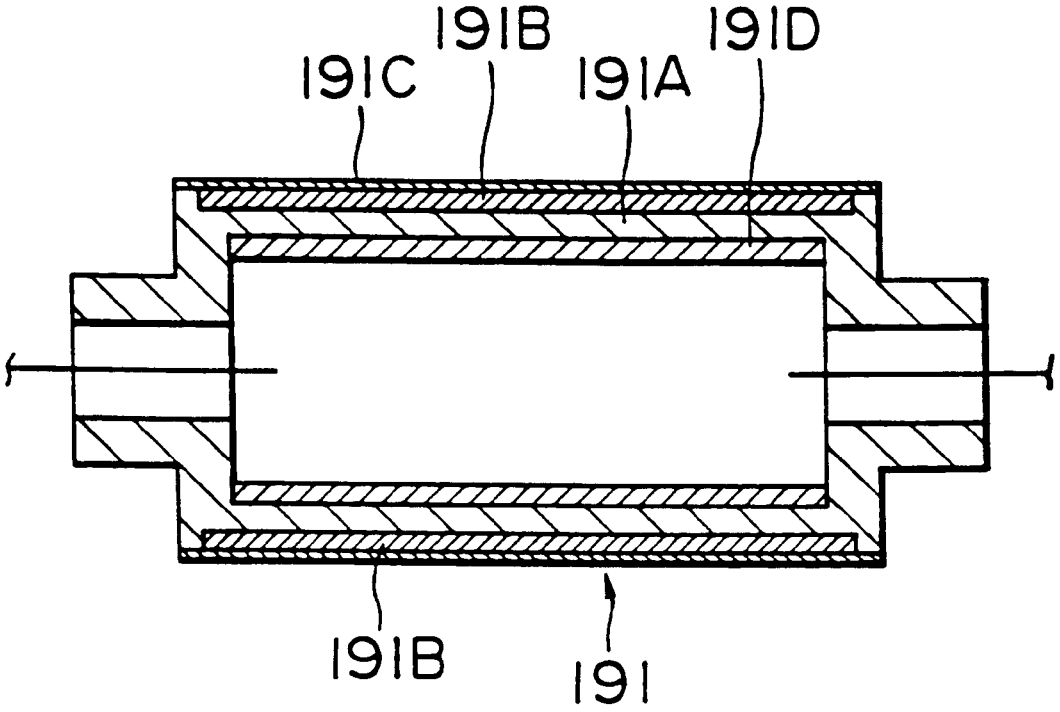
FIG. 42 is a cross-sectional view of an image fixing roller for use in the image formation apparatus shown in FIG. 37.

The heat application circuit 203 supplies a large amount of power to a heater 191D within an image fixing roller 191 shown in FIG. 42, upon receiving a heat application signal for fusing a phase transition layer 191B of the image fixing roller 191 from CPU 209 via the interface circuit 208, so that the image fixing roller 191 is heated and accordingly the phase transition layer 191B is fused.

In FIG. 42, reference number 191A indicates a core metal of the image fixing roller 191; reference numeral 191B indicates a phase transition layer; and reference numeral 191C indicates a protective layer for the phase transition layer 191B.

The heat application circuit 203 supplies power to a heater 191D within the image fixing roller 191, upon receiving a heat application signal for heating the image fixing roller 191 from CPU 209 via the interface circuit 208, so that the image fixing roller 191 is heated to the image fixing temperature.

The cooling circuit 204 activates cooling means such as a fan disposed in an image fixing unit 190 in order to forcibly cool the image fixing roller 191, upon receiving a cooing signal from CPU 209 via the interface circuit 208, after the phase transition layer 191B is heated to its melting point or higher due to the power supply to the heater 191D by the heat application circuit 203.

When the phase transition layer 191B is heated to its melting pint or higher due to the power supply to the heater 191D by the heat application circuit 203, and then the heat application circuit 203 stops the power supply, the image fixing roller 191 is gradually cooled, so that the phase transition layer 191B is subjected to the phase transition to the amorphous state.

The jam detection circuit 205 detects paper jam which takes place during the copy making operation. The jam detection circuit 205, when detecting the paper jam, sends a detection signal indicating the paper jam to CPU 209 via the interface circuit 208.

The toner exchange detection circuit 206 detects the running out of toner in a toner bottle 181. When the running out of toner is detected by the toner exchange detection circuit 206, the toner exchange detection circuit 206 sends a detection signal indicating the running out of toner to CPU 208 via the interface circuit 208.

When an operation section 130 is operated for making copies, the operation & display circuit 207 sends an operation signal relating to the above operation to CPU 209 via the interface circuit 208.

The operation & display circuit 207, when receiving various display signals relating to the copy making operation from CPU 209 from the interface circuit 208, displays such information in a display section 140. The information displayed in the display section 140 by the operation & display circuit 207 includes the information concerning toner replenishment, paper jam, and the necessity for inspection by a service engineer.

The interface circuit 208 connects the switch circuit 101 and CPU 209, the panel detection circuit 202 and CUP 209, the cooling circuit 204 and CPU 209, the jam detection circuit 205 and CPU 209, the toner exchange circuit 206 and CPU 209, and the operation & display circuit 207 and CPU 209, respectively.

Figure 38:
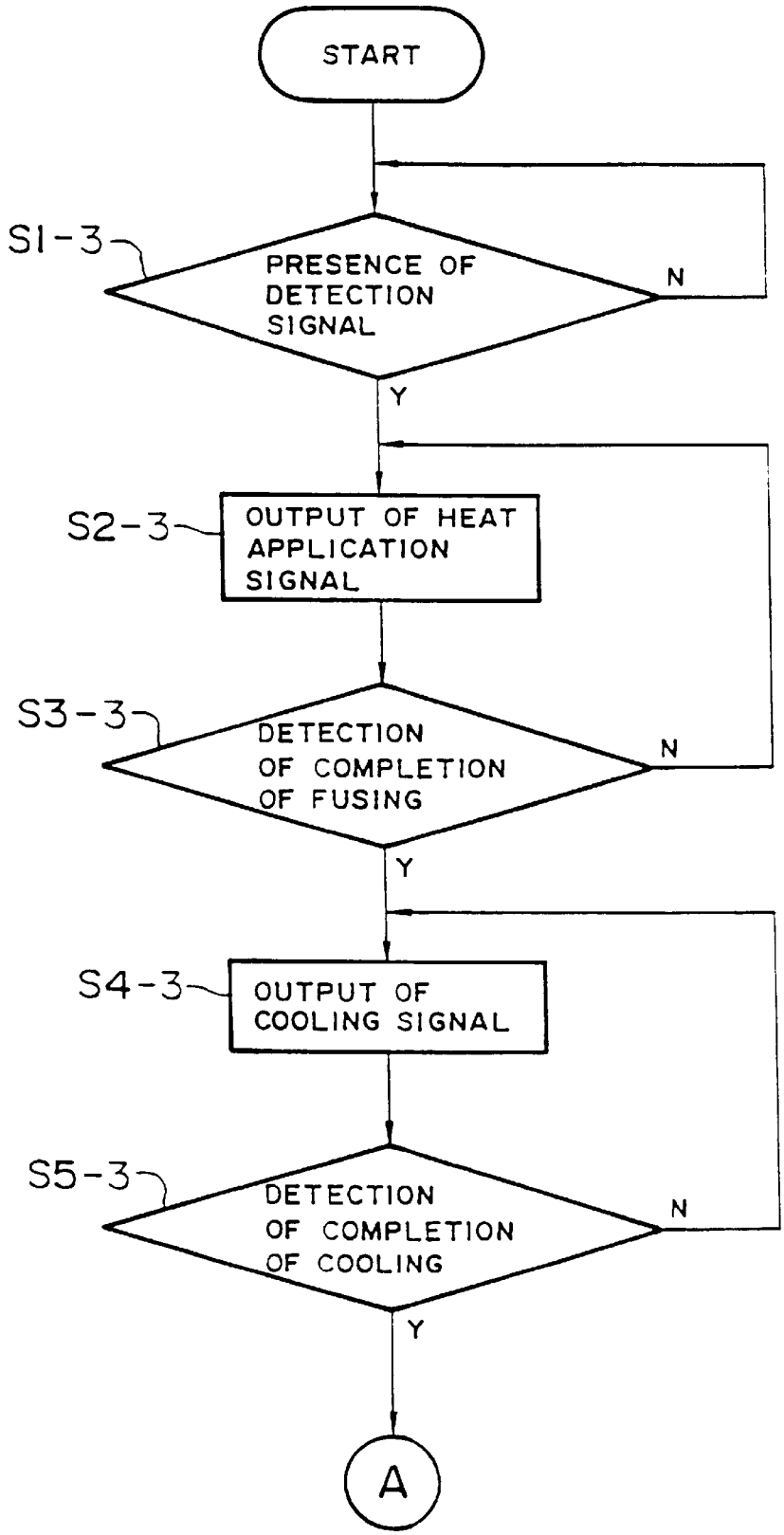
FIG. 38 is a flow chart of the control of the image formation apparatus shown in FIG. 37, using CPU.
Figure 39:
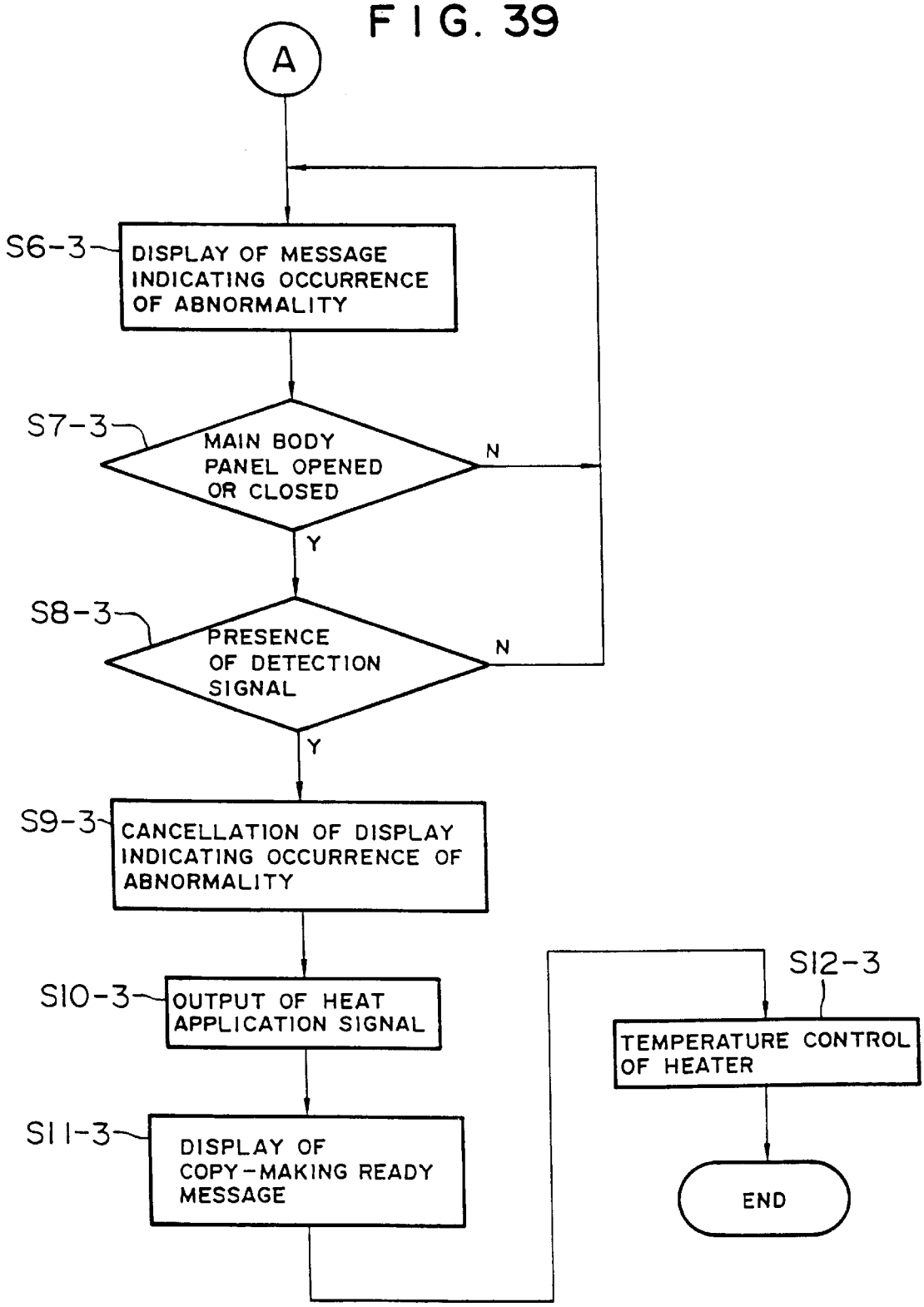
FIG. 39 is a flow chart of the control of the image formation apparatus shown in FIG. 37, using CPU.

CPU 209 performs the controls as shown in FIG. 38 and FIG. 39, based on the detection signals from the panel detection circuit 202, the jam detection circuit 205 and the toner exchange detection circuit 206. More specifically, CPU 209 always checks the presence or absence of the detection signals from the jam detection circuit 205 and the toner exchange detection circuit 206 (Step S1-3). In the absence of the detection signals from the jam detection circuit 205 and the toner exchange detection circuit 206, CPU 209 repeats the processing in Step S1-3.

When CPU 209 receives a detection signal from at least one of the jam detection circuit 205 or the toner exchange detection circuit 206 in Step S1-3, CPU 209 sends a heating signal for fusing the phase transition layer 191B of the image fixing roller 191 to the heat application circuit 203 (Step S2-3).

After Step S2-3, CPU 209 counts the time. When the counted time amounts to a predetermined value, the completion of the fusing of the phase transition layer 191B of the image fixing roller 191 is detected (Step S3-3). When the fusing is not completed in Step S3-3, CPU 209 returns the process to Step S2-3.

CPU 209, when detecting the completion of the fusing in Step S3-3, sends a cooling signal for cooling the phase transition layer 191B of the image fixing roller 191 to the cooling circuit 204 (Step S4-3).

After Step S4-3, CPU 209 counts the time. When the counted time amounts to a predetermined value, the completion of the cooling of the phase transition layer 191B of the image fixing roller 191 is detected (Step S5-3). The completion of the cooling can be detected by measuring the temperature of the phase transition layer 191B of the image fixing roller 191.

When the cooling is not completed in Step S5-3, CPU 209 returns the process to Step S4-3.

CPU 209, when detecting the completion of the cooling in Step S5-3, sends a display signal indicating the occurrence of a problem to the operation & display circuit 207, in accordance with the detection signal received in Step S1-3 (Step S6-3). For example, when CPU 209 receives a signal from the jam detection circuit 205, CPU 209 sends a display play signal indicating the miss-feed or paper jam to the operation & display circuit 207, and when CPU 209 receives a signal from the toner exchange detection circuit 206, CPU 209 sends a signal indicating the toner replenishment to the operation & display circuit 207.

After Step S6-3, CPU 209 checks whether or not the user who looks at the display in Step S6-3 opens the main body panel 170, based on the detection signal from the panel detection circuit 202 (Step S7-3). In the absence of the detection signal from the panel detection circuit 202 (Step S7-3), CPU 209 returns the process to Step S6-3.

After the opening or closing of the main body panel 170 is detected in Step S7-3, CPU 209 also checks the presence or absence of a detection signal from the jam detection circuit 205 or from the toner exchange detection circuit 206 (Step S8-3).

In the absence of the detection signal from the jam detection circuit 205 or from the toner exchange detection circuit 206 in Step S8-3, CPU 209 judges that the problem or abnormality is canceled, so that the display of the message in Step S6-3 is canceled (Step S9-3).

In the presence of the detection signal from the jam detection circuit 205 or from the toner exchange detection circuit 206 in Step 58-3, CPU 209 judges that the problem or abnormality is not canceled, and returns the process to Step S6-3.

After Step S9-3, CPU 209 sends a heat application signal for heating the image fixing roller 191 to the image fixing temperature to the heat application circuit 203 (Step S10-3). Thereafter, CPU 209 sends a display signal indicating the message that copy making is ready to the operation & display circuit 207 (Step S11-3).

After Step S11-3, CPU 209 sends a heat application signal for maintaining the image fixing roller 191 at the image fixing temperature to the heat application circuit 203 (Step S12-3).

Figure 40:
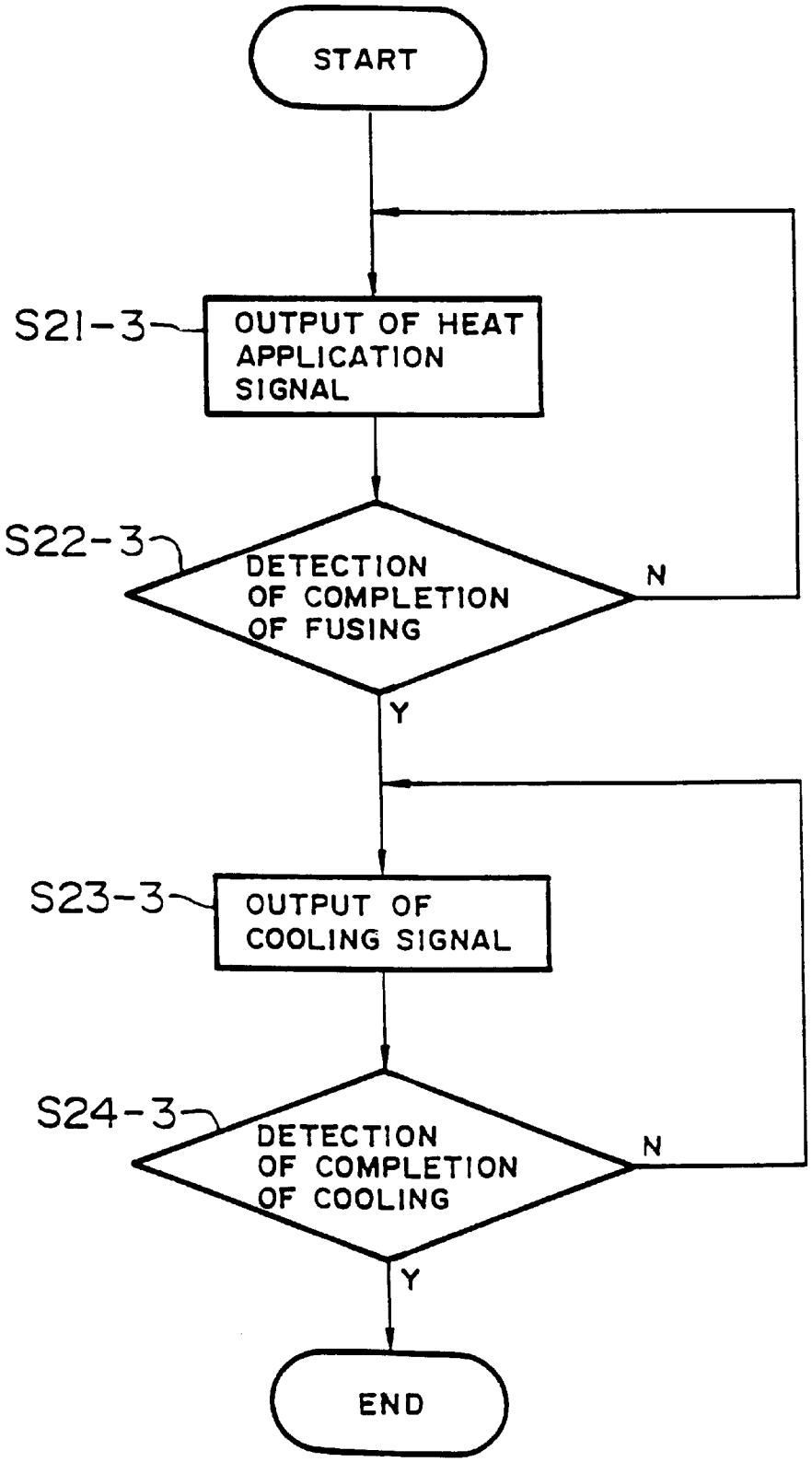
FIG. 40 is a flow chart of the control of the image formation apparatus shown in FIG. 37, using CPU.

CPU 209 performs the following controls, in addition to the controls in the above-mentioned Step S1-3 to Step S12-3. Namely, CPU 209 performs the processes from Step S21-3 to Step S24-3 shown in FIG. 40, when the main switch 110 is OFF. These processes are the same as in Step S2-3 to Step S5-3. By these processes, when the main switch 110 is turned OFF, the heating, fusing and cooling of the phase transition layer 191B of the image fixing roller 191 are performed, so that the phase transition layer 191B is subjected to the phase transition to the amorphous state. This is carried out in order to warm up the image fixing roller 191 to the image fixing temperature very quickly, by utilizing the crystallization heat released from the phase transition layer 191B.

The main switch 110 has a delay function. To be more specific, when the user turns OFF the main switch 110, the main switch 110 stops power supply to the image formation apparatus 100 after a predetermined delay time. CPU 209 performs the processes in Step S21-3 to S24-3 during this delay time.

CPU 209 sends a power-source OFF instruction signal to the switch circuit 201 upon receiving a detection signal indicating the opening of the main body panel 170 from the panel detection circuit 202 after the main switch 110 is turned ON. Furthermore, CPU 209 sets the temperature of the image fixing roller 191 at the image fixing temperature after the main switch 110 is turned ON, and thereafter maintains the temperature of the image fixing roller at the image fixing temperature by sending a heat application signal to maintain the image fixing temperature to the heat application circuit 203.

ROM 210 stores the procedures relating to the various controls conducted by CPU 209.

An example of the actual operation will now be explained.

When the user turns ON the main switch 110, the switch circuit 101 sends an ON detection signal to CPU 209 via the interface circuit 208.

CPU 209, upon receiving the detection signal from the switch circuit 201, sends a heat application signal for heating the image fixing roller 191 to the heat application circuit 203, whereby the temperature of the image fixing roller 191 can be increased to the image fixing temperature in a short time by utilizing the crystallization heat released from the phase transition layer 191B of the image fixing roller 191. Thereafter, CPU 209 controls the temperature of the image fixing roller 191 by normal heating, using the heater 191D, so as to maintain the image fixing temperature.

When the user turns OFF the main switch 110, since the main switch 110 has the above-mentioned delay function, the power supply to the image formation apparatus 100 is stopped after the delay time. During this delay time, CPU 209 carries out the processes in Step S21-3 to Step S24-3, whereby the phase transition layer 191B of the image fixing roller 191 is subjected to the phase transition to the amorphous state. As a result, at the next copy making operation, the warm-up of the image fixing roller 191 can be achieved in a short time by utilizing the crystallization heat released from the phase transition layer 191B.

When the image formation apparatus is in the image-fixing ready state, if paper jam occurs or toner runs out, the jam detection circuit 205 or the toner exchange detection circuit 206 detects this and send the detection signal to CPU 209 via the interface circuit 208.

When CPU 209 receives the detection signal from the jam detection circuit 205 or from the toner exchange detection circuit 206 in Step S1-3, CPU performs the processes in Step S2-3 to Step S5-3. More specifically, CPU 209 performs the heating, fusing and cooling of the phase transition layer 191B of the image fixing roller 191, so that the phase transition of the phase transition layer 191B to the amorphous state is carried out. Thereafter, CPU 209 performs the process in Step S6-3, and sends a display signal indicating the miss feeding or toner replenishment, if any, to the operation & display circuit 207.

The user, looking at the message indicating the paper jam or the shortage of toner, will open the main body panel 170, and cope with such a problem.

At this moment, the panel detection circuit 202 detects the opening or closing of the main body panel 170. The panel detection circuit 202, upon detecting the opening of the main body panel 170, sends the detection signal indicating the opening of the main body panel 170 to CPU 209.

When CPU 209 receives the detection signal, CPU 209 sends a power source OFF instruction signal to the switch circuit 201. The switch circuit 201, upon receiving this power source OFF instruction signal, stops the power supply to the image formation apparatus 100.

When the user closes the main body panel 170, the panel detection circuit 202 sends a detection signal indicating the closing of the main body panel 170 to CPU 209. When CPU 209 receives this detection signal, CPU 209 sends a power source ON instruction signal to the switch circuit 101. The switch circuit 101, upon receiving this power source ON instruction signal, resumes the power supply to the image formation apparatus 100.

When the user removes the paper jam or replenishes the toner, the jam detection circuit 205 and the toner exchange detection circuit 206 no longer output the respective detection signals. In the meantime, CPU 209 performs the process in Step S6-3, and then the processes in Step S7-3 and Step S8-3, whereby CPU 209 checks whether or not the abnormality has been removed by detecting the presence or absence of the detection signal from the jam detection circuit 205 or from the toner exchange detection circuit 206. When the abnormality is removed, CPU 209 cancels the display of the message in Step S6-3 by performing the process in Step S9-3.

CPU 209 sends a heat application signal to the heat application circuit 203 in order to set the image fixing roller 191 in an image fixable state by the process in Step S10-3. At this heating, since the image fixing roller 191 is in the amorphous state by the processes in Step S2-3 to Step S5-3, the image fixing roller 191 can be warmed up in a short time by utilizing the crystallization heat released from the phase transition layer 191B when used again thereafter.

After the temperature of the image fixing roller 191 is increased to the image fixing temperature by utilizing the crystallization heat, CPU 209 causes the operation & display circuit 207 to display the message indicating that the copy making can be done by the process in Step S11-3. CPU 209 maintains the image fixing roller 191 at the temperature where image fixing can be done by Step S12-3.

In the above-mentioned example, even if the paper jam takes place or the toner runs out, and the temperature of the image fixing roller 191 becomes lower than the image fixing temperature while the user removes the jammed paper or replenishes the toner, the image fixing roller 191 can be heated by utilizing the crystallization heat. Therefore, the image fixing roller 191 can be set in the image fixable state in a short time.

Figure 44:
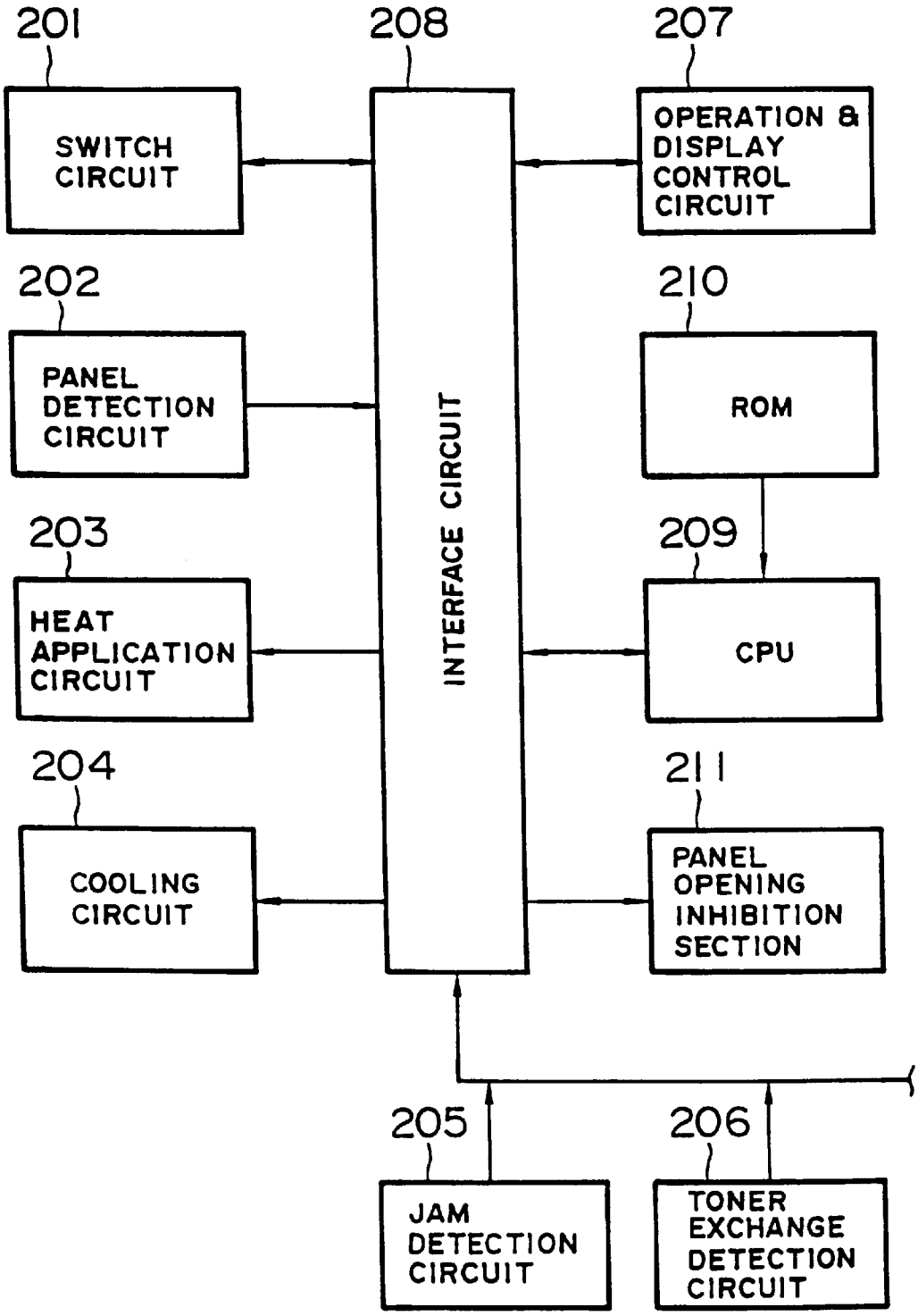
FIG. 44 is a block diagram of a further example of the image formation apparatus of the present invention.

FIG. 44 is a block diagram of another image formation apparatus 100-1 of the present invention for making it possible to use the crystallization heat effectively, even when paper jam or toner insufficiency takes place during the operation thereof and the user attends to such problems. This image formation apparatus 100-1 can also be applied to the copying machine as illustrated in FIG. 41.

The image formation apparatus 100-1 comprises a switch circuit 201, a panel detection circuit 202, a heat application circuit 203, a cooling circuit 204, a jam detection circuit 205, a toner exchange detection circuit 206, an operation & display circuit 207, an interface circuit 208, CPU (Central Processing Unit) 209, ROM (Read Only Memory) 210, and a panel opening prohibition section 211.

The switch circuit 201 detects ON or OFF of a main switch 110 disposed on one side of the image formation apparatus. The switch circuit 201 sends a detection signal indicating ON or OFF of the main switch 110 to CPU 209 via the interface circuit 208.

When the main switch 110 is ON, the switch circuit 201 stops the power supply to the image formation apparatus 100-1, upon receiving a power-source OFF instruction signal from CPU 209 via the interface circuit 208.

With the main switch 110 being ON, when the switch circuit 201 receives the power-source OFF instruction signal from CPU 209 via the interface circuit 208, and then receives a power-source ON instruction signal, the switch circuit 201 resumes the power supply to the image formation apparatus 100-1.

The panel detection circuit 202 detects the opening or closing of a main body panel 170 of the image formation apparatus 100-1, and sends a detection signal indicating the opening or closing of the main body panel 170 to CPU 209 via the interface circuit 208.

Figure 49:
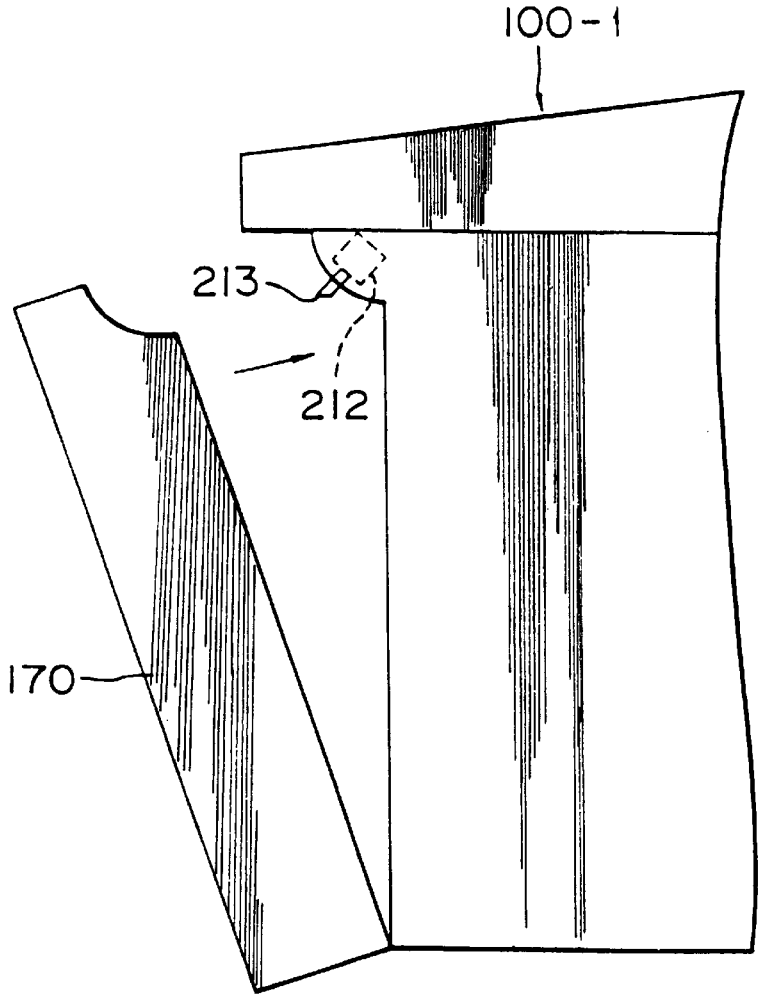
FIG. 49 is a schematic cross-sectional view of an example of a panel detection circuit for use in the image formation apparatus.

As the panel detection circuit 202, for instance, a switch 212 can be used, which is disposed on the image formation apparatus 100-1 as shown in FIG. 49. When the main body panel 170 is closed, a press button 213 of the switch 212 is pressed by the panel 170. The panel detection circuit 202 outputs a detection signal which is generated when the switch 212 is ON by the press button 213 being pressed.

As the panel detection circuit 202, a panel detection circuit comprising a piezo-electric element instead of the switch 212 may be employed. In this case, when the main body panel 170 is closed, pressure is applied to the piezo-electric element by the main body panel 170, so that the piezo-electric elements generates a voltage. When the main body panel 170 is opened, the piezo-electric element generates no voltage since no pressure is applied thereto. Thus, in the panel detection circuit 202, the generation or no generation of the voltage is used as the detection signal.

Figure 50:
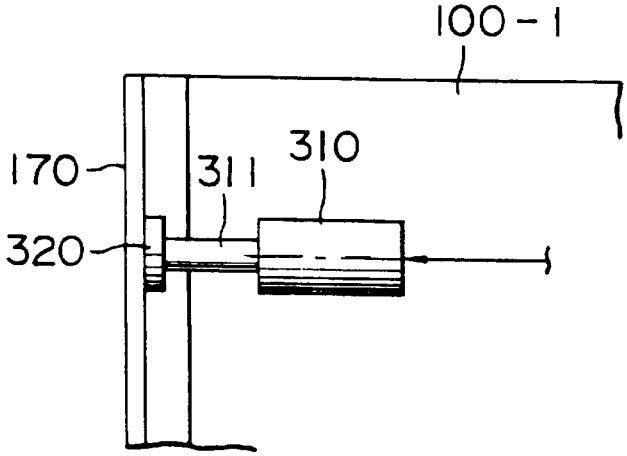
FIG. 50 is a partial plan view of an example of a panel opening prohibition section.

The panel opening prohibition section 211 comprises a solenoid 310 and an iron plate 320 as illustrated in FIG. 50.

The solenoid 310 is provided on the image formation apparatus 100-1. Reference numeral 311 indicates an attracting portion of the solenoid 310. The iron plate 320 is attached to the main body panel 170, so that when the main body panel 170 is closed, the iron plate 320 faces the attracting portion 311.

Figure 51:
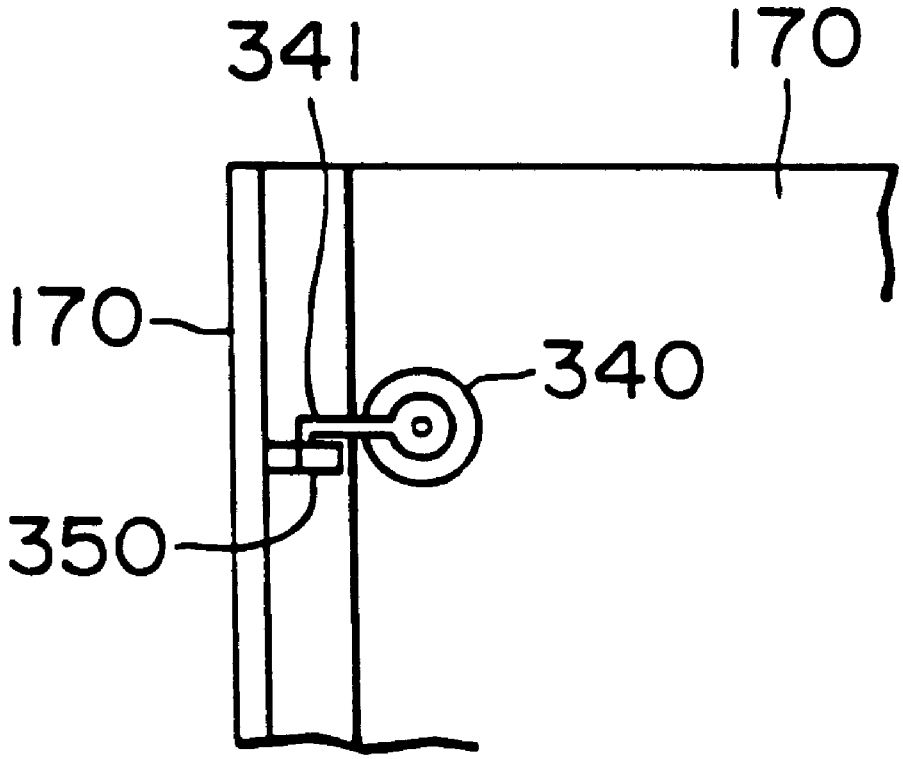
FIG. 51 is a partial plan view of another example of a panel opening prohibition section.

The panel opening prohibition section 211 may also have such a structure as illustrated in FIG. 51, which is composed of a motor 340, a lock member 341 and a hook 350. The main body panel 170 is provided with an auxiliary iron plate, and an auxiliary permanent magnet is provided to the image formation apparatus 100-1 in such a position so as to face the auxiliary iron plate, whereby even if the prohibition of the closing of the main body panel 170 is canceled, the main body panel 170 cannot be opened freely.

The heat application circuit 203 supplies a large amount of power to the heater 191D within the image fixing roller 191 shown in FIG. 42, upon receiving a heat application signal for fusing the phase transition layer 191B of the image fixing roller 191 from CPU 209 via the interface circuit 208, so that the image fixing roller 191 is heated and accordingly the phase transition layer 191B of is fused.

The heat application circuit 203 supplies power to the heater 191D within the image fixing roller 191, upon receiving a heat application signal for heating the image fixing roller 191 from CPU 209 via the interface circuit 208, so that the image fixing roller 191 is heated to the image fixing temperature.

The cooling circuit 204 activates cooling means such as a fan disposed in an image fixing unit 190 in order to forcibly cool the image fixing roller 191, upon receiving a cooing signal from CPU 209 via the interface circuit 208, after the phase transition layer 191B is heated to its melting point or higher due to the power supply to the heater 191D by the heat application circuit 203.

When the phase transition layer 191B is heated to its melting pint or higher due to the power supply to the heater 191D by the heat application circuit 203, and then the heat application circuit 203 stops the power supply, the image fixing roller 191 is gradually cooled, so that the phase transition layer 191B is subjected to the phase transition to the amorphous state.

The jam detection circuit 205 detects paper jam which takes place during the copy making operation. The jam detection circuit 205, when detecting paper jam, sends a detection signal indicating the paper jam to CPU 209 via the interface circuit 208.

The toner exchange detection circuit 206 detects the shortage or running out of toner in a toner bottle 181. When the running out of toner is detected by the toner exchange detection circuit 206, the toner exchange detection circuit 206 sends a detection signal indicating the running out of toner to CPU 208 via the interface circuit 208.

When an operation section 130 is operated for making copies, the operation & display circuit 207 sends an operation signal relating to the above operation to CPU 209 via the interface circuit 208.

The operation & display circuit 207, when receiving various display signals relating to the copy making operation from CPU 209 from the interface circuit 208, displays such information in a display section 140. The information displayed in the display section 140 by the operation & display circuit 207 includes the information concerning toner replenishment, paper jam, and the necessity for inspection by a service engineer.

The interface circuit 208 connects the switch circuit 101 and CPU 209, the panel detection circuit 202 and CUP 209, the cooling circuit 204 and CPU 209, the jam detection circuit 205 and CPU 209, the toner exchange circuit 206 and CPU 209, and the operation & display circuit 207 and CPU 209, respectively.

Figure 45:
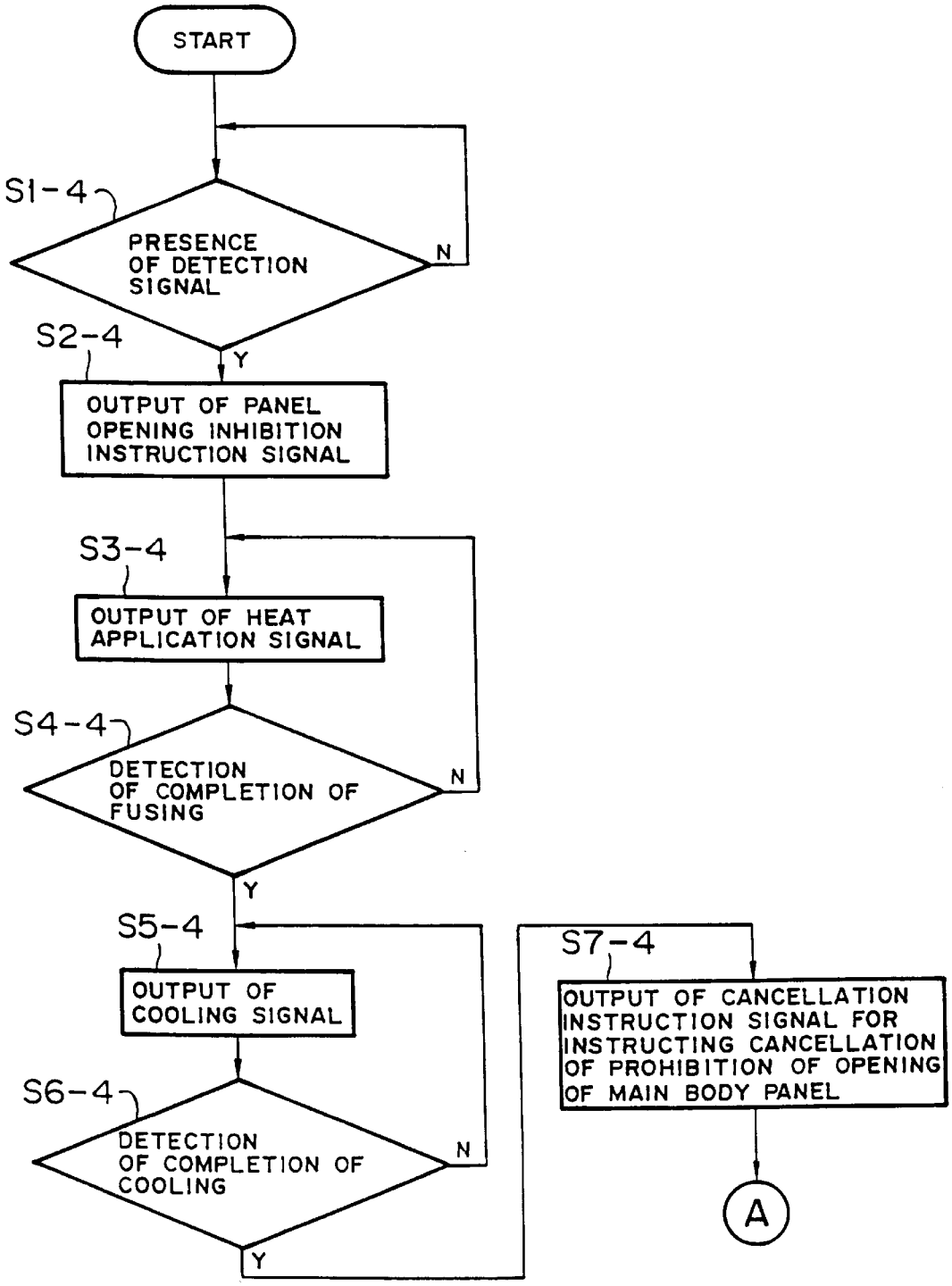
FIG. 45 is a flow chart of the control of the image formation apparatus, using CPU.
Figure 46:
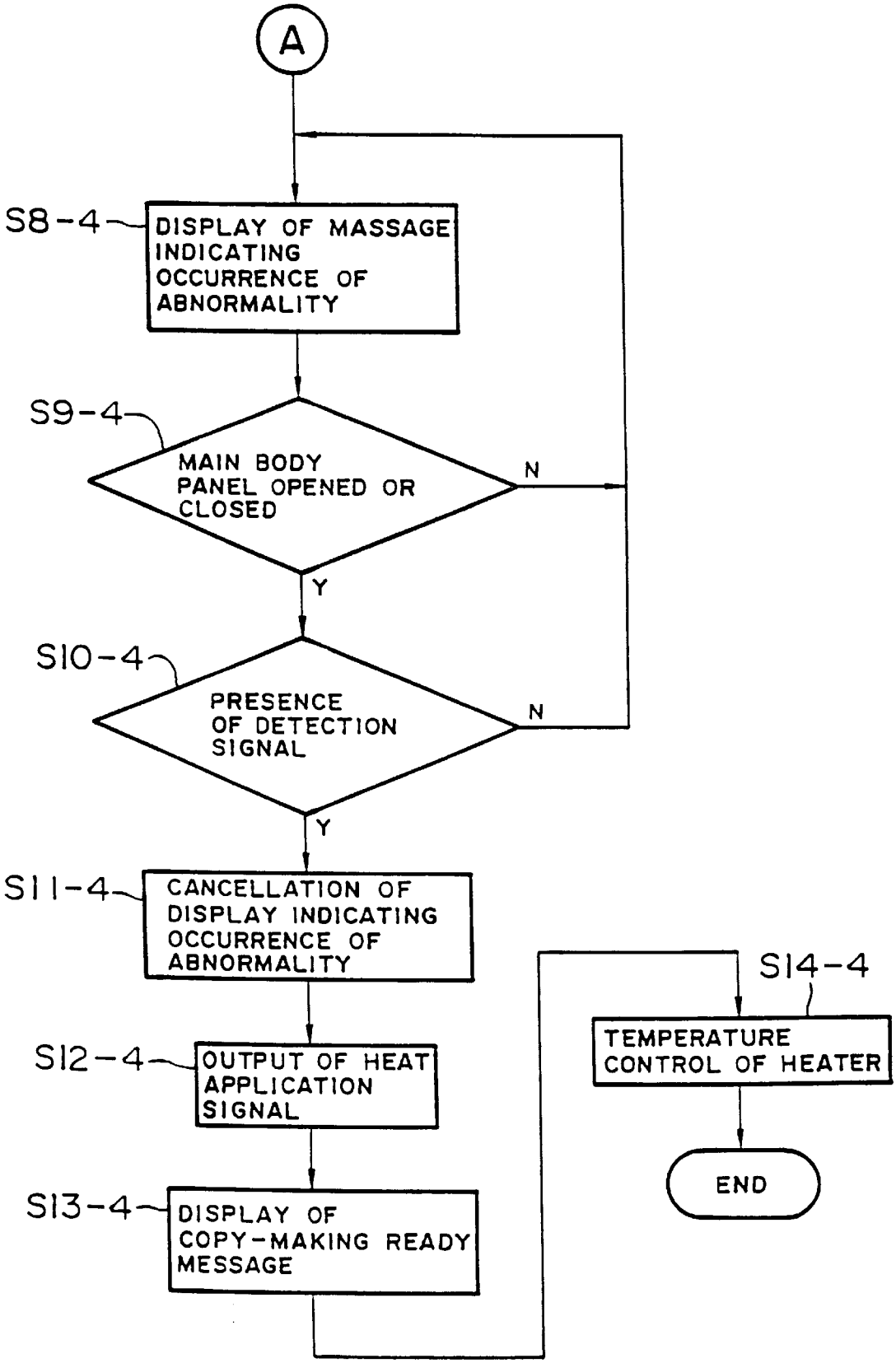
FIG. 46 is a flow chart of the control of the image formation apparatus, using CPU.

CPU 209 performs the controls as shown in FIG. 45 and FIG. 46, based on the detection signals from the panel detection circuit 202, the jam detection circuit 205 and the toner exchange detection circuit 206. More specifically, CPU 209 always checks the presence or absence of the detection signals from the jam detection circuit 205 and the toner exchange detection circuit 206 (Step S1-4). In the absence of the detection signals from the jam detection circuit 205 and the toner exchange detection circuit 206, CPU 209 repeats the process in Step S1-4.

When CPU 209 receives a detection signal from at least one of the jam detection circuit 205 or the toner exchange detection circuit 206 in Step S1-4, CPU 209 sends to the panel opening prohibition section 211 a panel opening prohibition instruction signal by which the opening of the main body panel 170 is inhibited (Step S2-4).

After Step S2-4, CPU 209 sends a heat application signal for fusing the phase transition layer 191B of the image fixing roller 191 to the heat application circuit 203 (Step S3-4).

After Step S3-4, CPU 209 counts the time. When the counted time amounts to a predetermined value, the completion of the fusing of the phase transition layer 191B of the image fixing roller 191 is detected (Step S4-4). When the fusing is not completed in Step S4-4, CPU 209 returns the process to Step S3-4.

CPU 209, when detecting the completion of the fusing in Step S4-4, sends a cooling signal for cooling the phase transition layer 191B of the image fixing roller 191 to the cooling circuit 204 (Step S5-4).

After Step S5-4, CPU 209 counts the time. When the counted time amounts to a predetermined value, the completion of the cooling of the phase transition layer 191B of the image fixing roller 191 is detected (Step S6-4). The completion of the cooling can be detected by measuring the temperature of the phase transition layer 191B of the image fixing roller 191.

When the cooling is not completed in Step S6-4, CPU 209 returns the process to Step S5-4.

CPU 209, when detecting the completion of the cooling in Step S6-4, outputs a cancellation instruction signal for instructing the cancellation of the prohibition of the opening of the main body panel 170 to the panel opening prohibition section 211 (Step S7-4).

After Step S7-4, CPU 209 sends a display signal indicating the occurrence of abnormality or a problem to the operation & display circuit 207, in accordance with the detection signal received in Step S1-4 (Step S8-4). For example, when CPU 209 receives a signal from the jam detection circuit 205, CPU 209 sends a display play signal indicating the miss-feed or paper jam to the operation & display circuit 207, and when CPU 209 receives a signal from the toner exchange detection circuit 206, CPU 209 sends a signal indicating the toner replenishment to the operation & display circuit 207.

CPU 209 checks whether or not the user who looks at the display in Step S8-4 opens the main body panel 170, based on the detection signal from the panel detection circuit 202 (Step S9-4). In the absence of the detection signal from the panel detection circuit 202 in Step S9-4, CPU 209 returns the process to Step S8-4.

After the opening or closing of the main body panel 170 is detected in Step S9-4, CPU 209 also checks the presence or absence of a detection signal from the jam detection circuit 205 or from the toner exchange detection circuit 206 (Step S10-4).

In the absence of the detection signal from the jam detection circuit 205 or from the toner exchange detection circuit 206 in Step S10-4, CPU 209 judges that the problem or abnormality is canceled, so that the display of the message in Step S8-4 is canceled (Step S11-4).

In the presence of the detection signal from the jam detection circuit 205 or from the toner exchange detection circuit 206 in Step S10-4, CPU 209 judges that the problem or abnormality is not canceled, and returns the process to Step S8-4.

After Step S11-4, CPU 209 sends a heat application signal for heating the image fixing roller 191 to the image fixing temperature to the heat application circuit 203 (Step S12-4). Thereafter, CPU 209 sends a display signal indicating the message that copy making is ready to the operation & display circuit 207 (Step S13-4).

After Step S13-4, CPU 209 sends a heat application signal for maintaining the image fixing roller 191 at the image fixing temperature to the heat application circuit 203 (Step S14-4).

CPU 209, upon receiving the detection signal in Step S1-4, sends to the panel opening prohibition section 11 a panel opening prohibition instruction signal in Step S2-4. However, the processing conducted by CPU 209 is not limited to the above-mentioned processing. For example, CPU 209, upon receiving the detection signal in Step S1-4, may perform the processes in Step S2-4 and Step S3-4 at the same time.

Furthermore, CPU 209, upon receiving the detection signal in Step S1-4, may send a heat application signal for fusing the phase transition layer 191B of the image fixing roller 191 to the heat application circuit 203, and thereafter may send a panel opening prohibition instruction signal to the panel opening prohibition section 211.

Figure 47:
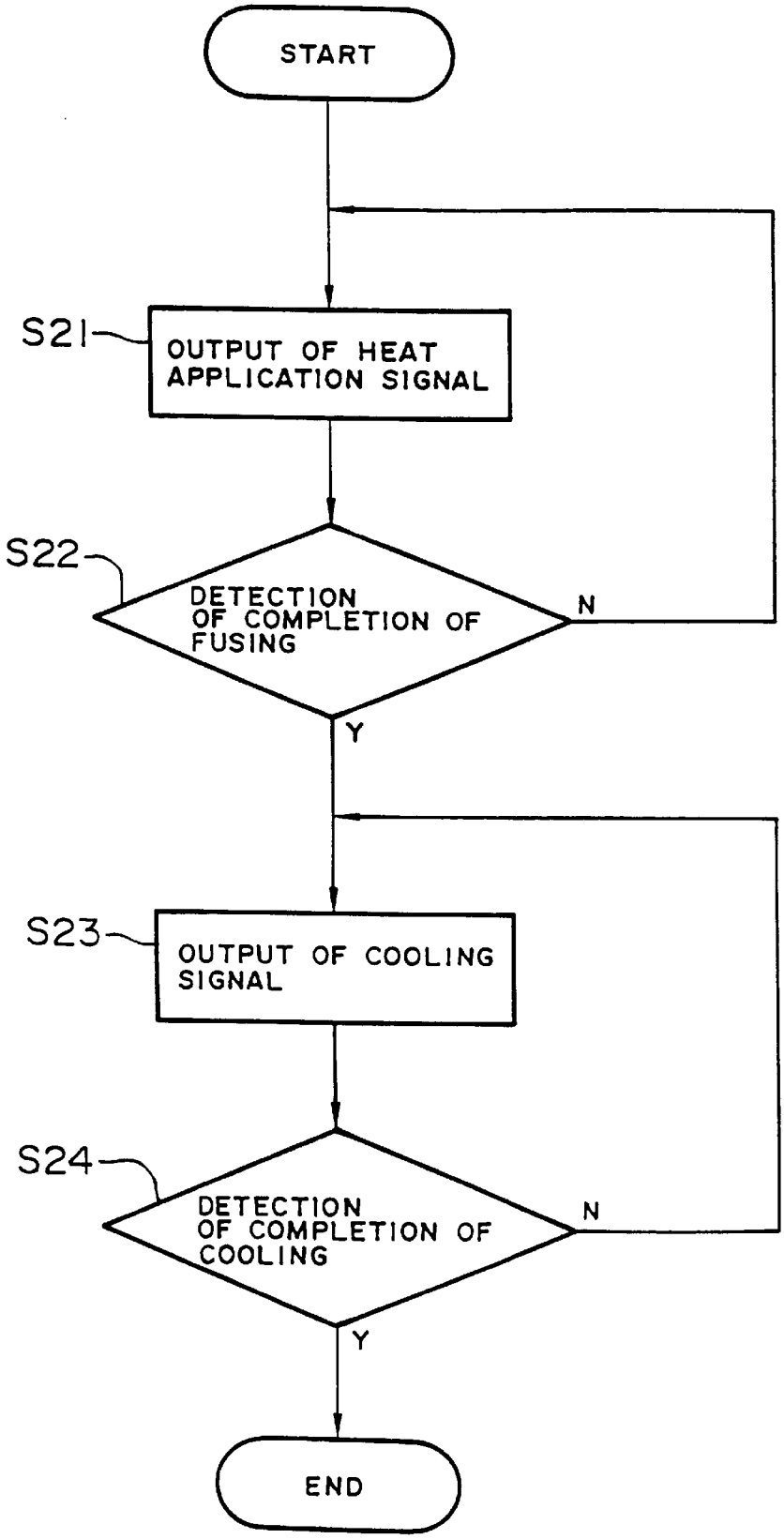
FIG. 47 is a flow chart of the control of the image formation apparatus, using CPU.
Figure 48:
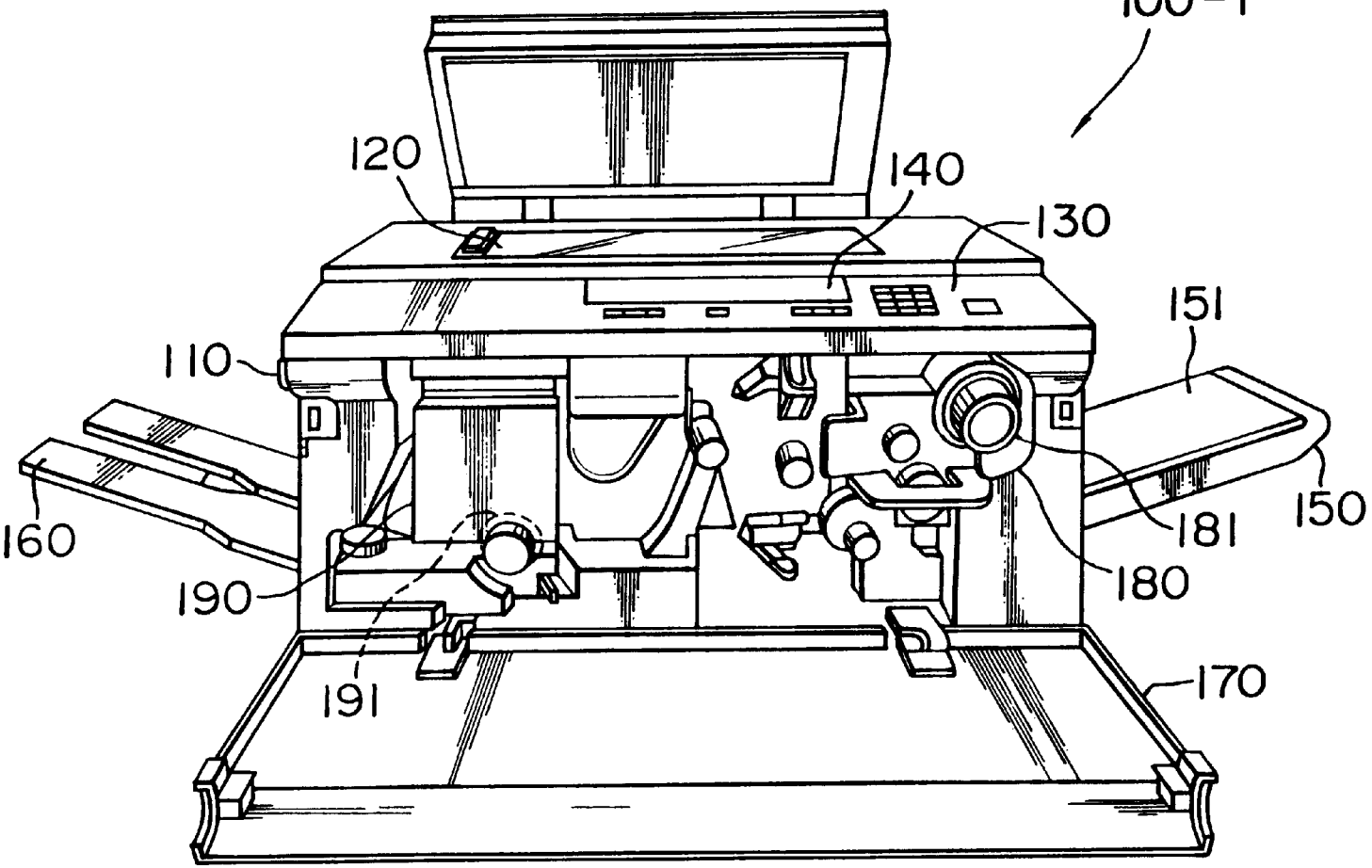
FIG. 48 is a perspective view of the image formation apparatus of the present invention.

CPU 209 performs the following controls, in addition to the controls in the above-mentioned Step S1-4 to Step S14-4. Namely, CPU 209 performs the processes from Step S21-4 to Step S24-4 shown in FIG. 47, when the main switch 110 is OFF. These processes are the same as in Step S3-4 to Step S6-4. By these processes, when the main switch 110 is turned OFF, the heating, fusing and cooling of the phase transition layer 191B of the image fixing roller 191 are performed, so that the phase transition layer 191B is subjected to the phase transition to the amorphous state. This is carried out in order to warm up the image fixing roller 191 to the image fixing temperature very quickly, by utilizing the crystallization heat released from the phase transition layer 191B.

The main switch 110 has a delay function. To be more specific, when the user turns OFF the main switch 110, the main switch 110 stops power supply to the image formation apparatus 100-1 after a predetermined delay time. CPU 209 performs the processes in Step S21-4 to S24-4 during this delay time.

CPU 209 sends a power-source OFF instruction signal to the switch circuit 201 upon receiving a detection signal indicating the opening of the main body panel 170 from the panel detection circuit 202 after the main switch 110 is turned ON. Furthermore, CPU 209 sets the temperature of the image fixing roller 191 at the image fixing temperature after the main switch 110 is turned ON, and thereafter maintains the temperature of the image fixing roller at the image fixing temperature by sending a heat application signal to maintain the image fixing temperature to the heat application circuit 203.

ROM 210 stores the procedures relating to the various controls conducted by CPU 209.

An example of the actual operation will now be explained.

When the user turns ON the main switch 110, the switch circuit 101 sends an ON detection signal to CPU 209 via the interface circuit 208.

CPU 209, upon receiving the detection signal from the switch circuit 201, sends a heat application signal for heating the image fixing roller 191 to the heat application circuit 203, whereby the temperature of the image fixing roller 191 can be increased to the image fixing temperature in a short time by utilizing the crystallization heat released from the phase transition layer 191B of the image fixing roller 191. Thereafter, CPU 209 controls the temperature of the image fixing roller 191 by normal heating, using the heater 191D, so as to maintain the image fixing temperature.

When the user turns OFF the main switch 110, since the main switch 110 has the above-mentioned delay function, the power supply to the image formation apparatus 100 is stopped after the delay time. During this delay time, CPU 209 carries out the processes in Step S21-4 to Step S24-4, whereby the phase transition layer 191B of the image fixing roller 191 is subjected to the phase transition to the amorphous state. As a result, at the next copy making operation, the warm-up of the image fixing roller 191 can be achieved in a short time by utilizing the crystallization heat released from the phase transition layer 191B.

When the image formation apparatus is in the image-fixing ready state, if paper jam occurs or toner runs out, the jam detection circuit 205 or the toner exchange detection circuit 206 detects this and send the detection signal to CPU 209 via the interface circuit 208.

When CPU 209 receives the detection signal from the jam detection circuit 205 or from the toner exchange detection circuit 206 in Step S1-4, CPU performs the process in Step S2-4. More specifically, CPU 209 sends a panel opening prohibition instruction signal to the panel opening prohibition section 211. The panel opening prohibition section 211, upon receiving the above instruction signal, locks the main body panel 170 and inhibits the opening of the main body panel 170.

Thereafter, CPU 209 performs the processes in Step S3-4 to Step S6-4. More specifically, CPU 209 performs the heating, fusing and cooling of the phase transition layer 191B of the image fixing roller 191, so that the phase transition of the phase transition layer 191B to the amorphous state is carried out. When this process is finished, CPU 209 outputs to the panel opening prohibition section 211 a cancellation instruction signal for canceling the prohibition of the opening of the main body panel 170, which is output in Step S2-4. Thus, the user can open the main body panel 170.

Thereafter, CPU 209 performs the process in Step S8-4, and sends a display signal indicating paper miss feeding, paper jam, or the necessity for toner replenishment, or the shortage of toner, if any, to the operation & display circuit 207.

The user, looking at the message indicating the paper jam or the shortage of toner, will open the main body panel 170, and cope with such a problem.

At this moment, the panel detection circuit 202 detects the opening or closing of the main body panel 170. The panel detection circuit 202, upon detecting the opening of the main body panel 170, sends the detection signal indicating the opening of the main body panel 170 to CPU 209.

CPU 209, upon receiving the detection signal, sends a power source OFF instruction signal to the switch circuit 201. The switch circuit 201, upon receiving this power source OFF instruction signal, stops the power supply to the image formation apparatus 100-1.

When the user closes the main body panel 170, the panel detection circuit 202 sends a detection signal indicating the closing of the main body panel 170 to CPU 209. CPU 209, upon receiving this detection signal, sends a power source ON instruction signal to the switch circuit 101. The switch circuit 101, upon receiving this power source ON instruction signal, resumes the power supply to the image formation apparatus 100-1.

When the user removes the paper jam or replenishes the toner, the jam detection circuit 205 and the toner exchange detection circuit 206 no longer output the respective detection signals. In the meantime, CPU 209 performs the process in Step S8-4, and then the processes in Step S9-4 and Step S10-4, whereby CPU 209 checks whether or not the abnormality has been removed by detecting the presence or absence of the detection signal from the jam detection circuit 205 or from the toner exchange detection circuit 206. When the abnormality is removed, CPU 209 cancels the display of the message in Step S8-4 by performing the process in Step S11-4.

CPU 209 sends a heat application signal to the heat application circuit 203 in order to set the image fixing roller 191 in an image fixable state by the process in Step S12-4. At this heating, since the image fixing roller 191 is in the amorphous state by the processes in Step S3-4 to Step S6-4, the image fixing roller 191 can be warmed up in a short time by utilizing the crystallization heat released from the phase transition layer 191B when used again thereafter.

After the temperature of the image fixing roller 191 is increased to the image fixing temperature by utilizing the crystallization heat, CPU 209 causes the operation & display circuit 207 to display the message indicating that copy making can be done by the process in Step S14-4. CPU 209 maintains the image fixing roller 191 at the temperature where image fixing can be done by Step S14-4.

In the above-mentioned example, even if the paper jam takes place or the toner runs out, and the temperature of the image fixing roller 191 becomes lower than the image fixing temperature while the user removes the jammed paper or replenishes the toner, the image fixing roller 191 can be heated by utilizing the crystallization heat. Therefore, the image fixing roller 191 can be set in the image fixable state in a short time.

What is claimed is:

1. An image formation apparatus comprising:

a switch configured to selectively set said image formation apparatus in an ON mode in which power is supplied to said image formation apparatus, or in an OFF mode in which power supply to said image formation apparatus is terminated;

an image forming unit configured to form a toner image on a sheet;

an image fixing unit configured to thermally fix said toner image to said sheet at a predetermined image fixing temperature, said image fixing unit including (a) a rotatable image fixing member, and (b) a heater configured to heat said rotatable image fixing member, said rotatable image fixing member including an exothermic phase transition layer and having a contact surface which contacts said toner image when said toner image is thermally fixed to said sheet, said exothermic phase transition layer including an exothermic phase transition material which performs reversible phase transition from an amorphous solid state to a crystalline state and vice versa and crystallizes at a crystallization temperature which is lower than said predetermined image fixing temperature, with liberation of crystallization heat therefrom, said exothermic phase transition material having a melting point higher than said predetermined image fixing temperature, thereby additionally increasing a temperature elevation rate before a temperature of said contact surface of said image fixing member reaches said predetermined image fixing temperature; and a controlling unit configured to control the temperature of said rotatable image fixing member such that in said ON mode, the temperature of the contact surface of said image fixing member reaches said predetermined image fixing temperature, by heating said exothermic phase transition material to cause said exothermic phase transition material to liberate said crystallization heat therefrom, thereby additionally increasing the temperature elevation rate before the temperature of said contact surface of said image fixing member reaches said predetermined image fixing temperature, and in said OFF mode, said heater heats said exothermic phase transition material to perform the phase transition from said crystalline state to a fused state, and then to terminate the heating, allowing said exothermic phase transition material to cool to change from said fused state to a solid amorphous state.

2. An image formation apparatus as claimed in claim 1, wherein said image fixing unit further comprises a cooling member configured to cool said exothermic phase transition material in said fused state to change to said solid amorphous state by said controlling unit in said OFF mode.

3. A method of controlling temperature of a rotatable image fixing member of an image fixing unit of an image formation apparatus, said image formation apparatus including a switch configured to selectively set said image formation apparatus in an ON mode in which power is supplied to said image formation apparatus, or in an OFF mode in which power supply to said image formation apparatus is terminated, an image forming unit configured to form a toner image on a sheet, and said image fixing unit configured to thermally fix said toner image to said sheet at a predetermined image fixing temperature, said image fixing unit including (a) said rotatable image fixing member, and (b) a heater configured to heat said rotatable image fixing member, said rotatable image fixing member including an exothermic phase transition layer and having a contact surface which contacts said toner image when said toner image is thermally fixed to said sheet, said exothermic phase transition layer including an exothermic phase transition material which performs reversible phase transition from an amorphous solid state to a crystalline state and vice versa and crystallizes at a crystallization temperature which is lower than said predetermined image fixing temperature, with liberation of crystallization heat therefrom, said exothermic phase transition material having a melting point higher than said predetermined image fixing temperature, thereby additionally increasing a temperature elevation rate before a temperature of said contact surface of said image fixing member reaches said predetermined image fixing temperature, said method comprising the steps of:

turning ON said switch to set said image formation apparatus in said ON mode;

heating said image fixing member such that said exothermic phase transition material is heated to liberate said crystallization heat therefrom, thereby additionally increasing the temperature elevation rate of the temperature of said contact surface of said image fixing member;

allowing said contact surface of said image fixing member to reach said predetermined image fixing temperature; and turning OFF said switch to set said image formation apparatus in said OFF mode, thereby causing said heater to heat said exothermic phase transition material to perform the phase transition from said crystalline state to a fused state; and terminating the heating, allowing said exothermic phase transition material to cool to change from said fused state to a solid amorphous state.

4. An image formation method as claimed in claim 3, wherein said image fixing unit further comprises a cooling member, and said method further comprises the step of cooling said exothermic phase transition material by said cooling member in said fused state to change to said solid amorphous state by said controlling unit in said OFF mode.

5. An image formation apparatus comprising:

an image forming unit configured to form a toner image on a sheet;

an image fixing unit configured to thermally fix said toner image to said sheet at a predetermined image fixing temperature, said image fixing unit including (a) a rotatable image fixing member, and (b) a heater configured to heat said rotatable image fixing member, said rotatable image fixing member including an exothermic phase transition layer and having a contact surface which contacts said toner image when said toner image is thermally fixed to said sheet, said exothermic phase transition layer including an exothermic phase transition material which performs reversible phase transition from an amorphous solid state to a crystalline state and vice versa and crystallizes at a crystallization temperature which is lower than said predetermined image fixing-temperature, with liberation of crystallization heat therefrom, said exothermic phase transition material having a melting point higher than said predetermined image fixing temperature, thereby additionally increasing a temperature elevation rate before a temperature of said contact surface of said image fixing member reaches said predetermined image fixing temperature; and a jam feeding detector configured to detect jamming of said sheet during feeding and configured to output a jam detection signal when detecting the jamming of said sheet, and further configured to detect removal of a jammed sheet when said jammed sheet is removed, and to output a jam removal detection signal when detecting removal of said jammed sheet, wherein said heater is configured to apply heat in a first control mode and in a second control mode, and in said first control mode, in accordance with said jam detection signal output, said heater heats said exothermic phase transition material to its melting point which is higher than said predetermined image fixing temperature to perform the phase transition from said crystalline state to a fused state, and to then terminate the heating, allowing said exothermic phase transition material to cool to change from said fused state to a solid amorphous state, and in said second control mode, in accordance with said jam removal detection signal output, said heater heats said exothermic phase transition material which is in said solid amorphous state in accordance with said first control mode, to heat said rotatable image fixing roller to said predetermined image fixing temperature, causing said exothermic phase transition material to liberate said crystallization heat therefrom, thereby additionally increasing the temperature elevation rate before the temperature of said contact surface of said image fixing member reaches said predetermined image fixing temperature.

6. An image formation apparatus as claimed in claim 5, further comprising a jam feeding display unit configured to display occurrence of the jamming of said sheet in accordance with said jam detection signal output and a result of the jamming of said sheet after the phase transition of said exothermic phase transition material from said crystalline state to said solid amorphous state has been completed in said first control mode.

7. An image formation apparatus as claimed in claim 5, wherein said image fixing unit further comprises a cooling member configured to cool said exothermic phase transition material in said fused state to change to said solid amorphous state in accordance with said jam detection signal output in said first control mode.

8. A method of forming images, using an image formation apparatus including an image forming unit configured to form a toner image on a sheet, an image fixing unit configured to thermally fix said toner image to said sheet at a predetermined image fixing temperature, said image fixing unit including (a) a rotatable image fixing member, and (b) a heater configured to heat said rotatable image fixing member, said rotatable image fixing member including an exothermic phase transition layer and having a contact surface which contacts said toner image when said toner image is thermally fixed to said sheet, said exothermic phase transition layer including an exothermic phase transition material which performs reversible phase transition from an amorphous solid state to a crystalline state and vice versa and crystallizes at a crystallization temperature which is lower than said predetermined image fixing temperature, with liberation of crystallization heat therefrom, said exothermic phase transition material having a melting point higher than said predetermined image fixing temperature, thereby additionally increasing a temperature elevation rate before a temperature of said contact surface of said image fixing member reaches said predetermined image fixing temperature, and a jam feeding detector configured to detect jamming of said sheet during feeding and configured to output a jam detection signal when detecting jamming of said sheet, and further configured to detect removal of a jammed sheet when said jammed sheet is removed, and to output a jam removal detection signal when detecting removal of said jammed sheet, said method comprising the steps of:

first heating, when the jamming of said sheet is detected by said jam feeding detector during the feeding of said sheet, said exothermic phase transition material, using said heater, to its melting point which is higher than said predetermined image fixing temperature to perform the phase transition from said crystalline state to a fused state;

terminating the heating, allowing said exothermic phase transition material to cool to change from said fused state to a solid amorphous state;

second heating, when the removal of said jammed sheet is detected by said jam feeding detector, said exothermic phase transition material which is in said solid amorphous state to heat said rotatable image fixing roller to said predetermined image fixing temperature, using said heater, while causing said exothermic phase transition material to liberate said crystallization heat therefrom, thereby additionally increasing the temperature elevation rate before the temperature of said contact surface of said image fixing member reaches said predetermined image fixing temperature.

9. A method of forming images as claimed in claim 8, wherein said image formation apparatus further comprises a jam feeding display unit, and said method further comprising the step of displaying a result of the jamming of said sheet on said jam feeding display unit after the phase transition of said exothermic phase transition material from said crystalline state to said solid amorphous state has been completed.

10. An image formation apparatus comprising:

image formation means for forming a toner image on a sheet;

image fixing means for thermally fixing said toner image to said sheet at a predetermined image fixing temperature, said image fixing means including (a) a rotatable image fixing member, and (b) heater means for heating said rotatable image fixing member, said rotatable image fixing member including an exothermic phase transition layer and having a contact surface which contacts said toner image when said toner image is thermally fixed to said sheet, said exothermic phase transition layer including an exothermic phase transition material which performs reversible phase transition from an amorphous solid state to a crystalline state and vice versa and crystallizes at a crystallization temperature which is lower than said predetermined image fixing temperature, with liberation of crystallization heat therefrom, said exothermic phase transition material having a melting point higher than said predetermined image fixing temperature, thereby additionally increasing a temperature elevation rate before a temperature of said contact surface of said image fixing member reaches said predetermined image fixing temperature;

jam feeding detection means for detecting jamming of said sheet during feeding thereof and for outputting a jam detection signal when detecting the jamming of said sheet, and further for detecting removal of a jammed sheet when said jammed sheet is removed, and for outputting a jam removal detection signal when detecting the removal of said jammed sheet;

first phase transition means for energizing said heater means in accordance with said jam detection signal to heat said exothermic phase transition material to its melting point thereof which is higher than said predetermined image fixing temperature, thereby performing the phase transition from said crystalline state to a fused state, and for then terminating the heating, allowing said exothermic phase transition material to cool to change from said fused state to a solid amorphous state; and second phase transition means for energizing said heater means in accordance with said jam removal detection signal to heat said exothermic phase transition material which is in said solid amorphous state by said first phase transition means, to heat said rotatable image fixing roller to said predetermined image fixing temperature, causing said exothermic phase transition material to liberate said crystallization heat therefrom, thereby additionally increasing the temperature elevation rate before the temperature of said contact surface of said image fixing member reaches said predetermined image fixing temperature.

11. An image formation apparatus as claimed in claim 10, wherein said first phase transition means comprises:

(a) fusing means for heating said exothermic phase transition material to its melting point thereof which is higher than said predetermined image fixing temperature, thereby performing the phase transition from said crystalline state to a fused state; and (b) cooling means for terminating the heating, allowing said exothermic phase transition material to cool to change from said fused state to said solid amorphous state.

12. The image formation apparatus as claimed in claim 11, further comprising:

operation state display means for displaying a state of operation of said image formation apparatus; and jam feeding display control means for displaying a state of the jamming of said sheet detected by said jam feeding detection means in said operation state display means after the phase transition of said exothermic phase transition material from said crystalline state to said amorphous state has been completed by said cooling means.

13. An image formation apparatus as claimed in claim 10, further comprising:

jam feeding display means for displaying the detection of the jamming of said sheet during the feeding thereof; and jam feeding display control means for displaying a state of the jamming of said sheet detected by said jam feeding detection means in said jam feeding display means after the phase transition of said exothermic phase transition material from said crystalline state to said amorphous state has been completed by said first phase transition means.

14. An image formation apparatus comprising:

an image forming unit configured to form a toner image on a sheet;

an image fixing unit configured to thermally fix said toner image to said sheet at a predetermined image fixing temperature, said image fixing unit including (a) a rotatable image fixing member, and (b) a heater configured to heat said rotatable image fixing member, said rotatable image fixing member including an exothermic phase transition layer and having a contact surface which contacts said toner image when said toner image is thermally fixed to said sheet, said exothermic phase transition layer including an exothermic phase transition material which performs reversible phase transition from an amorphous solid state to a crystalline state and vice versa and crystallizes at a crystallization temperature which is lower than said predetermined image fixing temperature, with liberation of crystallization heat therefrom, said exothermic phase transition material having a melting point higher than said predetermined image fixing temperature, thereby additionally increasing a temperature elevation rate before a temperature of said contact surface of said image fixing member reaches said predetermined image fixing temperature; and a toner shortage detector configured to detect a shortage of toner during an operation of said image formation apparatus and to output a toner shortage detection signal when detecting the shortage of said toner, and further configured to detect supplying of said toner when said toner has been supplied, and output a toner supply detection signal when detecting the supplying of said toner, wherein said heater is further configured to apply heat in a first control mode and in a second control mode, and in said first control mode, in accordance with said toner shortage detection signal output, said heater heats said exothermic phase transition material to its melting point which is higher than said predetermined image fixing temperature to perform the phase transition from said crystalline state to a fused state, and to then terminate the heating, allowing said exothermic phase transition material to cool to change from said fused state to a solid amorphous state, and in said second control mode, in accordance with said toner supply detection signal output, said heater heats said exothermic phase transition material which is in said solid amorphous state in accordance with said first control mode, to heat said rotatable image fixing roller to said predetermined image fixing temperature, causing said exothermic phase transition material to liberate said crystallization heat therefrom, thereby additionally increasing the temperature elevation rate before the temperature of said contact surface of said image fixing member reaches said predetermined image fixing temperature.

15. An image formation apparatus as claimed in claim 14, further comprising a toner shortage display unit configured to display the toner shortage during the operation of said image formation apparatus in accordance with said toner shortage detection signal output, detected by said toner shortage detector, and further configured to display a result of the detection of the toner shortage after the phase transition of said exothermic phase transition material from said crystalline state to said solid amorphous state has been completed in said first control mode.

16. An image formation apparatus as claimed in claim 14, wherein said image fixing unit further includes a cooling member configured to cool said exothermic phase transition material in said fused state to change to said solid amorphous state in accordance with said toner detection signal output in said first control mode.

17. A method of forming images, using an image formation apparatus including an image forming unit configured to form a toner image on a sheet, an image fixing unit configured to thermally fix said toner image to said sheet at a predetermined image fixing temperature, said image fixing unit including (a) a rotatable image fixing member, and (b) a heater configured to heat said rotatable image fixing member, said rotatable image fixing member including an exothermic phase transition layer and having a contact surface which contacts said toner image when said toner image is thermally fixed to said sheet, said exothermic phase transition layer including an exothermic phase transition material which performs reversible phase transition from an amorphous solid state to a crystalline state and vice versa and crystallizes at a crystallization temperature which is lower than said predetermined image fixing temperature, with liberation of crystallization heat therefrom, said exothermic phase transition material having a melting point higher than said predetermined image fixing temperature, thereby additionally increasing a temperature elevation rate before a temperature of said contact surface of said image fixing member reaches said predetermined image fixing temperature, and a toner shortage detector configured to detect shortage of said toner during an operation of said image formation apparatus and to output a toner shortage detection signal when detecting the shortage of said toner, and further configured to detect supplying of said toner when said toner has been supplied, and to output a toner supply detection signal when detecting the supplying of said toner, said method comprising the steps of:

first heating, when the shortage of said toner is detected by said toner shortage detector during operation of said image formation apparatus, said exothermic phase transition material, using said heater, to its melting point which is higher than said predetermined image fixing temperature to perform the phase transition from said crystalline state to a fused state;

terminating the heating, allowing said exothermic phase transition material to cool to change from said fused state to a solid amorphous state; and second heating, when the supplying of said toner is detected, said exothermic phase transition material which is in said solid amorphous state, using said heater, to heat said rotatable image fixing roller to said predetermined image fixing temperature, causing said exothermic phase transition material to liberate said crystallization heat therefrom, thereby additionally increasing the temperature elevation rate before the temperature of said contact surface of said image fixing member reaches said predetermined image fixing temperature.

18. A method of forming images as claimed in claim 17, wherein said image formation apparatus further comprises a toner shortage display unit, and said method further comprising the step of displaying a result of a shortage of said toner after the phase transition of said exothermic phase transition material from said crystalline state to said solid amorphous state has been completed.

19. An image formation apparatus comprising:

image formation means for forming a toner image on a sheet;

image fixing means for thermally fixing said toner image to said sheet at a predetermined image fixing temperature, said image fixing means including (a) a rotatable image fixing member, and (b) heater means for heating said rotatable image fixing member, said rotatable image fixing member including an exothermic phase transition layer and having a contact surface which contacts said toner image when said toner image is thermally fixed to said sheet, said exothermic phase transition layer including an exothermic phase transition material which performs reversible phase transition from an amorphous solid state to a crystalline state and vice versa and crystallizes at a crystallization temperature which is lower than said predetermined image fixing temperature, with liberation of crystallization heat therefrom, said exothermic phase transition material having a melting point higher than said predetermined image fixing temperature, thereby additionally increasing a temperature elevation rate before a temperature of said contact surface of said image fixing member reaches said predetermined image fixing temperature;

toner shortage detection means for detecting shortage of said toner during an operation of said image formation apparatus and for outputting a toner shortage detection signal when detecting the shortage of said toner, and further for detecting supplying of said toner when said toner has been supplied, and for outputting a toner supply detection signal when detecting the supplying of said toner;

first phase transition means for heating said exothermic phase transition material to its melting point which is higher than said predetermined image fixing temperature in accordance with said toner shortage detection signal output, thereby performing the phase transition from said crystalline state to a fused state, and for then terminating the heating, allowing said exothermic phase transition material to cool to change from said fused state to a solid amorphous state; and second phase transition means for heating said exothermic phase transition material which is in said solid amorphous state by said first phase transition means, in accordance with said toner supply detection signal output, to heat said rotatable image fixing roller to said predetermined image fixing temperature, causing said exothermic phase transition material to liberate said crystallization heat therefrom, thereby additionally increasing the temperature elevation rate before the temperature of said contact surface of said image fixing member reaches said predetermined image fixing temperature.

20. The image formation apparatus as claimed in claim 19, wherein said first phase transition means comprises:

(a) fusing means for heating said exothermic phase transition material to its melting point which is higher than said predetermined image fixing temperature, thereby performing the phase transition from said crystalline state to a fused state; and (b) cooling means for cooling said exothermic phase transition material to change from said fused state to said solid amorphous state.

21. The image formation apparatus as claimed in claim 20, further comprising:

toner shortage display means for displaying a result of the detection of the shortage of said toner by said toner shortage detection means; and toner shortage display control means for displaying a state of the shortage of said toner detected by said toner shortage detection means in said toner shortage display means after the phase transition of said exothermic phase transition material from said crystalline state to said amorphous state has been completed by said cooling means.

22. The image formation apparatus as claimed in claim 19, further comprising:

toner shortage display means for displaying the detection of the shortage of said toner during the operation of said image formation apparatus; and toner shortage display control means for displaying the shortage of said toner detected by said toner shortage detection means in said toner shortage display means after the phase transition of said exothermic phase transition material from said crystalline state to said amorphous state has been completed by said first phase transition means.

* * * * *

UNITED STATES PATENT AND TRADEMARK OFFICE

CERTIFICATE OF CORRECTION

PATENT NO. : 6,064,850

DATED : MAY 16, 2000

INVENTOR(S): MINORU MATSUO, ET AL.

It is certified that an error appears in the above-identified patent and that said Letters Patent is hereby corrected as shown below:

In column 2, line 23, change "worm-up" to --warm-up --.
In column 11, line 28, change "cylidrical" to --cylindrical--.
line 38, change "cylidrical" to --cylindrical--.
In column 13, line 6, change "cites" to --sites--.
line 16, change "sate" to --state--.
In column 18, line 20, in second occurrence, delete "period".
line 27, change "484" to -- 48-4 --.
line 40, change "abovementioned" to --above-mentioned--.
In column 20, line 6, change "abovementioned" to --above-mentioned--.
In column 24, line 20, change "proceeds" to --proceed--.
In column 27, line 3, change "process" to --processed--.
In column 32, line 46, change "Step" to --Step 51-2.--.
line 50, change "548-4" to -- 48-4 --.
In column 35, line 51, change "cooing" to --cooling--.
In column 36, line 6, in first occurrence, change "208" to --209--.
line 20, change "CUP" to --CPU--.
In column 37, line 22, change "58-3" to --S8-3--.
In column 40, line 47, change "cooing" to --cooling--.
line 53, change "pint" to --point--.
In column 41, line 2, in first occurrence, change "208" to --209--.
line 16, change "CUP" to --CPU--.

UNITED STATES PATENT AND TRADEMARK OFFICE

CERTIFICATE OF CORRECTION

PATENT NO. : 6,064,850
DATED : MAY 16, 2000
INVENTOR(S) : MINORU MATSUO, ET AL.

It is certified that error appears in the above-identified patent and that said Letters Patent is hereby corrected as shown below:

In column 44, line 2, change "miss feeding" to --mis-feeding--.
In column 48, line 13, delete "while".

Signed and Sealed this

Twenty-second Day of May, 2001

*Attest:*

Nicholas P. Godici

NICHOLAS P. GODICI

*Attesting Officer*

*Acting Director of the United States Patent and Trademark Office*